US012767364B1

(12) United States Patent
Dueweke et al.

(10) Patent No.: US 12,767,364 B1
(45) Date of Patent: Oct. 20, 2026

(54) INJECTION DEVICE FOR PAPER CONES

(71) Applicant: Sesh Technologies Manufacturing Inc., Spokane, WA (US)

(72) Inventors: Jason Dueweke, Deer Park, WA (US); Eric Robbs, Spokane Valley, WA (US)

(73) Assignee: Sesh Technologies Manufacturing Inc., Spokane, WA (US)

( * ) Notice: Subject to any disclaimer, the term of this patent is extended or adjusted under 35 U.S.C. 154(b) by 86 days.

(21) Appl. No.: 18/947,769

(22) Filed: Nov. 14, 2024

Related U.S. Application Data

(60) Provisional application No. 63/600,611, filed on Nov. 17, 2023.

(51) Int. Cl.
*B65B 3/12* (2006.01)
*B65B 43/54* (2006.01)
*B65B 57/04* (2006.01)

(52) U.S. Cl.
CPC ..... *B65B 3/12* (2013.01); *B65B 43/54* (2013.01); *B65B 57/04* (2013.01)

(58) Field of Classification Search
CPC ..... B65B 3/12; B65B 43/54; B65B 57/04
See application file for complete search history.

(56) References Cited

U.S. PATENT DOCUMENTS

| | | | | |
|---|---|---|---|---|
| 11,937,627 | B2 * | 3/2024 | Sullivan | A24C 5/32 |
| 11,975,505 | B2 * | 5/2024 | Dueweke | B31C 7/00 |
| 12,545,449 | B2 * | 2/2026 | Ng | B65B 3/003 |

* cited by examiner

*Primary Examiner* — Frederick C Nicolas
(74) *Attorney, Agent, or Firm* — Lee & Hayes, P.C.

(57) ABSTRACT

A device includes a reservoir, a manifold, plungers, needles, at least one actuator coupled to the plungers, and one or more tracks configured to receive a tray containing paper cones. The reservoir has a cavity configured to receive a fluid and channels fluidly connected to the cavity. The manifold has channels fluidly connected to the channels of the reservoir, and chambers fluidly connected to the channels in the manifold. The plungers are disposed within the channels of the manifold and the needles are fluidly connected to the chambers. The device actuates the tray to align the paper cones with the needles, and actuates the at least one actuator to dispense the fluid from the needles into the paper cones.

20 Claims, 47 Drawing Sheets

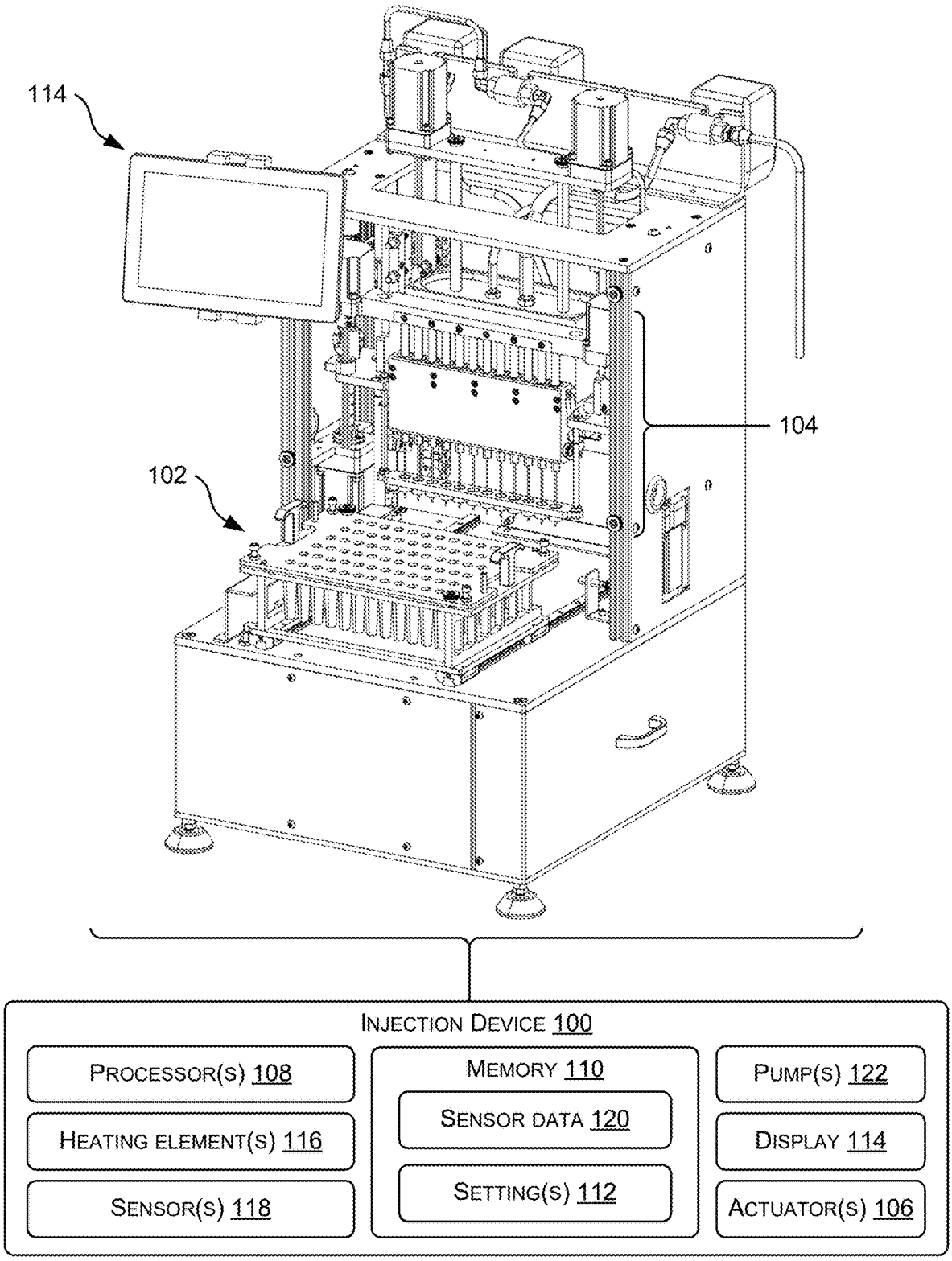
FIG. 1
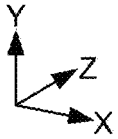

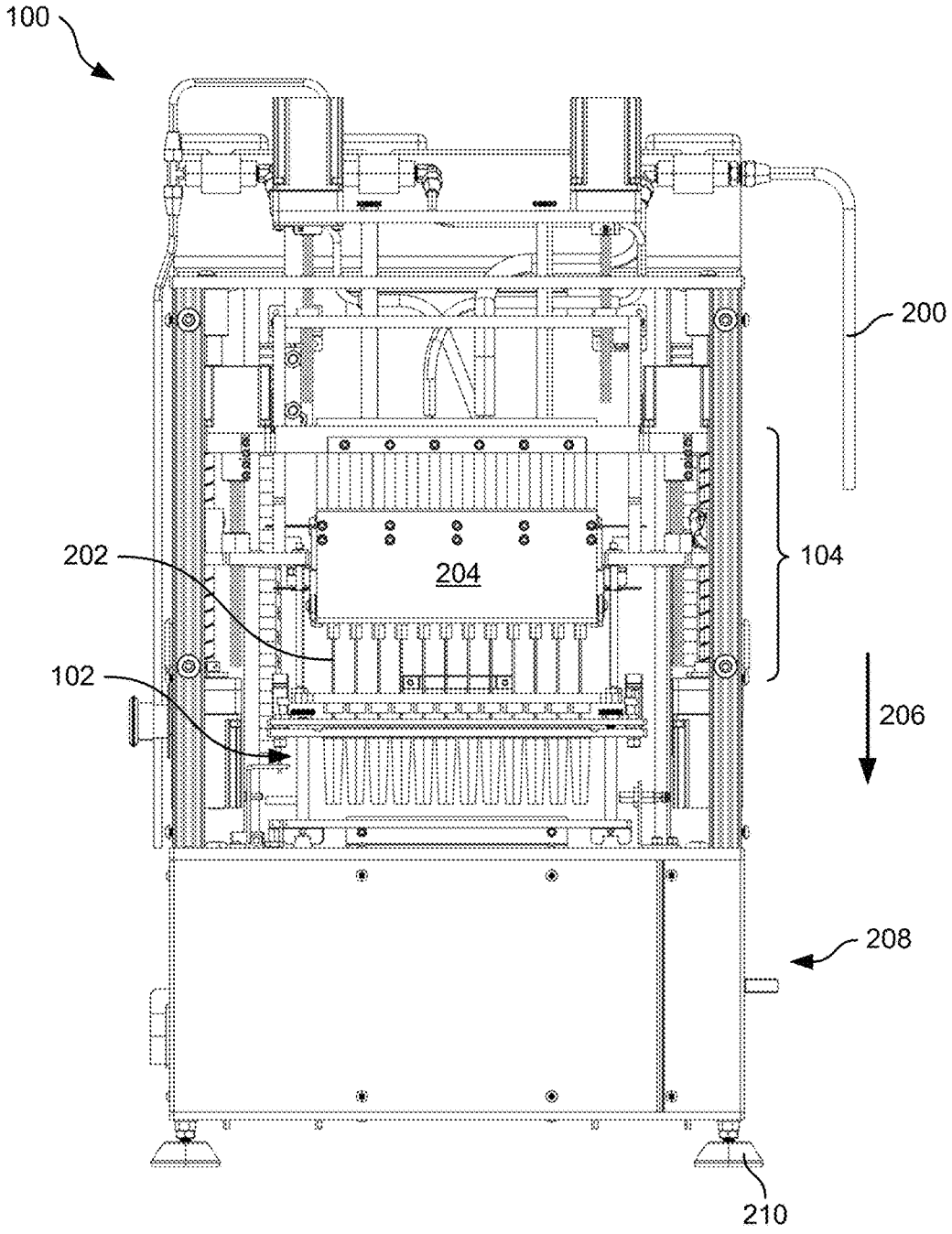
FIG. 2
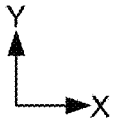

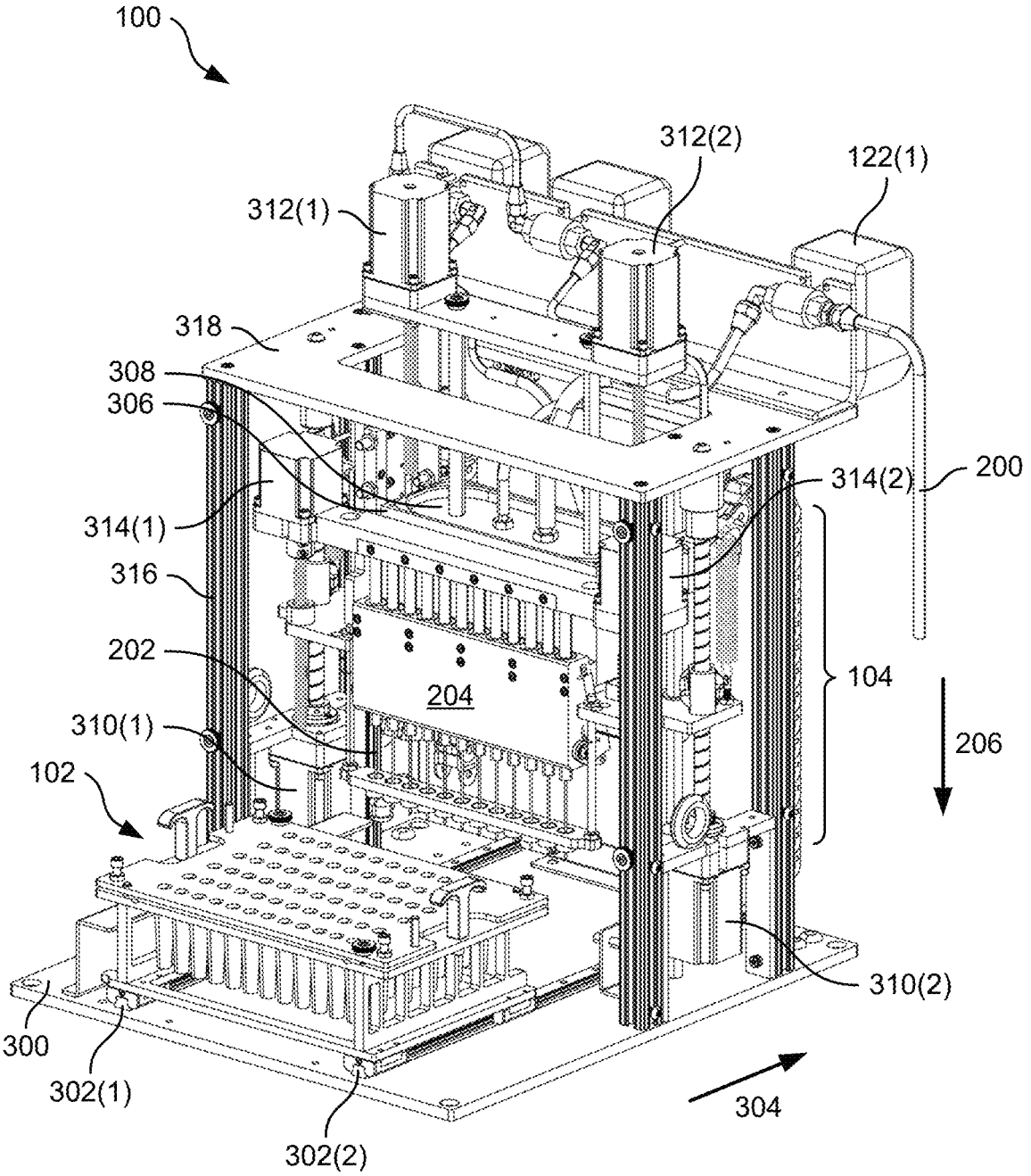
FIG. 3A
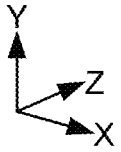

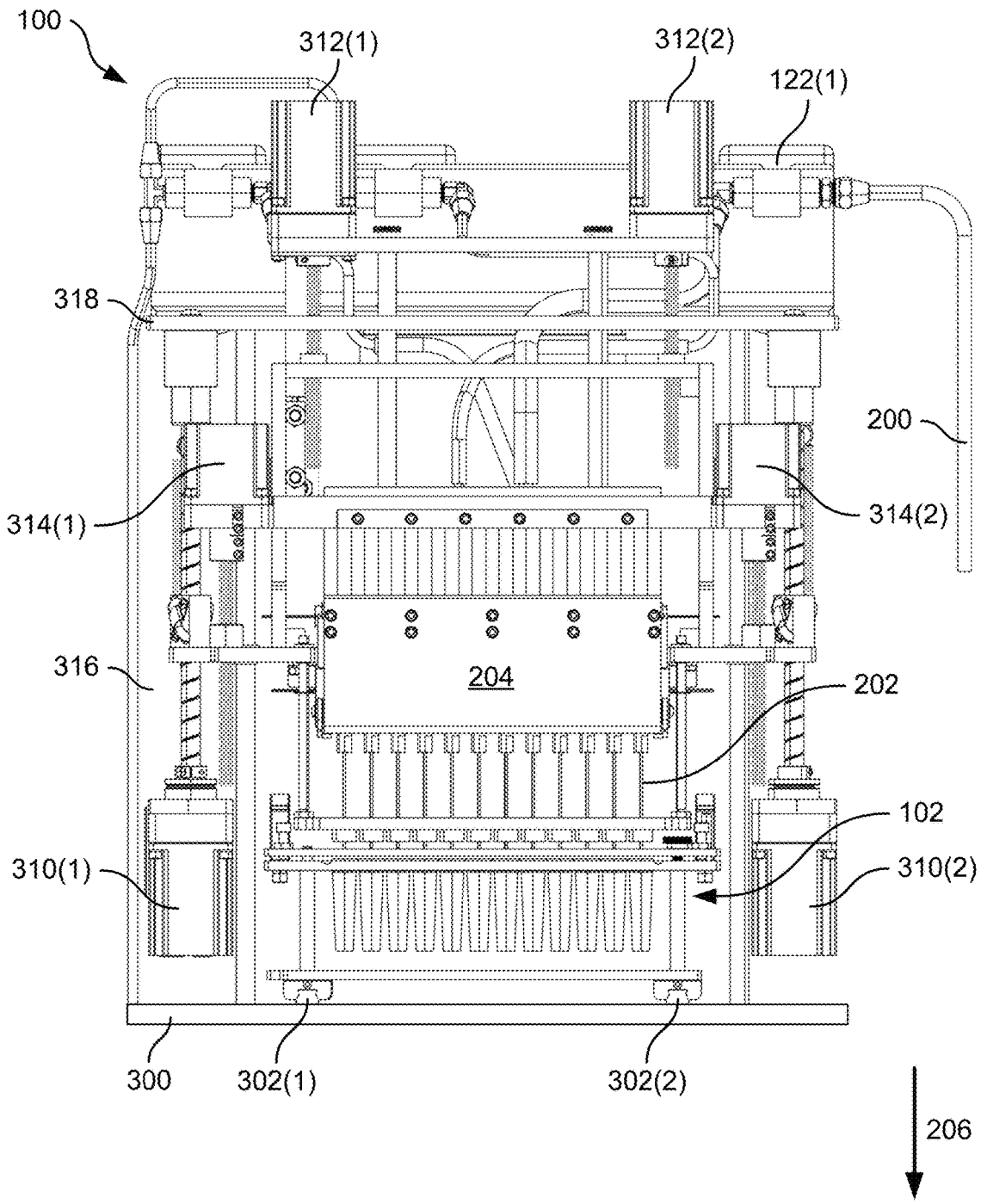
FIG. 3B
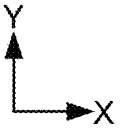

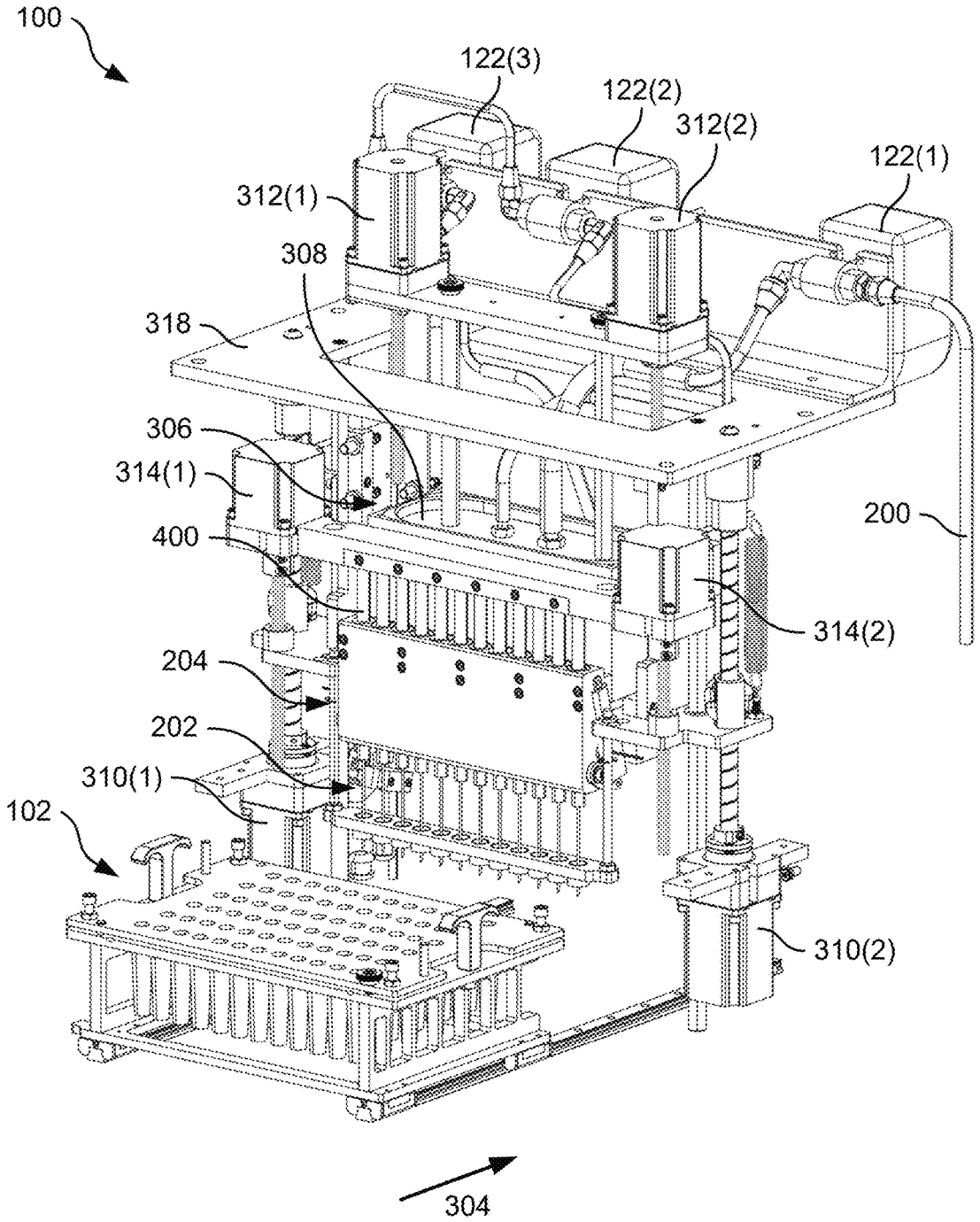
FIG. 4A
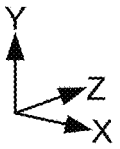

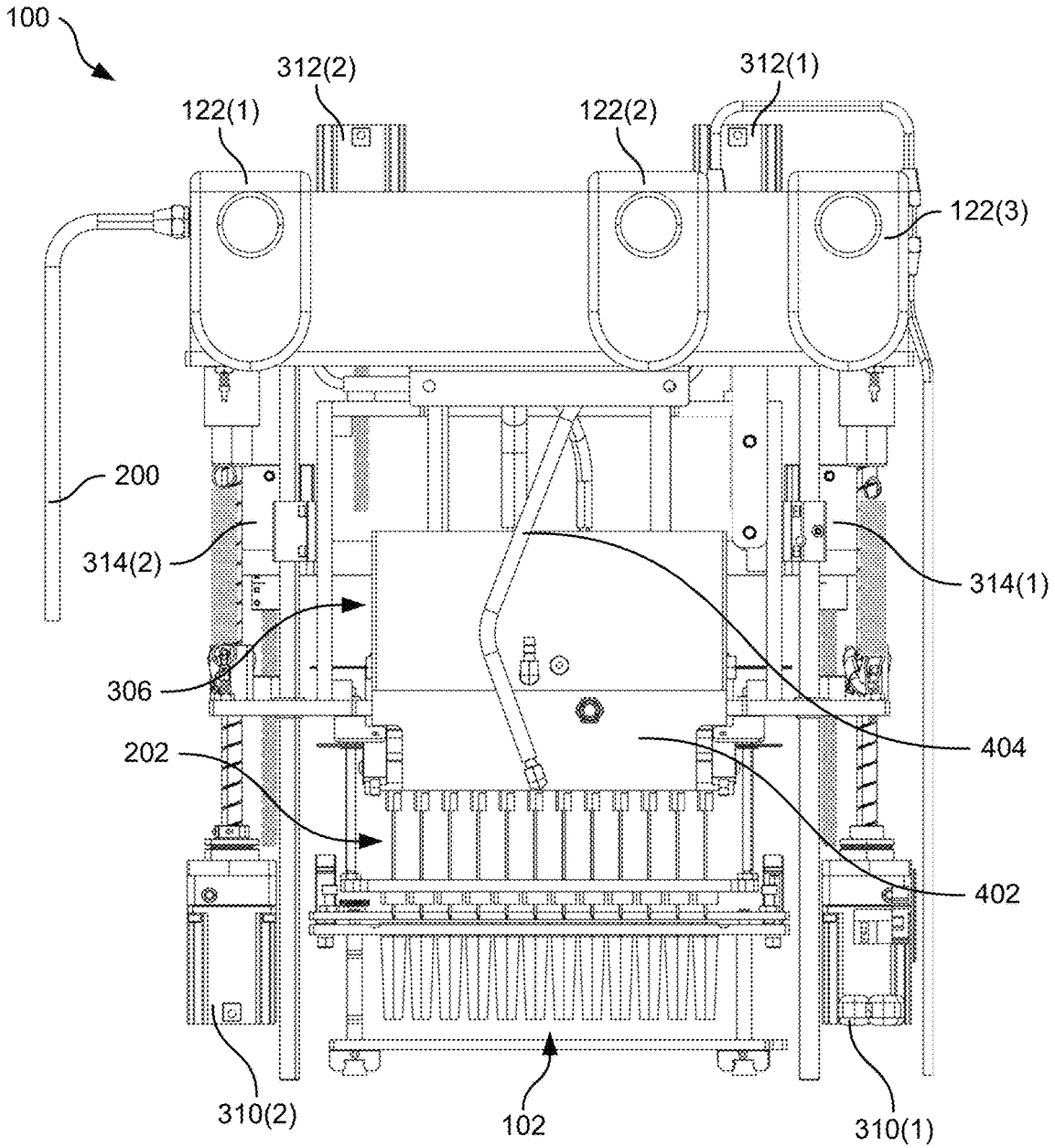
FIG. 4C
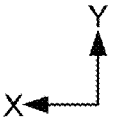

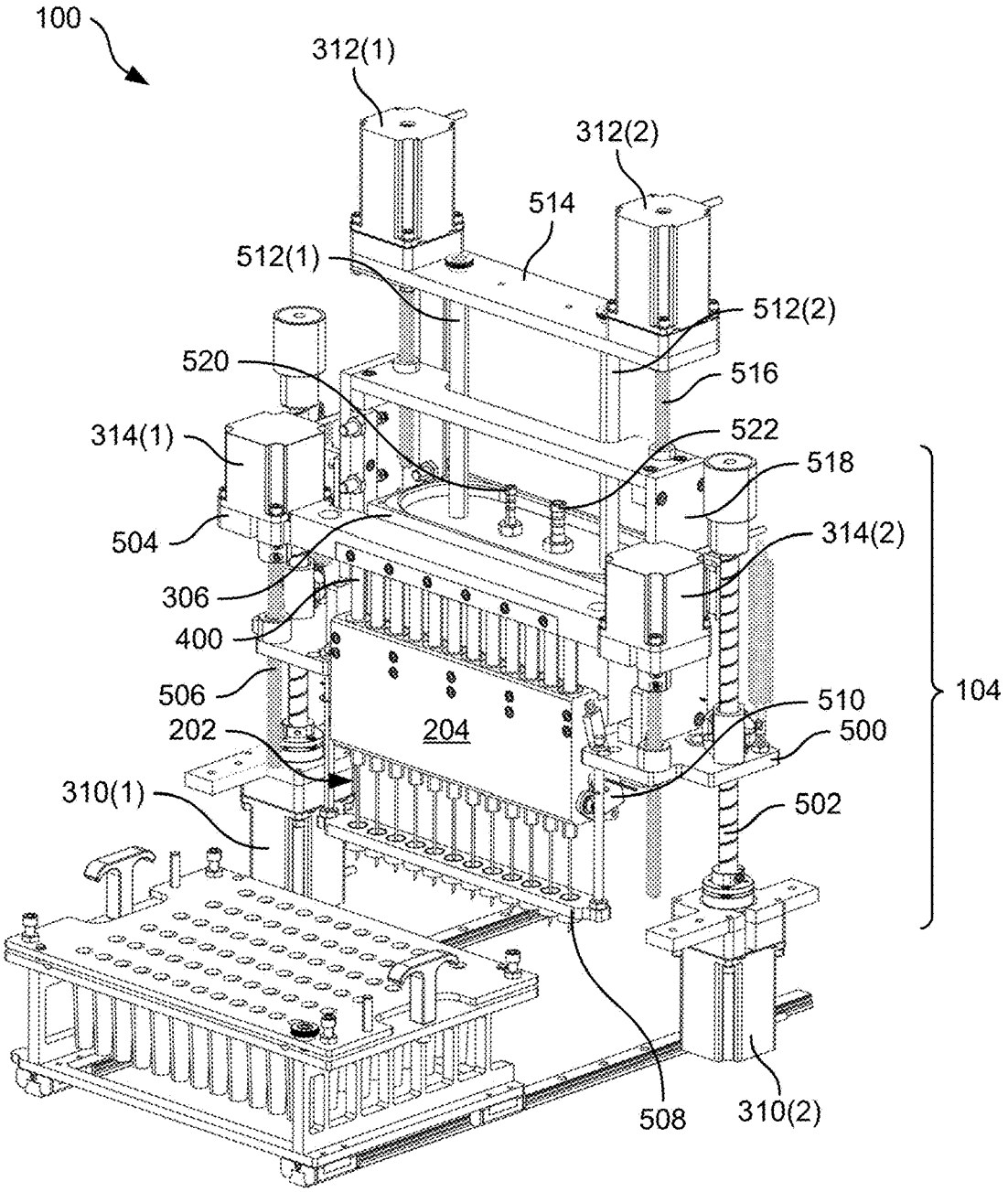
FIG. 5A
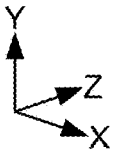

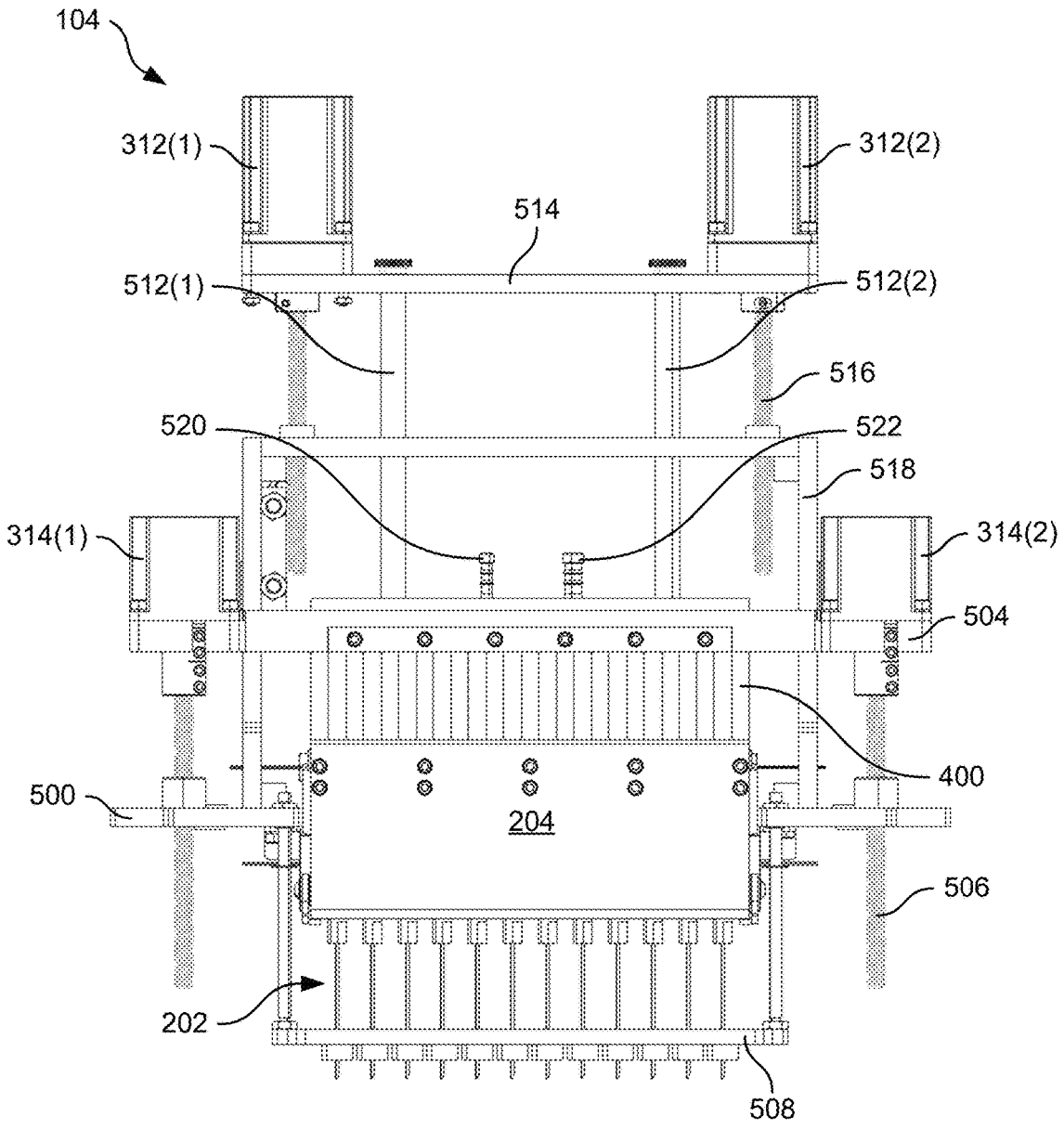
FIG. 5B
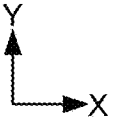

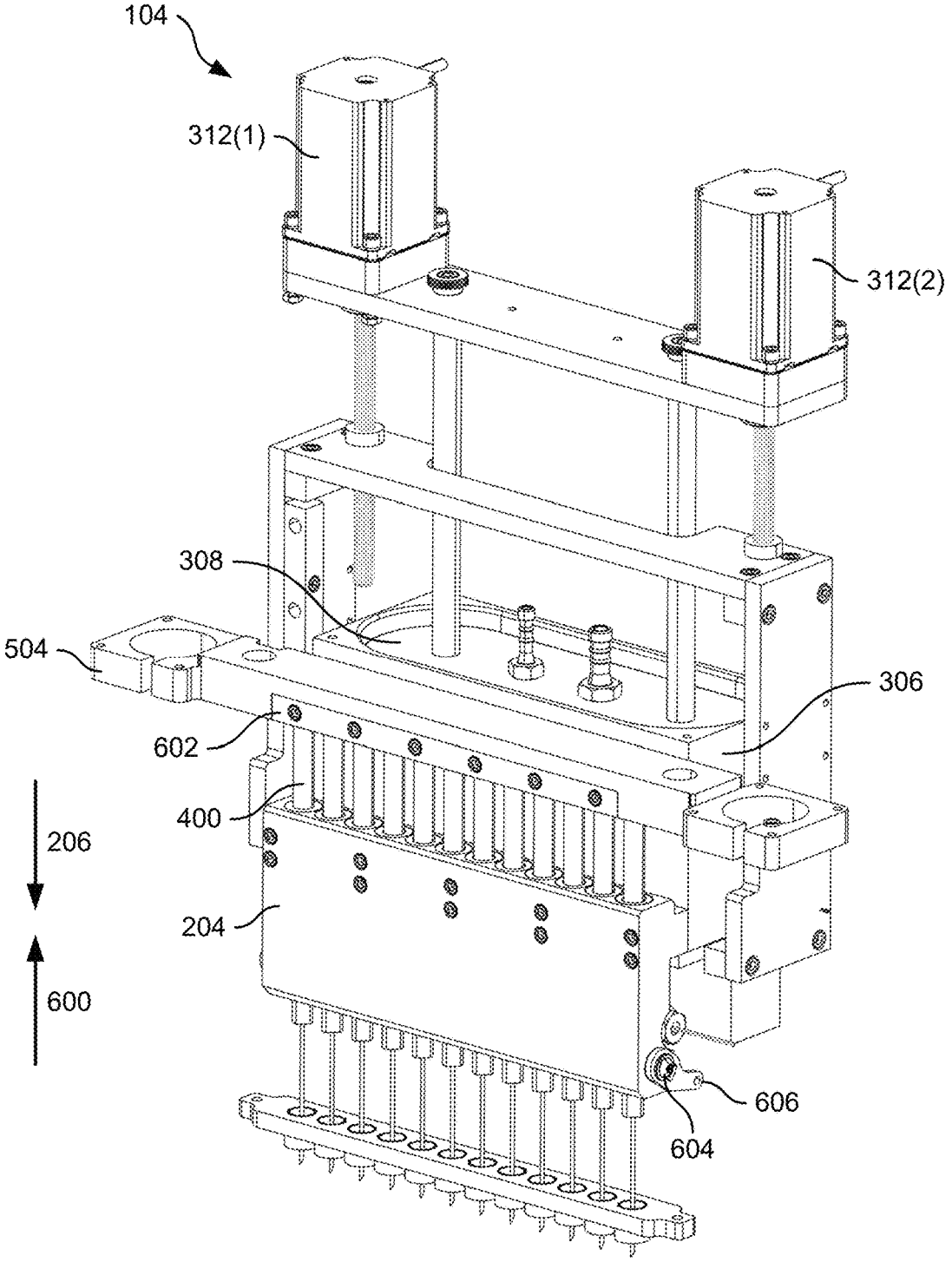
FIG. 6
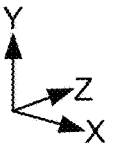

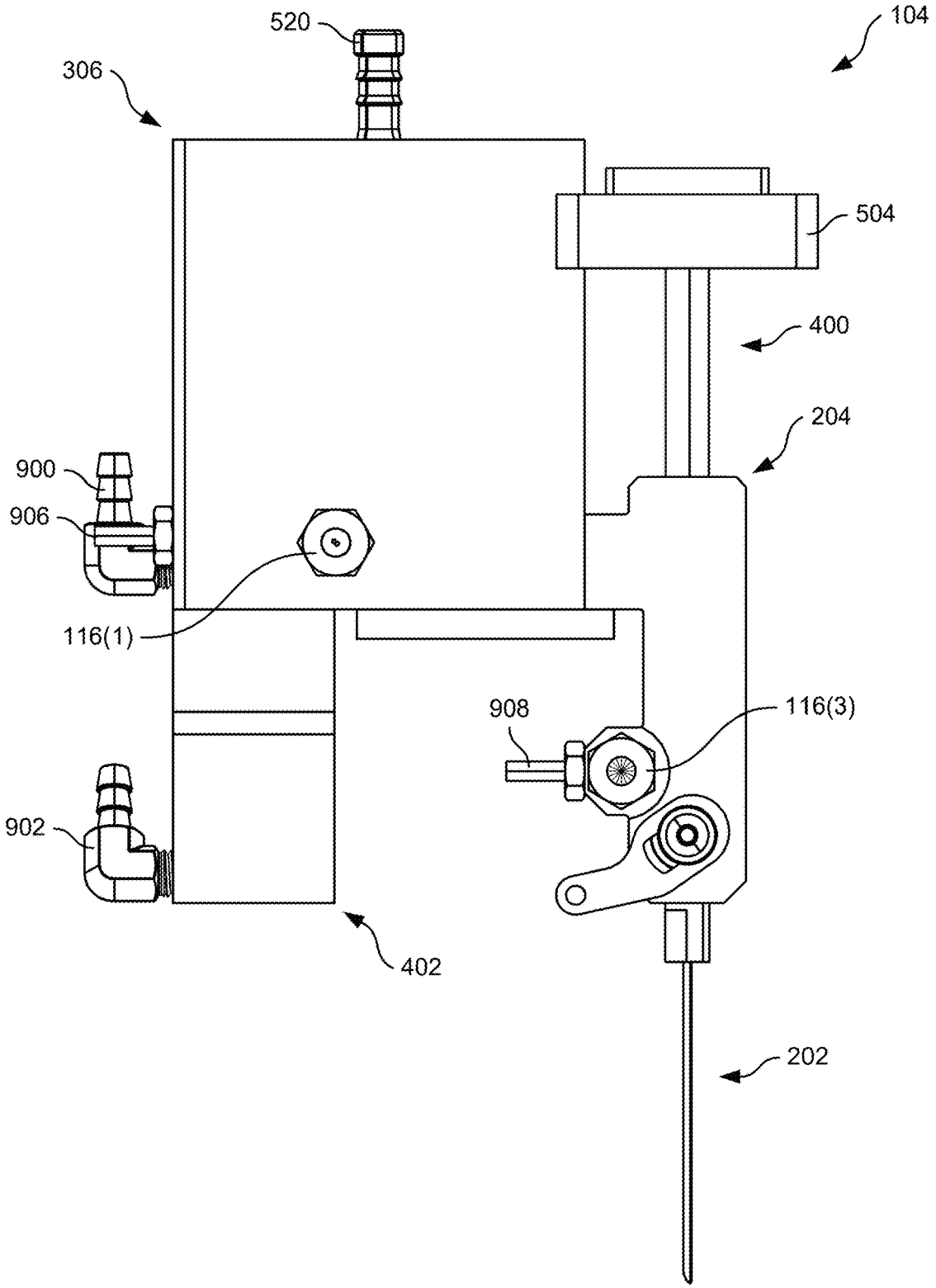
FIG. 9A
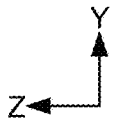

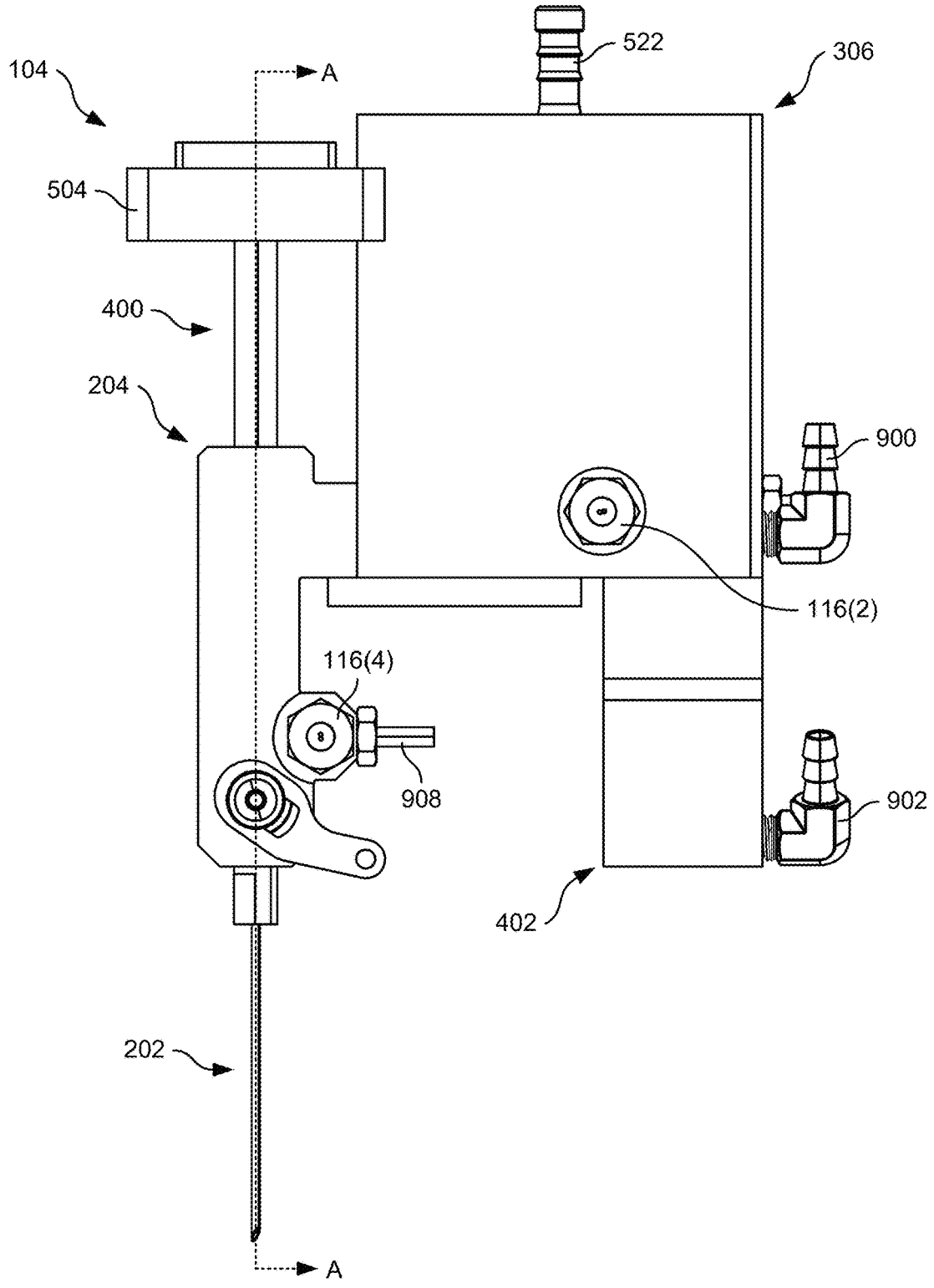
FIG. 9B
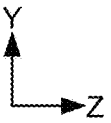

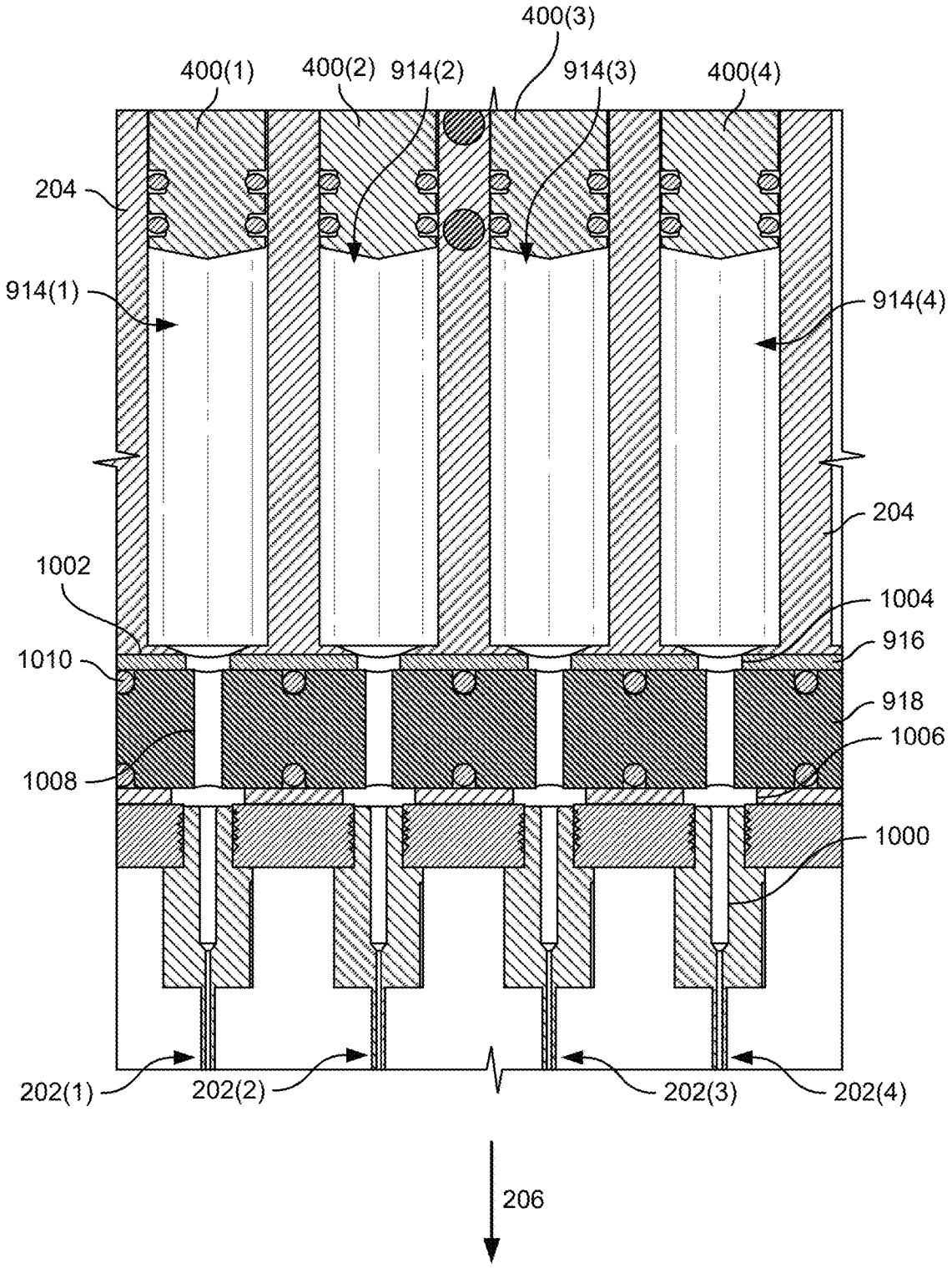
FIG. 10
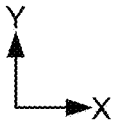

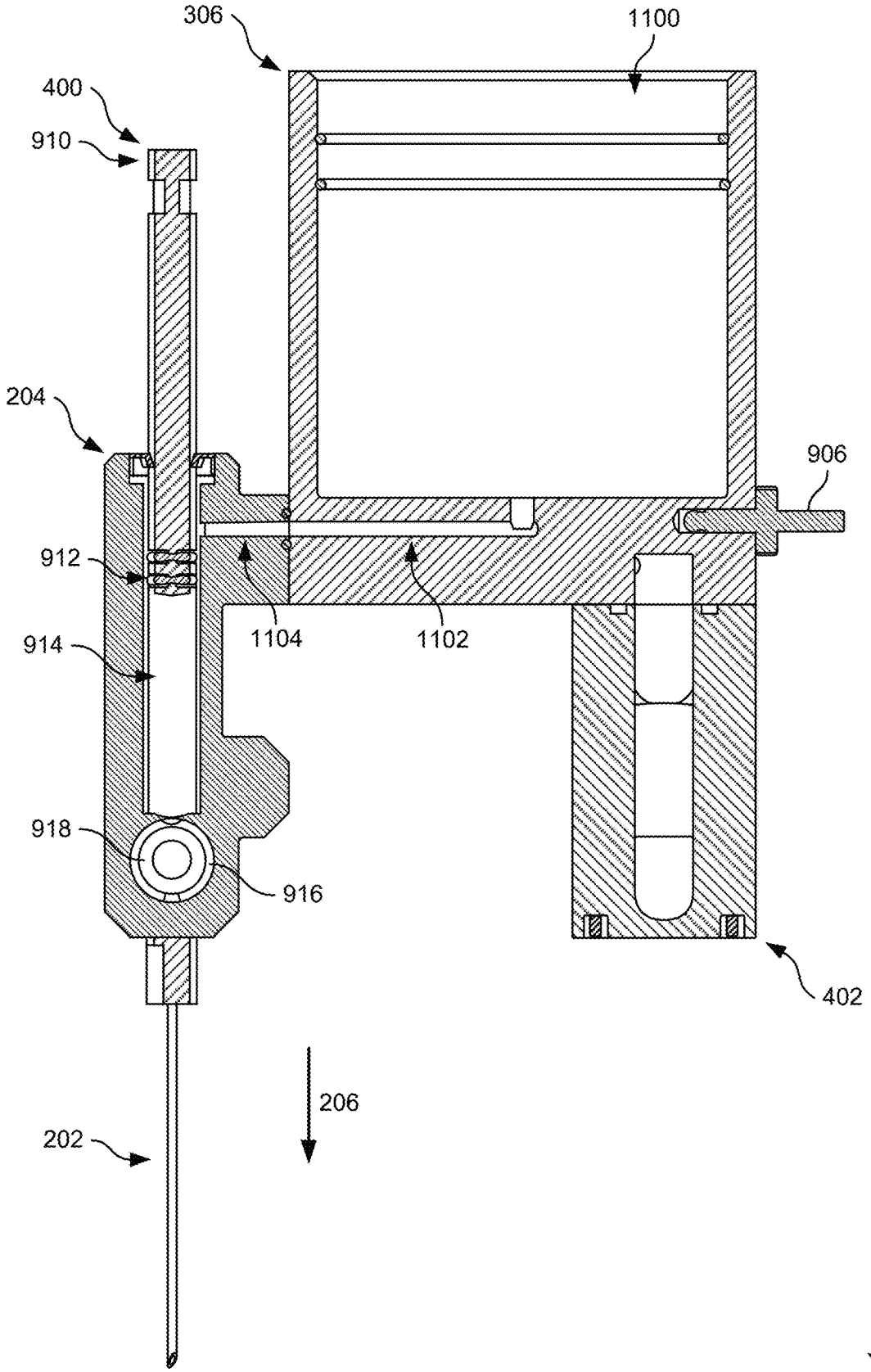
FIG. 11
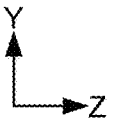

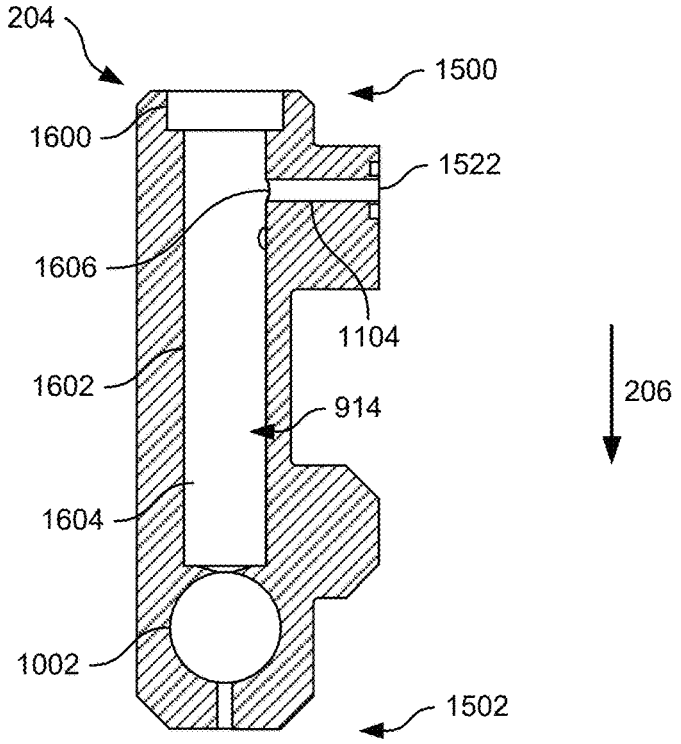
FIG. 16B
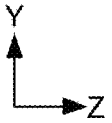
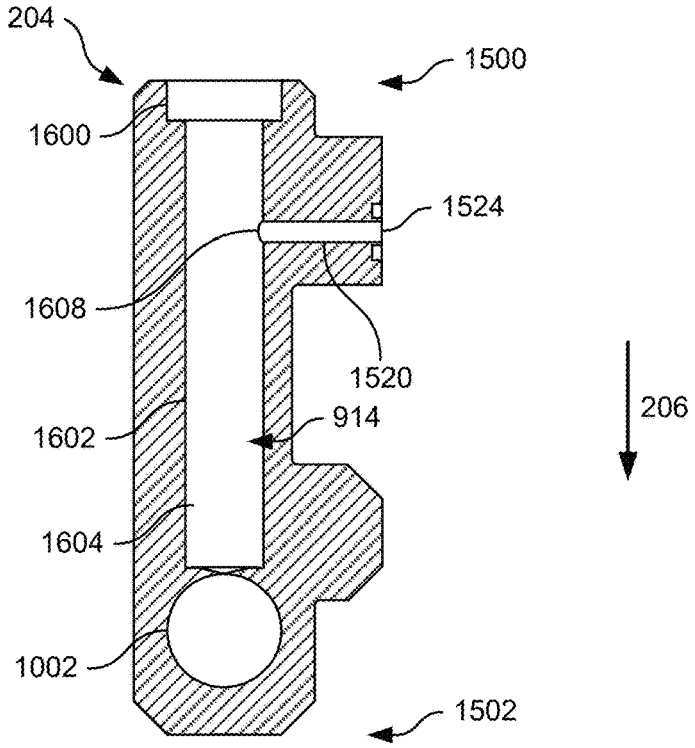
FIG. 16C
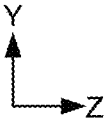

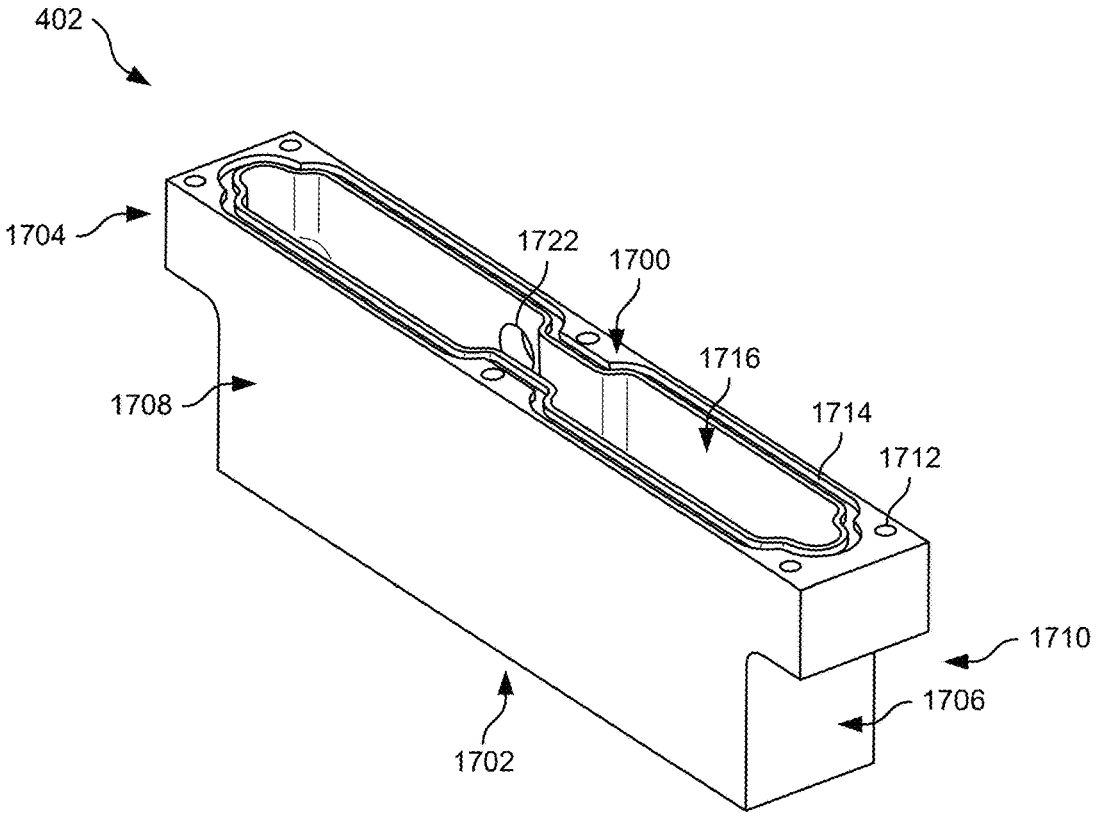
FIG. 17A
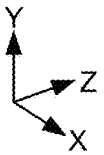
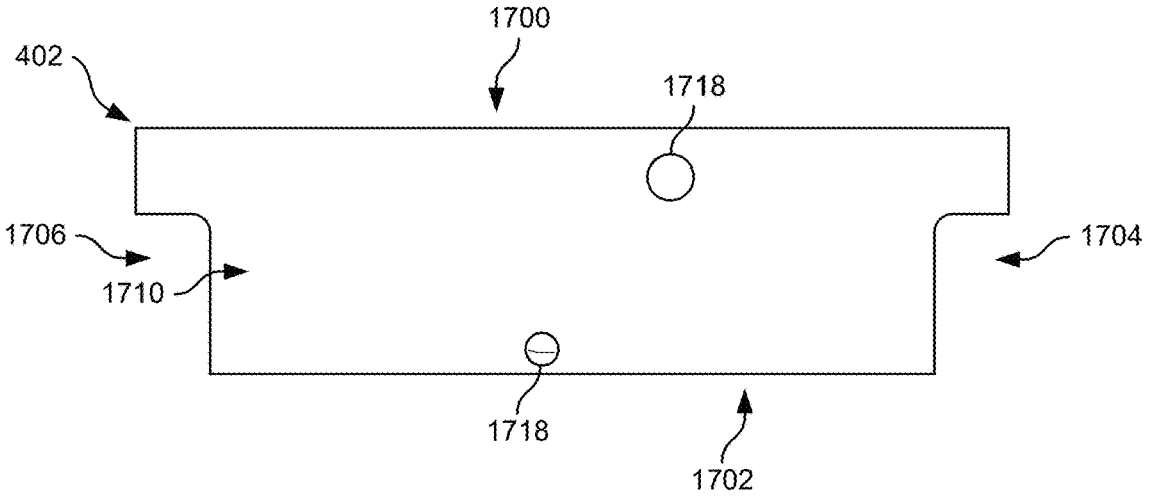
FIG. 17B
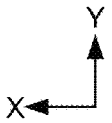

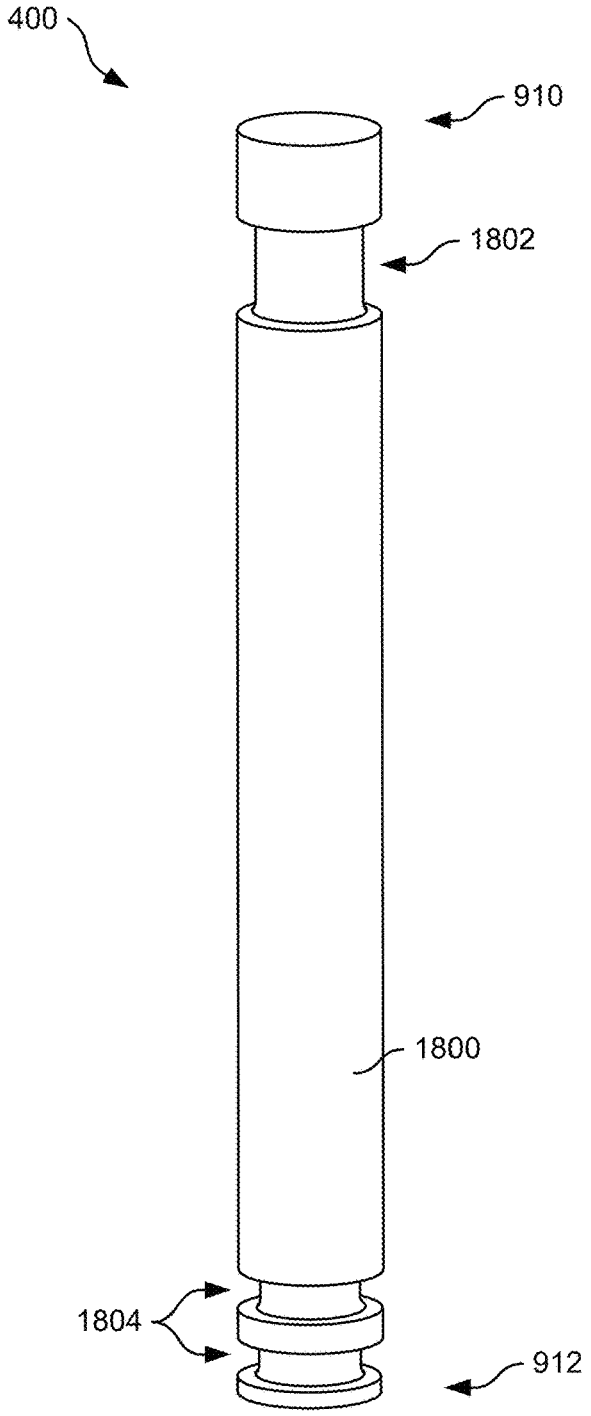
FIG. 18
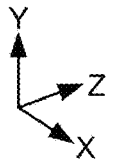

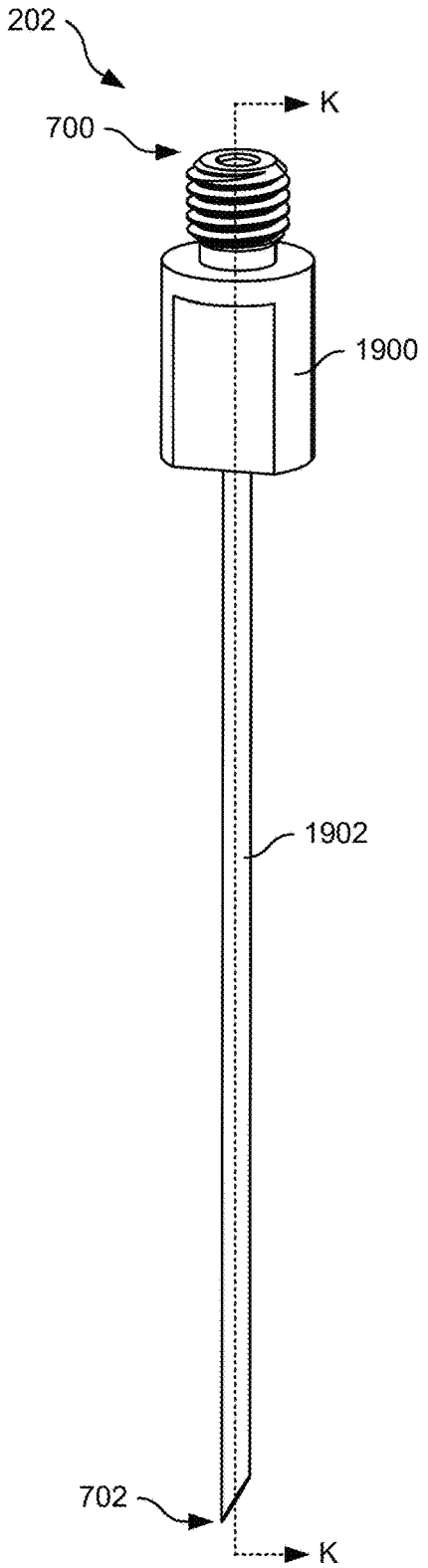
FIG. 19A
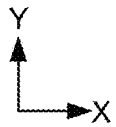

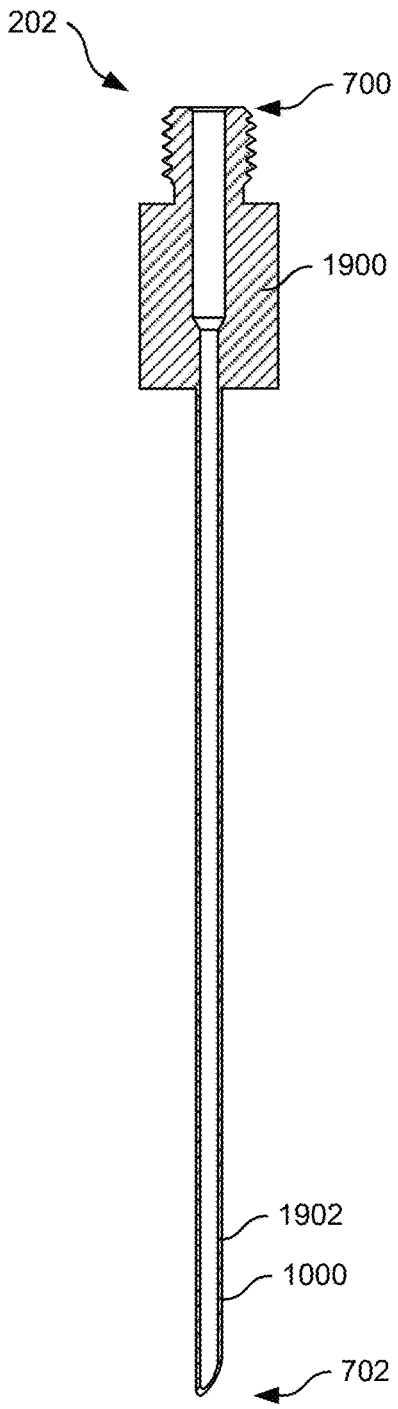
FIG. 19B
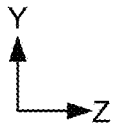

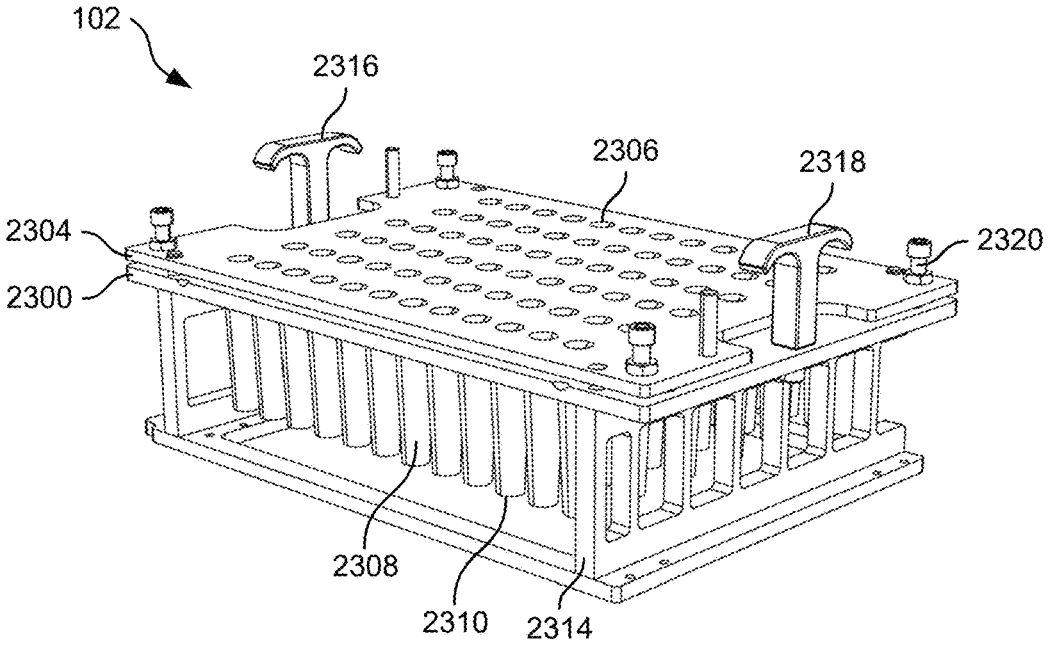
FIG. 23A
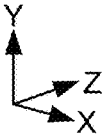
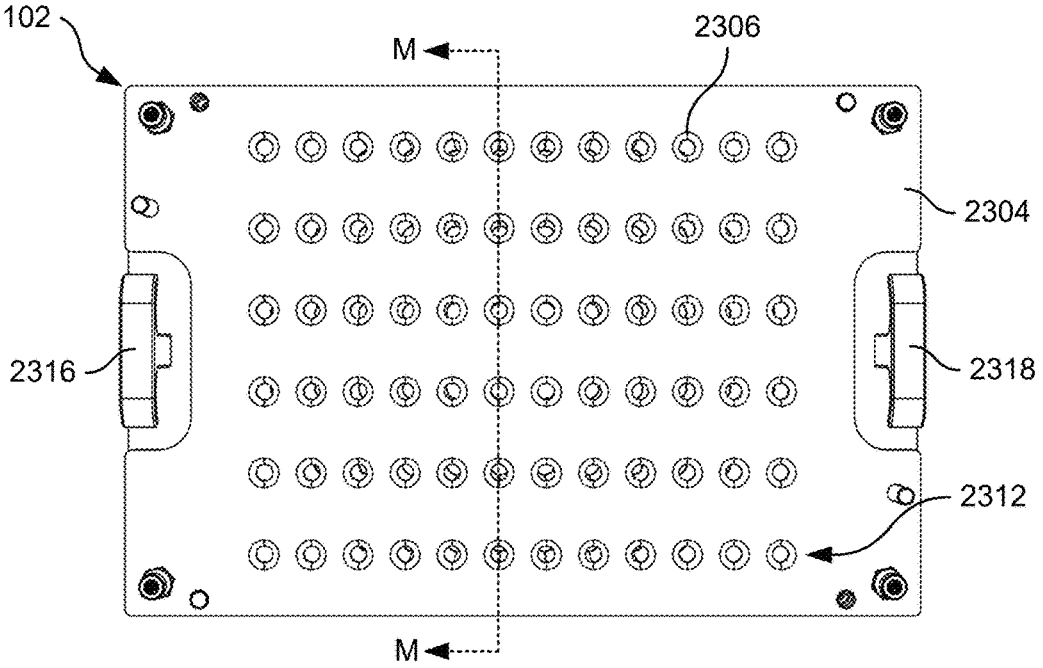
FIG. 23B
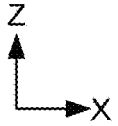

INJECTION DEVICE FOR PAPER CONES

CROSS-REFERENCE TO RELATED APPLICATIONS

This application claims priority to U.S. Provisional Patent Application No. 63/600,611, filed Nov. 17, 2023, entitled "Automated Viscous Fluid Injection Machine," the entirety of which is herein incorporated by reference.

BACKGROUND

Machines may be used to automate manufacturing processes. In some examples, machines may be designed to produce a manufactured product including delicate materials that are required to be combined in specific manner.

BRIEF DESCRIPTION OF THE DRAWINGS

The detailed description is set forth below with reference to the accompanying FIGURES. In the FIGURES, the left-most digit(s) of a reference number identifies the figure in which the reference number first appears. The use of the same reference number in different FIGURES indicates similar or identical items. The systems depicted in the accompanying FIGURES are not to scale and components within the FIGURES and/or between different FIGURES may be depicted not to scale with each other.

FIG. 1 illustrates an example injection device configured to dispense fluid into agricultural material contained with paper cones, according to examples of the present disclosure.

FIG. 2 illustrates a front view of the injection device of FIG. 1, according to examples of the present disclosure.

FIG. 3A illustrates a partial isometric view of the injection device of FIG. 1, showing example components of the injection device, according to examples of the present disclosure.

FIG. 3B illustrates a partial front view of the injection device of FIG. 1, showing example components of the injection device, according to examples of the present disclosure.

FIG. 4A illustrates a partial isometric view of the injection device of FIG. 1, showing example components of the injection device, according to examples of the present disclosure.

FIG. 4C illustrates a partial rear view of the injection device of FIG. 1, showing example components of the injection device, according to examples of the present disclosure.

FIG. 5A illustrates a partial isometric view of the injection device of FIG. 1, showing example components of the injection device, according to examples of the present disclosure.

FIG. 5B illustrates a front view of the injection device of FIG. 1, showing example components of the injection device, according to examples of the present disclosure.

FIG. 6 illustrates an isometric view of an example dispensing assembly of the injection device of FIG. 1, according to examples of the present disclosure.

FIG. 9A illustrates a first side view of the dispensing assembly of FIG. 6, according to examples of the present disclosure.

FIG. 9B illustrates a second side view of the dispensing assembly of FIG. 6, according to examples of the present disclosure.

FIG. 10 illustrates a partial cross-sectional view of the dispensing assembly of FIG. 6, taken along line A-A of FIG. 9B, according to examples of the present disclosure.

FIG. 11 illustrates a cross-sectional view of the dispensing assembly of FIG. 6, taken along line B-B of FIG. 9C, according to examples of the present disclosure.

FIG. 16B illustrates a second cross-sectional view of the manifold of FIG. 15A, taken along line H-H of FIG. 15C, according to examples of the present disclosure.

FIG. 16C illustrates a third cross-sectional view of the manifold of FIG. 15A, taken along line I-I of FIG. 15C, according to examples of the present disclosure.

FIG. 17A illustrates an isometric view of an example catch of the dispensing assembly of FIG. 6, according to examples of the present disclosure.

FIG. 17B illustrates a side view of the catch of FIG. 17A, according to examples of the present disclosure.

FIG. 18 illustrates an isometric view of an example plunger of the dispensing assembly of FIG. 6, according to examples of the present disclosure.

FIG. 19A illustrates an isometric view of an example needle of the dispensing assembly of FIG. 6, according to examples of the present disclosure.

FIG. 19B illustrates a cross-sectional view of the needle of FIG. 19A, taken along line K-K of FIG. 19A, according to examples of the present disclosure.

FIG. 23A illustrates an isometric view of an example tray usable with the injection device of FIG. 1, according to examples of the present disclosure.

FIG. 23B illustrates a top view of the tray of FIG. 23A, according to examples of the present disclosure.

DETAILED DESCRIPTION

Figure 4B:
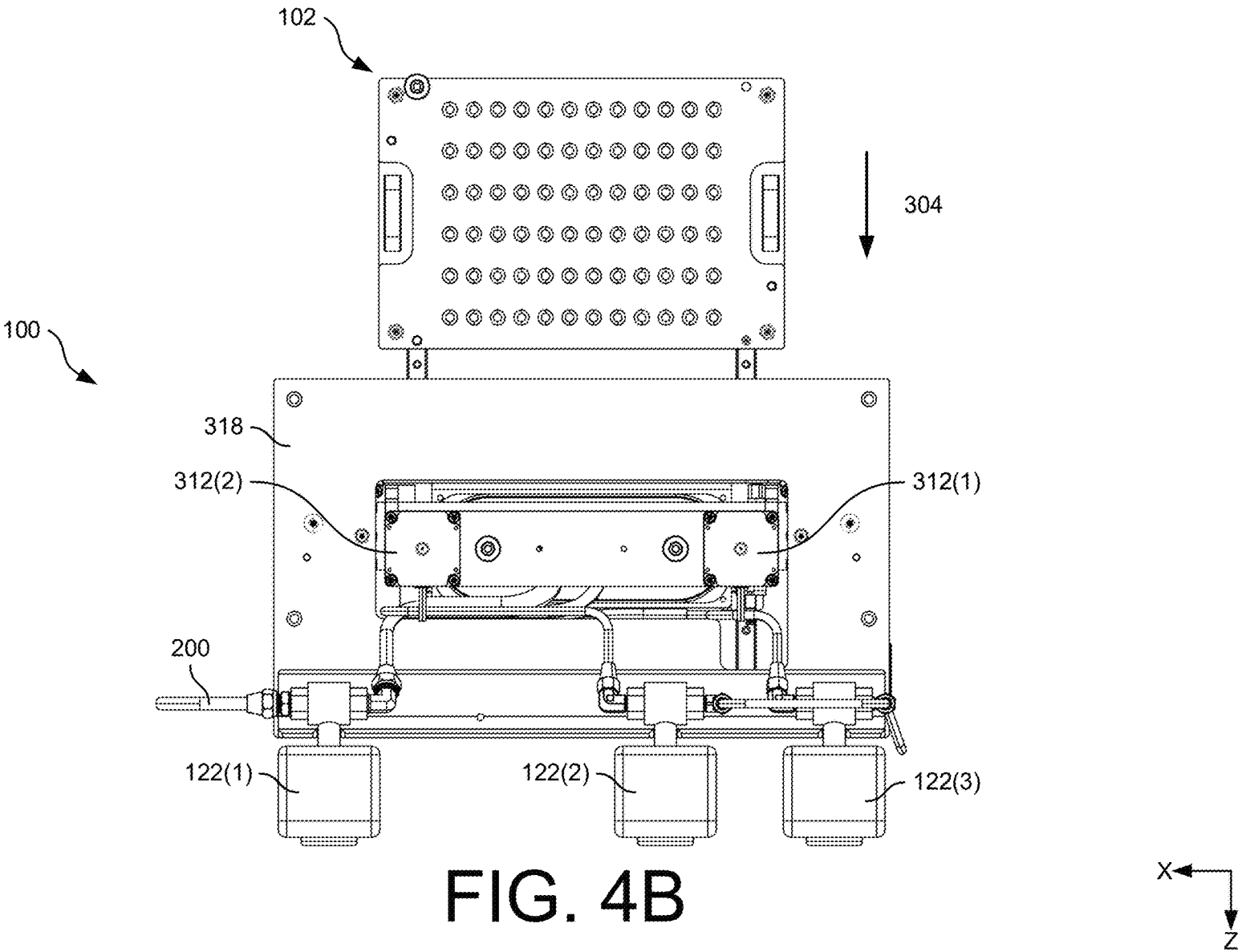
FIG. 4B illustrates a partial top view of the injection device of FIG. 1, showing example components of the injection device, according to examples of the present disclosure.

This application is directed, at least in part, to an injection device configured to inject a fluid into an agricultural material, according to examples of the present disclosure. In some instances, the agricultural material may be disposed in paper cones. For example, the agricultural material may be loaded into the paper cones. The injection device may include a manifold fluidly connected to needles that are used to dispense (e.g., inject) the fluid into the agricultural material. For example, the needles may be insertable into the agricultural material disposed in the paper cones. When the needles are disposed in the agricultural material the fluid may be dispensed out the needles. For example, a piston may be actuated to dispense the fluid. In some instances, the fluid may be dispensed as the needles retract from within the agricultural material, thereby dispensing the fluid throughout, or along a length of, the agricultural material. After dispensing the fluid, the needles may retract from the paper cones and the paper cones may be packaged for use. The injection device may allow for desired quantities of the fluid to be accurately and conveniently dispensed to increase production, throughput, and reduce waste.

In some instances, the paper cones may be substantially conically shaped. In some instances, the paper cones may be manufactured from at least one of refined white paper, unrefined brown paper, recycled paper, hemp paper, palm leaf, and/or anything containing substantially similar qualities. The material is pliable, deformable, etc., to form the paper cones. In some instances, the paper cones may include a first end (e.g., base) and a second end (e.g., top) opposite the first end. A filter (e.g., plastic cellulose, stiffened paper, etc.) may be disposed adjacent to the first end. The second end may be open such that the agricultural material is capable of being inserted into the paper cone. For example, the paper cone may define an internal cavity that receives the agricultural material. Examples of forming the paper cones are described in, for example, U.S. patent application Ser. No. 17/108,604, filed Dec. 1, 2020, entitled "Automated Paper Cone Shaping and Arrangement Machine," the entirety of which is herein incorporated by reference in its entirety and for all purposes.

The agricultural material may be processed before being loaded into the paper cones. For example, the agricultural material may be a plant with a number of parts, such as stems, flowers, roots, and/or seeds. Some parts of the agricultural material may be undesirable to a user, while other parts may be desirable. In some instances, a processed version of the agricultural material may contain the flowers having a desired particle size. Examples of the agricultural material include tobacco, hookah, herbs, etc.

The injection device includes a tray that receives the paper cones. For example, the tray may include a plurality of receptacles that receive the paper cones, where individual receptacles receive individual paper cones. In some instances, a machine or operator may load the paper cones into the receptacles. In some instances, the paper cones may be loaded with the agricultural material before being disposed in the receptacles or after being disposed in the receptacles. In some instances, a separate machine may be used to dispose the paper cones into the tray and/or load the paper cones with the agricultural material, and thereafter, the tray may be transferred to the injection device. The tray may include any number of receptacles (e.g., forty, seventy-two, one hundred, four hundred, etc.) to receive the paper cones. In some instances, the receptacles may be arranged in a grid-like fashion of rows, columns, etc. For example, the tray may have six rows of twelve receptacles (e.g., seventy-two receptacles). In some instances, the receptacles may be conically shaped.

The injection device may include a reservoir, the manifold coupled to the reservoir, plungers actuatable within the manifold, a shaft disposed within the manifold, needles coupled to the manifold, and a catch coupled to the reservoir. In some instances, the injection device may be configured to dispense the fluid into twelve of the paper cones simultaneously (e.g., at the same time). However, the injection device may be configured to dispense the fluid into less than, or more than, twelve of the paper cones. In such instances, the reservoir, manifold, etc., may be configured accordingly to dispense the fluid into less than, or more than, twelve of the paper cones. In some instances, the reservoir, the manifold, the plungers, the shaft, the needles, and/or the catch may represent, or be referred to as a dispensing assembly of the injection device.

The reservoir defines a cavity configured to receive the fluid. In some instances, the cavity may be filled with the fluid via pump(s) that suction the fluid from a container. For example, conduit (e.g., hoses, pipe, etc.) may be fluidly connected to the pump(s) and route the fluid from the container and into the cavity. Moreover, various valve(s), fitting(s), etc., may be disposed along the conduit, or between the container and the cavity, to permit and control a flow of the fluid from the container to the cavity. The piston may be engaged with the reservoir and is actuatable to apply pressure to the fluid disposed in the cavity. The piston may be actuatable via one or more actuator(s). For example, as the piston moves, the fluid in the cavity is pressurized and capable of being routed to other components of the injection device (e.g., the manifold, needles, etc.).

The reservoir may also define first channels and second channels. The first channels are fluidly connected to the cavity and route the fluid into the manifold, as will be explained herein. The second channels may receive excess (e.g., recycled) fluid from the manifold and which is not dispensed by the needles and into the paper cones. For example, the second channels may be fluidly connected to the catch, which may act as a basin to collect the fluid not dispensed into the paper cones. The fluid captured in the catch may be recirculated into the cavity of the reservoir, other containers, etc., for example, via conduit, pump(s), valve(s), fitting(s), etc.

The manifold defines first channels that are fluidly connected to the first channels of the reservoir, respectively. Individual first channels of the manifold may be fluidly connected to individual first channels of the reservoir. The first channels of the manifold are fluidly connected to chambers formed in the manifold, respectively. The chambers may be filled with the fluid to permit the fluid to be dispensed into the paper cones. For example, when the chambers are being filled with the fluid, the plungers may be disposed at a top end of the chambers. At this position, the plungers may be in a retracted state. As the plungers are actuated, for example, via one or more actuator(s), the plungers may move in a direction towards a bottom end of the chambers. For example, the plungers may move towards an extended state. As the plungers move towards the bottom end of the chambers the fluid is dispensed into the paper cones.

Introduced above, the plungers may be collectively (or simultaneously) actuated via the one or more actuator(s). For example, the actuator(s) may act on the plungers disposed within the chambers, respectively, to dispense the fluid into the paper cones simultaneously. The paper cones disposed across the row of the paper cones in the tray may be simultaneously filled from fluid within the chambers, respectively.

The manifold defines second channels that are fluidly connected to the second channels of the reservoir, respectively. Individual second channels of the manifold may be fluidly connected to individual second channels of the reservoir. The second channels are fluidly connected to the chambers formed in the manifold. In some instances, the first channels of the manifold are located more proximate to the top end of the chambers than the second channels. When the chambers are filled with the fluid via actuation of the piston, the chambers may be filled to a location where the second channels of the manifold fluidly connect to the chambers. The positioning of the plungers in the retracted position permits the chambers to be filled with the fluid.

The second channels allow air to be purged out the chambers before the plungers are depressed to dispense the fluid. For example, with the plungers in their retracted state, adjacent to the top end of the chambers, the plungers may be disposed above the first channels. In some instances, the chambers may include a fill hole fluidly connected to the first channels of the reservoir and the first channels of the manifold to allow the fluid to fill the chambers. Moreover, the chambers may include an air hole fluidly connected to the second channels of the reservoir and the second channels of the manifold to allow air to escape the chambers as the plungers are actuated.

The piston may be actuated to dispense the fluid into the chambers (e.g., via the first channels of the reservoir and the first channels of the manifold). The chambers may be filled with fluid to a point at, or above, where the second channels fluidly connect to the chambers. As the chambers are filled, air rises towards the top end of the chambers. When the plungers are actuated, the air may be purged out the second channels and ultimately into the catch. Purging the air out of the chambers avoids bubbles in the fluid, or dispensing air into the paper cones. Moreover, any fluid that is disposed into the second channels may be collected via the catch and recycled. With the air purged out of the chambers, the plungers are actuated to dispense the fluid.

The manifold also defines a passage in which the shaft is disposed. The shaft may define channels that fluidly connect to the chambers, respectively. The shaft may be rotatable, via one or more actuator(s), to align the channels with the chambers, respectively, or to fluidly connect chambers to the needles. For example, when the fluid is not being dispensed or to permit the fluid from being dispensed, the shaft may be rotated such that the channels are not aligned with the chambers. This may prevent the fluid from inadvertently being dispensed or leaking out the needles. Comparatively, when the fluid is being dispensed or to permit the fluid to be dispensed, the shaft may be rotated such that the channels are aligned with the chambers. In some instances, when the channels in the shaft are aligned with the chamber, the shaft may be in a first position. When the channels in the shaft are not aligned with the chambers, the shaft may be in a second position.

The needles are coupled to the manifold and fluidly connected to the chambers, respectively, via the channels in the shaft. The shaft may, therefore, be interposed between the chambers and the needles to control the flow of fluid to the needles. For example, in the first position of the shaft, the shaft permits the flow of fluid to the needles (e.g., via the channels aligning with the chambers). In the second position of the shaft, the shaft restricts the flow of fluid to the needles (e.g., via the channels not being aligned with the chambers).

The needles may include a first end coupled to the manifold and a second end, opposite the first end. In some instances, the first end may be threaded into the manifold, press-fit into the manifold, fastened to the manifold, etc. A length of the needle may extend between the first end and the second end. The length of the needle may accommodate a length of the paper cones (e.g., depth) such that the needle is disposable into the paper cone. The second end may be pointed (e.g., sharp) to allow the needle to be advanced into the agricultural material within the paper cone. A lumen of the needle may extend between the first end and the second end to allow the fluid to flow through the needle and into the agricultural material.

The fluid may be a viscous fluid, or other substance, capable of being dispensed via the needles. In some instances, the fluid may be heated via one or more heating element(s) disposed throughout the injection device. For example, heating element(s) may be disposed throughout the reservoir, the manifold, the catch, and/or wrapped around the conduit through which the fluid is routed, etc. Example heating element(s) may include electric heater(s), blanket heater(s), etc. The temperature of the fluid may be controlled to avoid crystallization and permit the fluid to flow throughout the injection device. For example, if too cold the fluid may not easily flow throughout the injection device and/or become clogged. In some instances, the temperature of the fluid may be controlled to adjust flow rates of the fluid through the injection device, for example, to permit the fluid to flow conveniently. In some instances, the temperature may be based on characteristic(s) of the fluid, an amount of fluid dispensed, etc. Example fluids include oil (e.g. hemp oil), honey, etc.

As introduced above, the paper cones may be disposed in the tray. The tray may be translated along tracks and actuators may move the tray along the tracks. The tray may be moved into position such that a first row of the paper cones in the tray are disposed adjacent to the needles (e.g., the second ends of the needles). With the paper cones in place, the second end of the needles may be moved into the agricultural material. As indicated above, in the event that the injection device dispenses fluid into twelve of the paper cones simultaneously, twelve of the needles may be inserted into the agricultural material across the twelve paper cones in a row, respectively. In some instances, as the needles are inserted into the agricultural material, the needles may move (e.g., oscillate) in an up and down fashion to create a void (e.g., cavity, channel, etc.) within the agricultural material. This void may accommodate dispensing of the fluid into the paper cones. Moreover, as the needles are inserted into the agricultural material, the shaft may be rotated to the second position such that the channels in the shaft are not fluidly connected with the chambers to avoid fluid leaking out of the needles.

With the second end of the needles disposed in the agricultural material, the shaft may be rotated to the first position to align the channels in the shaft with the chambers. The actuator(s) coupled to the plungers may then be actuated to dispense the fluid. In some instances, as the fluid is dispensed, the needles may retract. For example, while the fluid is being dispensed by the plungers, the needles may retract in an opposite direction. As the needles are retracted, however, the fluid may continue to be dispensed into the agricultural product. This may dispense the fluid throughout the agricultural product (e.g., between the first end and the second end of the paper cones).

Before removing the needles from the agricultural material, or before retracting the needles out the second end of the paper cones, the shaft may be rotated such that the channels are not fluidly connected with the chambers. This may close a fluid supply to the needles and prevent the fluid from leaking out of the needles. Alternatively, in some instances, before rotating the shaft, the plungers may slightly retract to suction any fluid remaining, hanging, or disposed at the second end of the needles. After such, the shaft may be rotated to the second position to prevent the fluid from leaking.

With the first row of the paper cones filled, the tray may move along the tracks and into position such that a second row of the paper cones is disposed adjacent to the needles (e.g., the second ends of the needles). The process of dispensing the fluid into the paper cones may repeat, and after filling the paper cones in the second row, the tray may move along the tracks and into position such that a third row of the paper cones is disposed adjacent to the needles. This process may repeat for all the rows of the paper cones or until the fluid is dispensed into all the paper cones across the rows. When the fluid has been dispensed into all the paper cones, the tray may be replaced with paper cones that have yet to receive the fluid.

In some instances, the chambers may be filled with enough fluid to dispense the fluid into the paper cones disposed across the rows. For example, in the retracted state of the plungers and before any fluid has been dispensed, the chambers may be filled with the fluid. In the event that the tray includes six rows, each of the chambers may be filled with enough fluid to dispense the fluid into one paper cone in the first row, one paper cone in the second row, and so on. In other words, the chamber may be filled with enough fluid for six paper cones. The injection device is configured to operate any number of cycles for dispensing the fluid into the paper cones across the rows. However, after the fluid has been dispensed into the paper cones, and the tray is replaced, as indicated above, the plungers may move to their retracted position and the piston may be actuated to dispense additional fluid into the chambers. Therein, the process may repeat for dispensing the fluid into the agricultural material within the paper cones of the new tray.

Although described as dispensing fluid into the paper cones of each row, in some instances, fluid may not be dispensed into all of the paper cones within or across the rows. Moreover, in some instances, each of the paper cones across the rows may be filled with the same amount of fluid or different paper cones may be filled with different amounts of fluid. For example, for the first row, the plungers may be actuated by a first amount to dispense a first amount of fluid into the paper cones. For a second row, however, the plungers may be actuated by a second amount different than the first amount to dispense a second amount of fluid into the paper cones.

The injection device may include computing components that control operations performed by the injection device. For example, computing components (e.g., processor(s), memory, etc.) may control the pump(s) to supply fluid to the cavity, control the actuator(s) coupled to the piston, control the actuator(s) coupled to the plungers, control the actuator(s) coupled to the shaft, control the actuator(s) coupled to the tray for moving the tray along the tracks, and so forth. In some instances, the injection device may operate according to certain setting(s). For example, the injection device may be programmable depending upon preference(s) of a user and operate according to the programmed setting(s). In some instances, the setting(s) may control how much fluid is dispensed into the paper cones, a length of the agricultural product over which the fluid is to be dispensed, a temperature by which to heat the fluid, characteristic(s) of the tray (e.g., receptacles, rows, etc.), a number of cycles over which to dispense the fluid, and so forth. The setting(s) may also be used to control the actuator(s) for moving the needles into and out of the paper cones, the actuator(s) for moving the piston, the actuator(s) for moving the shaft, the actuator(s) for moving the tray along the tracks, and so forth. For example, the setting(s) may indicate an amount of movement of the tray between the rows of paper cones in order to align the paper cones with the needles. Other setting(s), however, may be used to control the injection device.

In some instances, the injection device may include various input/output (I/O) components for at least partially controlling the operations of the injection device. For example, the injection device may include a display (e.g., touch-sensitive display) that receives input from a user associated with causing the injection device to perform the operations described herein. As examples, the user may provide various inputs to the display, such as when to run the injection device, when to turn off the injection device, etc. Moreover, the user may control the setting(s) of the injection device, such as a temperature to heat the fluid, an amount of fluid dispensed, etc., via the display. The user may indicate an amount of fluid to dispense into each paper cone, a size of the paper cones, an amount of paper cones within the tray, etc. Other I/O components may include lighting elements that illuminate according to the operations performed, keyboards, buttons, switches, etc., to provide input, speakers to output audio (e.g., warnings, etc.).

The injection device may include other components not discussed above. For example, network interfaces may communicatively couple the injection device to devices, tablets, etc., over one or more networks. Users may operate the injection device via the devices, or receive data associated with the device (e.g., progress, number of paper cones filled, etc.).

The injection device may also include sensor(s) that generate sensor data. The sensor(s) may include temperature sensor(s), optical sensor(s), proximity sensor(s), capacitive sensor(s), positional sensor(s), etc. The temperature sensor(s) may generate sensor data associated with a temperature of the fluid, or the reservoir, for example, to know when and/or by how much to heat the fluid. Optical sensor(s) or proximity sensor(s) may generate sensor data used to determine when the paper cones are disposed adjacent to the needles to permit the needles to actuate and dispense the fluid. Positional sensor(s) may be used to determine a position of the needles, the plungers, the piston, the tray, etc., for use in actuating the needles, the plungers, the piston, etc.

The injection device may include various housings, frames, brackets, plates, etc., that support the various components. For example, the reservoir, manifold, etc., may be disposed within a housing, and/or couple to the housings, frames, etc., via brackets, mounts, etc. In some instances, one or more covers may enclose components of the injection device. Moreover, gaskets, seals, etc., may be disposed at interfaces between the reservoir, manifold, catch, etc., to prevent leakage, contamination, etc.

Although referred to herein as an injection device, the injection device may alternatively be referred to as, or represent, an apparatus, piece of equipment, machine, injector, fluid injector, etc. The injection device may be portable within an environment or stationary within the environment.

The present disclosure provides an overall understanding of the principles of the structure, function, device, and system disclosed herein. One or more examples of the present disclosure are illustrated in the accompanying drawings. Those of ordinary skill in the art will understand and appreciate that the devices, the systems, and/or the methods specifically described herein and illustrated in the accompanying drawings are non-limiting embodiments. The features illustrated or described in connection with one embodiment or instance may be combined with the features of other embodiments or instances. Such modifications and variations are intended to be included within the scope of the disclosure and appended claims.

FIG. 1 illustrates an example injection device 100, according to examples of the present disclosure. As will be explained herein, the injection device 100 may be configured to dispense (e.g., inject) a fluid into an agricultural material disposed in paper cones. Examples of the agricultural material include tobacco, hookah, herbs, etc. Example fluids include oil (e.g. hemp oil), honey, etc. In some instances, the injection device 100 may alternatively be referred to as, or represent, an apparatus, piece of equipment, machine, injector, fluid injector, etc. The injection device 100 may be portable within an environment or stationary within the environment.

The paper cones may be disposed in receptacles of a tray 102. For example, the tray 102 may include a plurality of receptacles that receive the paper cones, where individual paper cones are disposed in individual receptacles. In some instances, a machine or operator may load the paper cones into the tray 102. In some instances, the paper cones may be loaded with the agricultural material before being disposed in the receptacles, or after being disposed in the receptacles. The tray 102 may include any number of receptacles (e.g., forty, seventy-two, one hundred, four hundred, etc.) to receive the paper cones. In some instances, the receptacles may be arranged in a grid-like fashion of rows, columns, etc. For example, the tray 102 may have six rows of twelve receptacles (e.g., seventy-two receptacles). In some instances, the receptacles may be conically shaped.

The tray 102 may be translatable into and out of the injection device 100 to dispense the fluid into the paper cones. The injection device 100 may include a dispensing assembly 104 that functions to dispense the fluid into the paper cones. In some instances, the dispensing assembly 104 may include a reservoir, a manifold coupled to the reservoir, plungers actuatable within the manifold, a shaft disposed within the manifold, needles coupled to the manifold, and a catch coupled to the reservoir. The injection device 100 may include actuator(s) 106 that move the tray 102 into position for dispensing the fluid into the paper cones.

In some instances, the injection device 100 may be configured to dispense the fluid into twelve of the paper cones simultaneously (e.g., at the same time). In such instances, for example, the dispensing assembly 104 may include twelve of the needles, where individual needles dispense the fluid into individual paper cones. The dispensing assembly 104 may include suitable components, or the manifold, plungers, the shaft, the needles coupled to the manifold, etc., may be configured accordingly to dispense the fluid into twelve of the paper cones. However, the injection device 100 may be configured to dispense the fluid into less than, or more than, twelve of the paper cones.

Details of the dispensing assembly 104 are discussed herein, however, the reservoir defines a cavity configured to receive the fluid. A piston may be engaged with the reservoir and is actuatable to apply pressure to the fluid disposed in the cavity. The piston may be actuatable via the actuator(s) 106. The manifold is coupled to the reservoir, and as the piston actuates, the fluid is routed into chambers of the manifold. The chambers may be filled with the fluid to permit the fluid to be dispensed into the paper cones. The chambers may include a top end, and when the chambers are being filled, the plungers may be in a retracted state proximate to the top end. After filling the chambers, the plungers may be actuated, for example, via the actuator(s) 106, to move the plungers towards a bottom end of the chambers. As the plungers move towards the bottom end the fluid is dispensed into the paper cones. As indicated above, the plungers may be collectively (or simultaneously) actuated. For example, the actuator(s) 106 may act on the plungers disposed within the chambers, respectively, to dispense the fluid into the paper cones simultaneously.

The manifold also defines a passage in which the shaft is disposed. The shaft may define channels that fluidly connect to the chambers in the manifold, respectively. The shaft may be rotatable, via actuator(s) 106, to align the channels with the chambers, respectively, or to fluidly connect chambers to the needles. For example, when the fluid is not dispensed, the shaft may be rotated so the channels are not aligned with the chambers to prevent the fluid from being inadvertently dispensed or leaking from the needles. Comparatively, when the fluid is dispensed, the shaft may be rotated to align the channels with the chambers.

The needles may include a first end coupled to the manifold and a second end, opposite the first end, configured to be disposed in the paper cones. The second end may be pointed to allow the needle to be advanced into the agricultural material within the paper cone. A lumen of the needle may extend between the first end and the second end to allow the fluid to flow through the needle and into the agricultural material.

The tray 102 may be moved into position such that a first row of the paper cones are disposed adjacent to the needles (e.g., the second ends of the needles). With the paper cones in place, the second end of the needles may be moved into the agricultural material. With the second end of the needles disposed in the agricultural material, the shaft may be rotated to align the channels in the shaft with the chambers. The actuator(s) 106 coupled to the plungers may be actuated to dispense the fluid. In some instances, as the fluid is dispensed, the actuator(s) 106 may retract the needles. As the needles are retracted, however, the fluid may continue to be dispensed into the agricultural product. This causes the fluid to be dispensed throughout the agricultural product.

Before removing the needles from the agricultural material, or before retracting the needles out the paper cones, the shaft may be rotated such that the channels are not fluidly connected with the chambers. This may close a fluid supply to the needles and prevent the fluid leaking. With the first row of the paper cones filled, the tray 102 may move along the tracks and into position such that a second row of the paper cones are disposed adjacent to the needles (e.g., the second ends of the needles). The process of dispensing the fluid into the paper cones may repeat and, after filling the paper cones in the second row, the tray 102 may move along the tracks and into position such that a third row of the paper cones are disposed adjacent to the needles. This process may repeat for all the rows of the paper cones, or until the fluid is dispensed into all the paper cones across the rows. When the fluid has been dispensed into all the paper cones, the tray 102 may be replaced with paper cones that have yet to receive the fluid.

The chambers may be filled with enough fluid to dispense the fluid into the paper cones disposed across the rows. The chambers may not have to be refilled while dispensing the fluid into the paper cones for the tray 102. However, when the tray 102 is replaced, the chambers may be refilled with enough fluid sufficient for a subsequent tray.

The injection device 100 is shown including processor(s) 108 and memory 110, where the processor(s) 108 may perform various functions and operations associated with controlling the injection device 100, and the memory 110 may store instructions executable by the processor(s) 108 to perform the operations described herein. In some instances, the injection device 100 may operate according to certain setting(s) 112. The setting(s) 112 be programmable depending upon preference(s) of a user, the tray 102, the paper cones, etc., and the injection device 100 may operate according to the setting(s) 112.

In some instances, the setting(s) 112 may control how much fluid is dispensed into the paper cones. For example, the setting(s) 112 may control an actuation (e.g., stroke, stroke length, etc.) of the actuator(s) 106 that act on the plungers to dispense the fluid into the paper cones. The setting(s) 112 may also control a length (e.g., span) over which the fluid is dispensed into the paper cones. The setting(s) 112 may also control the actuator(s) 106 to move the tray 102 into position. For example, the setting(s) 112 may indicate a spacing between the rows of receptacles within the tray 102, for example, to align the paper cones beneath the needles. The setting(s) 112 may further control a pressure applied by the piston to pressurize the fluid, or advance the fluid into the chambers. The actuator(s) 106 may independently control the piston, the plungers, the tray, the needles, etc. Example of the actuator(s) 106 include screw drives, linear actuator(s), motor(s), etc.

In some instances, the injection device 100 may include various input/output (I/O) components for at least partially controlling the operations of the injection device 100. For example, the injection device 100 may include a display 114 (e.g., touch-sensitive display) that receives input from a user associated with causing the injection device 100 to perform the operations described herein. As examples, the user may provide various inputs to the display, such as when to run the injection device 100, when to turn off the injection device 100, etc. Moreover, the user may control the setting(s) 112 of the injection device 100, such an amount of fluid dispensed, characteristic(s) of the tray 102, characteristic(s) of the paper cones, etc., via the display 114. Other I/O components may include lighting elements that illuminate according to the operations performed, keyboards, buttons, switches, etc., to provide input, speakers to output audio (e.g., warnings, etc.).

The injection device 100 may include other components. For example, network interfaces may communicatively couple the injection device 100 to devices, tablets, etc., over one or more networks. Users may operate the injection device 100 via the devices, or receive data associated with the device (e.g., progress, number of paper cones filled, etc.). Additionally, the injection device 100 may include one or more heating element(s) 116. The heating element(s) 116 may be disposed throughout the reservoir, the manifold, the catch, etc., and/or wrapped around conduit through which the fluid is routed. In some instances, the heating element(s) 116 may include electric heater(s), blanket heater(s), etc. The setting(s) 112 may indicate a temperate by which to heat the fluid, when to heat the fluid, an amount of time to heat the fluid, etc. The temperature may be based on the fluid, the agricultural product, the paper cones, etc. In some instances, the temperature of the fluid may be controlled to avoid crystallization and permit the fluid to flow throughout the injection device 100. For example, if too cold the fluid may not easily flow throughout the injection device 100 and/or become clogged. In some instances, the temperature of the fluid may be controlled to adjust flow rates of the fluid, for example, to permit the fluid to flow conveniently throughout the injection device 100.

The injection device 100 may also include sensor(s) 118 that generate sensor data 120. The sensor(s) 118 may include temperature sensor(s), optical sensor(s), proximity sensor(s), capacitive sensor(s), positional sensor(s), etc. The temperature sensor(s) may generate sensor data 120 associated with a temperature of the fluid, or the reservoir, for example, to know when and/or by how much to heat the fluid. Optical sensor(s) or proximity sensor(s) may generate sensor data 120 used to determine when the paper cones are disposed adjacent to the needles to permit the needles to actuate and dispense the fluid. Positional sensor(s) may be used to determine a position of the needles, the plungers, the piston, etc., etc., for use in actuating the needles, the plungers, the piston, etc.

The injection device 100 may further include pump(s) 122 that supply the fluid into the dispensing assembly 104. In some instances, the pump(s) 122 may pump the fluid from a container through conduits, pipes, valves, etc., and into the reservoir. The pump(s) 122 may also be used to recirculate the fluid, for example, as collected within the catch.

As used herein, a processor, such as the processor(s) 108 may include multiple processors and/or a processor having multiple cores. Further, the processor(s) 108 may comprise one or more cores of different types. For example, the processor(s) 108 may include application processor units, graphic processing units, and so forth. In one implementation, the processor(s) 136 may comprise a microcontroller and/or a microprocessor. The processor(s) 108 may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 108 may possess its own local memory, which also may store program components, program data, and/or one or more operating systems.

Memory, such as the memory 110 may include volatile and nonvolatile memory, removable and non-removable media implemented in any method or technology for storage of information, such as computer-readable instructions, data structures, program component, or other data. Such memory may include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory may be implemented as computer-readable storage media ("CRSM"), which may be any available physical media accessible by the processor(s) to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s) 108. The memory 110 is an example of non-transitory computer-readable media. The memory 110 may store an operating system and one or more software applications, instructions, programs, and/or data to implement the methods described herein and the functions attributed to the various systems.

FIG. 2 illustrates a front view of the injection device 100, according to examples of the present disclosure. As introduced above, the injection device 100 includes the dispensing assembly 104 that dispensing fluid into paper cones. The paper cones are disposed within the tray 102. The injection device 100 may include a supply line 200 (e.g., inlet, etc.) that is fluidly connected to needles 202 that dispense the fluid into the paper cones. A container, vessel, etc., may be disposed adjacent to the supply line 200, and the supply line 200 may be disposed within the container to intake the fluid. For example, the pump(s) 122 may suction the fluid from the container. As will be discussed herein, the fluid is delivered to a reservoir and is then supplied to a manifold 204 that disperses the fluid to the needles 202.

The needles 202 are configured to be actuated in a direction 206 (e.g., in the Y-direction) to plunge into the agricultural material within the paper cones. For example, the actuator(s) 106 may move the needles 202 in the direction 206 to dispose the needles 202 within the agricultural material. Once within the agricultural material, the needles 202 may dispense the fluid.

The injection device 100 may include valves, fittings, conduit, hoses, clamps, etc., to ultimately channel, direct, or otherwise route the fluid from the supply line 200 to the needles 202. Moreover, the heating element(s) 116 may be disposed about the valves, fittings, conduit, hoses, clamps, etc., to heat the fluid and keep the fluid viscous.

In some instances, the injection device 100 may include a cabinet 208 that houses computing components. For example, computers, storage devices, etc., may be housed within the cabinet 208. The cabinet 208 may be slidable on rails. Feet 210 may dispose the injection device 100 above a surface and prevent reorientation.

FIGS. 3A and 3B illustrate views of the injection device 100, showing the cabinet removed, according to examples of the present disclosure. FIG. 3A illustrates an isometric view of the injection device 100 and FIG. 3B illustrates a front view of the injection device 100.

The injection device 100 may include a base 300 to which components of the injection device 100 couple. For example, the injection device 100 may include tracks 302, such as a first track 302(1) and a second track 302(2) along which the tray 102 moves. The tracks 302 may represent rails, guides, etc., for moving the tray 102 in a direction 304 (e.g. in the Z-direction). The tray 102 may include carriages that mount the tray 102 to the tracks 302. Actuator(s) 106 may move the tray 102 in the direction 304 to align the paper cones with the needles 202. In doing so, the needles 202 are able to actuate in the direction 206, plunge into the paper cones, and dispense the fluid.

The actuator(s) 106 may be configured to incrementally, or by predetermined amounts, move the tray 102 in the direction 304. For example, the tray 102 may include rows of the paper cones (e.g., spaced apart in the Z-direction). At a first instance, the actuator(s) 106 may move the tray 102 in the direction 304 such that a first row is aligned vertically beneath the needles 202. With the first row in place, the needles 202 may be actuated in the direction 206. Once the fluid is dispensed into the paper cones in the first row, the needles 202 may be retracted in a direction opposite the direction 206. With the needles 202 retracted, at a second instance, the actuator(s) 106 may move the tray 102 in the direction 304 by a predetermined amount such that a second row is aligned vertically beneath the needles 202. With the second row in place, the needles 202 may be actuated in the direction 206. Once the fluid is dispensed into the paper cones in the second row, the needles 202 may be retracted in a direction opposite the direction 206. This process may repeat depending upon the number of rows within the tray 102.

The setting(s) 112 may indicate the amount of actuation by the tray 102 in the direction 304 to align the needles 202 with the paper cones disposed across the rows. For example, the setting(s) 112 may indicate a spacing (e.g., in the Z-direction) between adjacent rows, and the actuator(s) 106 may be configured to move the tray 102 by the amount of spacing. The setting(s) 112 may also indicate an amount of actuation by the needles 202 in the direction 206 to plunge the needles 202 into the paper cones. In some instances, the sensor(s) 118 may be utilized to determine whether the needles 202 and the tray 102 are aligned before actuating the needles 202 in the direction 206. For example, the sensor data 120 generated by the sensor(s) 118 may be used to move the needles 202 in the direction 206 and/or the tray 102 in the direction 304.

The injection device 100 may include a pump 122(1) that is fluidly connected to the supply line 200 for suctioning the fluid from the container. The pump 122(1) may supply the fluid to a reservoir 306. The reservoir 306 may include a cavity in which the fluid is dispensed. A piston 308 may engage with the reservoir 306 and may be actuated to apply pressure to the fluid to deliver the fluid to the manifold 204, and ultimately, the needles 202.

The injection device 100 includes actuator(s) 310, such as a first actuator 310(1) and a second actuator 310(2) that move the dispensing assembly 104 vertically upwards and downwards (e.g., in the Y-direction). During actuation of the actuator(s) 310, the needles 202 may move into and out of the paper cones. The injection device 100 further includes actuator(s) 312, such as a first actuator 312(1) and a second actuator 312(2), that move the piston 308 upwards and downwards (e.g., in the Y-direction). The actuator(s) 312 may move the piston 308 independently of the reservoir 306, the manifold 204, and the needles 202. Actuator(s) 314, such as a first actuator 314(1) and a second actuator 314(2), may move the plungers disposed within the manifold 204 upwards and downwards (e.g., in the Y-direction). The actuator(s) 314 may move the plungers independently of the reservoir 306, the manifold 204, and/or the piston 308. The actuator(s) 310, the actuator(s) 312, and/or the actuator(s) 314 may be any suitable actuator(s). Example actuator(s) include screw drives, linear actuator(s), rotary actuator(s), etc.

In some instances, the actuator(s) 310 may move an entirety of the dispensing assembly 104 (e.g., the piston 308, the manifold 204, the needles, etc.) into position for dispensing the fluid. For example, the actuator(s) 310 may move the dispensing assembly 104 in an upwards direction to dispose the needles 202 away from the tray 102. Once the tray 102 is moved into position, the actuator(s) 310 may move the dispensing assembly 104 in a downward direction (e.g., in the direction 206) to dispose the needles 202 adjacent to the tray 102. The actuator(s) 312 may independently apply pressure to the piston 308 to pressurize the fluid. The actuator(s) 314 may move the plungers to dispense the fluid into the paper cones (e.g., in the direction 206). In some instances, when the actuator(s) 314 are actuated the actuator(s) 310 remain stationary. The actuator(s) 314 may, therefore, only move, or independently move, the plungers in relation to other components of the dispensing assembly 104.

One or more struts 316 may extend between the base 300 and a top plate 318. The top plate 318 may support components of the injection device 100, such as the pump(s) 122, the actuator(s) 106, conduit, etc. Moreover, components of the injection device 100 may be supported between the base 300 and the top plate 318. For example, various brackets, mounts, clamps, flanges, etc., may couple to the base 300, the struts 316, the top plate 318, etc., for coupling the components to the injection device 100.

FIGS. 4A-4C illustrate detailed views of the injection device 100, according to examples of the present disclosure. FIG. 4A illustrates an isometric view of the injection device 100, FIG. 4B illustrates a top view of the injection device 100, and FIG. 4C illustrates a rear view of the injection device 100. In FIGS. 4A-4C, the tray 102 is shown being displaced away from the needles 202. However, the tray 102 may move in the direction 304, into the injection device 100, for example, to dispose the paper cones adjacent to the needles 202.

The pump 122(1) intakes fluid from the supply line 200 and routes the fluid into the reservoir 306. The manifold 204, which is fluidly connected to the reservoir 306, receives the fluid via actuation of the piston 308 (e.g., via the actuator(s) 312). The needles 202, which are coupled to the manifold 204, route the fluid to the paper cones disposed in the tray 102.

As introduced above, the injection device 100 includes the actuator(s) 310 that move the dispensing assembly 104, the actuator(s) 312 that move the piston 308, and the actuator(s) 314 that move plungers 400. The plungers 400 act to dispense fluid through the manifold 204, through the needles 202, and into the paper cones. For example, as will be explained herein, the manifold 204 may define chambers that are filled with the fluid. During actuation of the actuator(s) 314, the plungers 400 are urged to dispense the fluid from the needles 202. The actuator(s) 314 move the plungers 400 independently of the manifold 204. The actuator(s) 310, the actuator(s) 312, and/or the actuator(s) 314 may mount to the struts 316, the base 300, and/or the top plate 318 via various mounts, brackets, etc. Although a particular arrangement of the actuator(s) 310, the actuator(s) 312, and/or the actuator(s) 314 are shown, other variations are envisioned.

The injection device 100 further includes a pump 122(2) that may act as a recirculation pump. For example, as will be explained herein, a catch 402 may fluidly couple to the reservoir 306. The catch 402 may collect fluid not dispensed into the needles 202 for recycling or reuse. The pump 122(2) may deliver the fluid back to the reservoir 306, to the supply line 200, etc. For example, a conduit 404 may couple to the catch 402, and the pump 122(2) may suction the fluid collected in the catch 402. Other pumps, such as a pump 122(3) may be included to circulate the fluid, recirculate the fluid, etc., throughout the injection device 100. Moreover, as indicated above, the various conduit, hoses, tubing, etc., that routes between the pump(s) 122 and/or components of the injection device 100 may be wrapped with the heating element(s) 116, for example, to make the fluid viscous and permit a flow of fluid.

FIGS. 5A and 5B illustrate detailed views of the dispensing assembly 104, the actuator(s) 310, the actuator(s) 312, and the actuator(s) 314, according to examples of the present disclosure. FIG. 5A illustrates an isometric view and FIG. 5B illustrates a front view. In FIG. 5B, the tray 102 and the actuator(s) 310 are shown removed.

The manifold 204 may be coupled to a frame 500. The actuator(s) 310 may be engaged with the frame 500 to move the dispensing assembly 104 in the upward and downward direction (e.g., in the Y-direction). For example, screw drives 502 may be coupled to the actuator(s) 310 and the frame 500, and actuation of the actuator(s) 310 may cause the frame 500 to move in the upward and downward direction (e.g., depending upon the direction of rotation). In some instances, the manifold 204 couples to the reservoir 306, and in turn, the reservoir 306 couples to the frame 500 for coupling the manifold 204 to the frame 500.

The plungers 400 are coupled to a mount 504. The actuator(s) 314 are also coupled to the mount 504, and screw drives 506 may be coupled to the actuator(s) 314 and engaged with the frame 500. For example, a first end of the plungers 400 may be coupled to the mount 504, and a second end of the plungers 400, opposite the first end (e.g., in the Y-direction), may be disposed within the manifold 204. During actuation of the actuator(s) 314, the plungers 400 are either advanced in a direction into the manifold 204 (e.g., to dispense the fluid) or retracted in a direction away from the manifold 204 (e.g., to fill the manifold 204 with fluid from the reservoir 306).

The dispensing assembly 104 may additionally include a guide 508 that couples to the frame 500. Ends of the needles 202 may be disposed through the guide 508. In some instances, the guide 508 may protect users from the ends of the needles 202 to avoid injury.

Actuator(s) 510 may couple a shaft disposed within the manifold 204. The shaft may be rotated to fluidly connect the manifold 204 with the needles 202. The shaft may also be rotated to prevent the flow of fluid from the manifold 204 to the needles 202. For example, in a first position of the shaft, the shaft permits the flow of fluid to the needles 202. In a second position of the shaft, the shaft restricts the flow of fluid to the needles 202. The shaft may be rotatable by the actuator(s) 510 between the first position and the second position.

Rod(s) 512, such as a first rod 512(1) and a second rod 512(2), may be disposed between a plate 514 to which the actuator(s) 312 are coupled and the piston 308. During actuation of the actuator(s) 312, the rods 512 may urge against the piston 308 to pressurize the fluid in the reservoir 306. Screw drives 516 coupled to the actuator(s) 310 may be engaged with a frame 518 disposed above the reservoir 306.

The piston 308 may include a first connection 520 and a second connection 522. The first connection 520 may be coupled to a conduit fluidly connected to the pump 122(1). Fluid may be dispensed into the reservoir 306 via the first connection 520. The second connection 522 may be a breather line to purge any air within the reservoir 306. In some instances, the pump 122(3) is fluidly connected to the second connection 522 via conduit. The pump 122(3), in some instances, may bleed the line to remove any air from the reservoir 306. As the actuator(s) 312 are actuated, the pump 122(3) may be cycled on and off to bleed the air from the reservoir 306 and/or permit the piston 308 to apply pressure to the fluid. For example, for the piston 308 to apply pressure, the pump 122(3) may close, power off, etc., to apply back pressure.

FIG. 6 illustrates an isometric view of the dispensing assembly 104, according to examples of the present disclosure. In FIG. 6, the actuator(s) 310 and the actuator(s) 314 are shown removed. Introduced above, the actuator(s) 312 act on the piston 308 to apply pressure to fluid contained in the reservoir 306. For example, the actuator(s) 312 may actuate in the direction 206 to pressurize the fluid and cause the fluid to route throughout the dispensing assembly 104. The actuator(s) 312 may move in an opposite direction than the direction 206, such as in a direction 600, when or to allow the reservoir 306 to be filled with fluid. For example, when emptied of the fluid, the actuator(s) 312 may retract the piston 308 (e.g., in the direction 600). In some instances, when the piston 308 moves in the direction 600, the pump 122(3) may be opened to allow the reservoir 306 to breathe and prevent cavitation.

The plungers 400 are coupled to the mount 504. The mount 504 may define receptacles that receive one end of the plungers 400, while another end of the plungers 400 may be disposed within the manifold 204. A plate 602 may couple to the mount 504 to retain the plungers 400 within the mount 504 or to couple the plungers 400 to the mount 504. The plate 602 may be removably coupled to the mount 504 to permit removal of the plungers 400. The plungers 400, for example, may be removed to replace the plungers 400, perform maintenance on the plungers 400, etc. Actuation of the actuator(s) 314 in either the direction 206 or the direction 600 causes the plungers 400 to move via an engagement between the plungers 400 and the mount 504. The actuator(s) 314 are also coupled to the mount 504, and the screw drives 506 may be coupled to the actuator(s) 314 and engaged with the frame 500.

Introduced above, the actuator(s) 510 may couple to the shaft disposed within the manifold 204. In some instances, fasteners 604 are used to couple an arm 606 the shaft, whereby the actuator(s) 510 may be coupled to the arm 606. The actuator(s) 510 may be disposed on either side of the manifold 204 (e.g., sides spaced apart in the X-direction).

Figure 7:
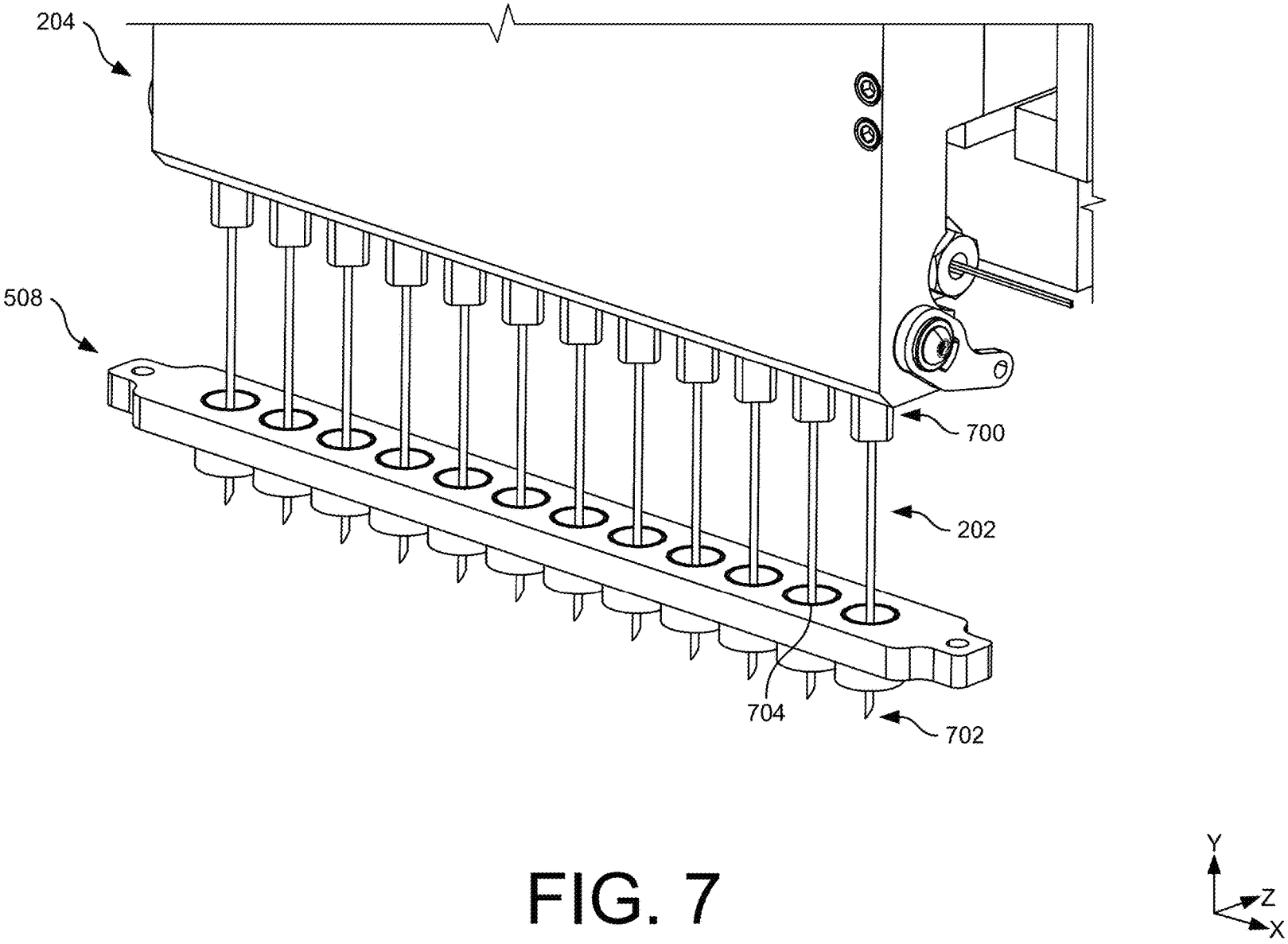
FIG. 7 illustrates a partial isometric view of the dispensing assembly of FIG. 6, according to examples of the present disclosure.

FIG. 7 illustrates a disposition of the needles 202 through the guide 508, according to examples of the present disclosure. The needles 202 may include a first end 700 coupled to the manifold 204 and a second end 702 spaced apart from the first end 700 (e.g., in the Y-direction). The second end 702 may be disposed through the guide 508. For example, the guide 508 may include channels 704 through which a portion of the needles 202 is disposed. During movement of the needles 202 into the paper cones, the needles 202 may be disposed by a greater distance through the channels 704. In other words, a distance between the manifold 204 and the guide 508 may be depressed as the needles 202 are advanced into the to the paper cones.

The guide 508 may provide support to the needles 202 and/or prevent damage to the needles 202, users operating the injection device 100, etc. As shown, the injection device 100 may include twelve of the needles 202. The injection device 100 may therefore be configured to simultaneously deposit the fluid into twelve of the paper cones. That is, during actuation of the actuator(s) 310, all twelve of the needles 202 may simultaneously be disposed within the paper cones, respectively, and during actuation of the actuator(s) 314, the plungers 400 may supply the fluid to the needles 202, respectively. However, the injection device 100 may configured to simultaneously deposit the fluid into more than or less than twelve of the paper cones.

Figure 8:
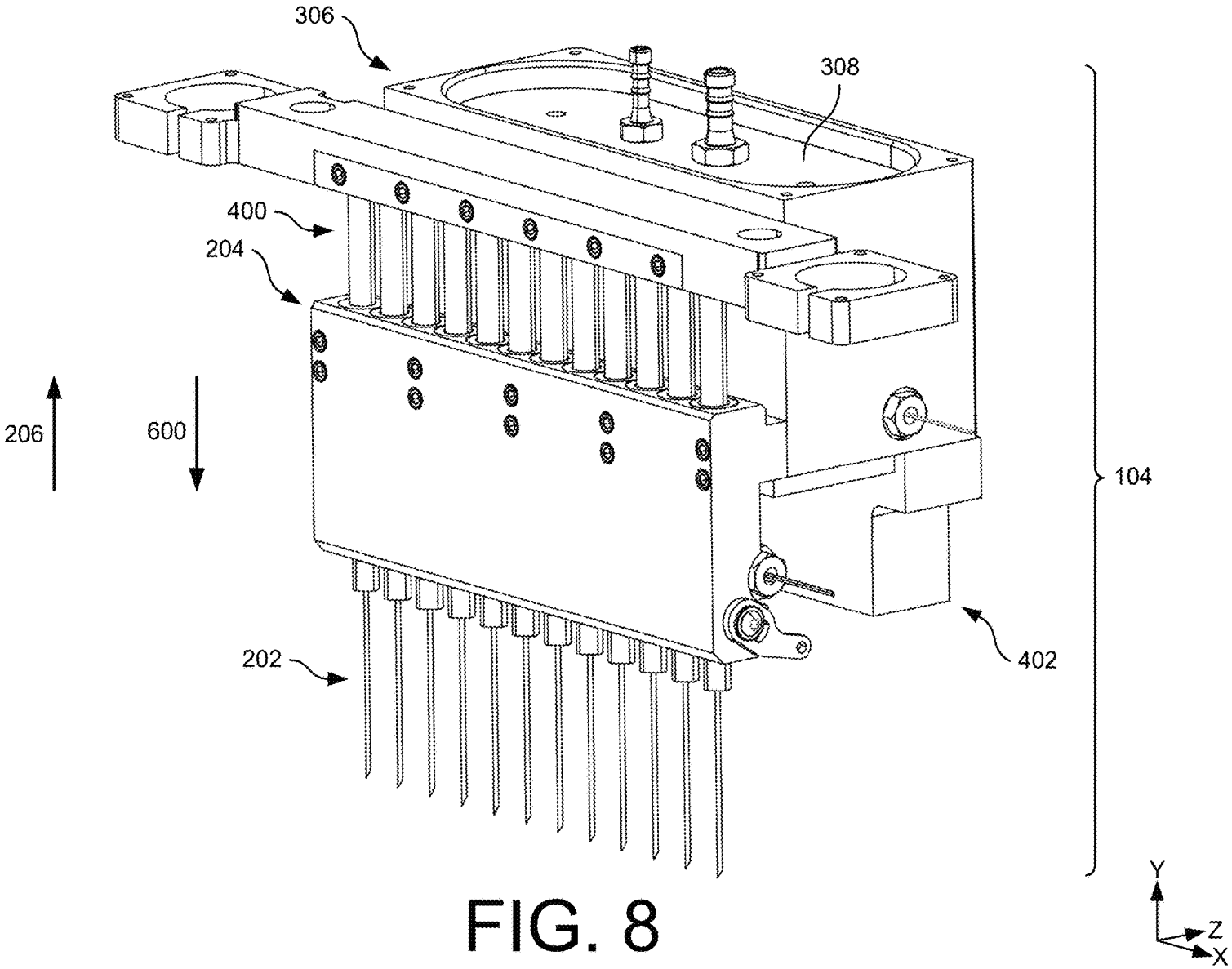
FIG. 8 illustrates a partial isometric view of the dispensing assembly of FIG. 6, according to examples of the present disclosure.

FIG. 8 illustrates an isometric view showing details of the dispensing assembly 104, according to examples of the present disclosure. The dispensing assembly 104 includes the reservoir 306, the manifold 204 coupled to the reservoir 306, the catch 402 coupled to the reservoir 306, and the plungers 400 engaged with the manifold 204. The dispensing assembly 104 is moveable in the direction 206 and the direction 600. The piston 308 and the plungers 400 are independently actuatable in the in the direction 206 and the direction 600 via the actuator(s) 312 and the actuator(s) 314, respectively. In some instances, the actuator(s) 310, the actuator(s) 312, and the actuator(s) 314 may be actuated simultaneously, or at different times. The dispensing assembly 104 may include heating element(s) 116 that heat the fluid within components of the dispensing assembly 104. In some instances, the heating element(s) 116 may be disposed within the reservoir 306 and/or the manifold 204.

Figure 9C:
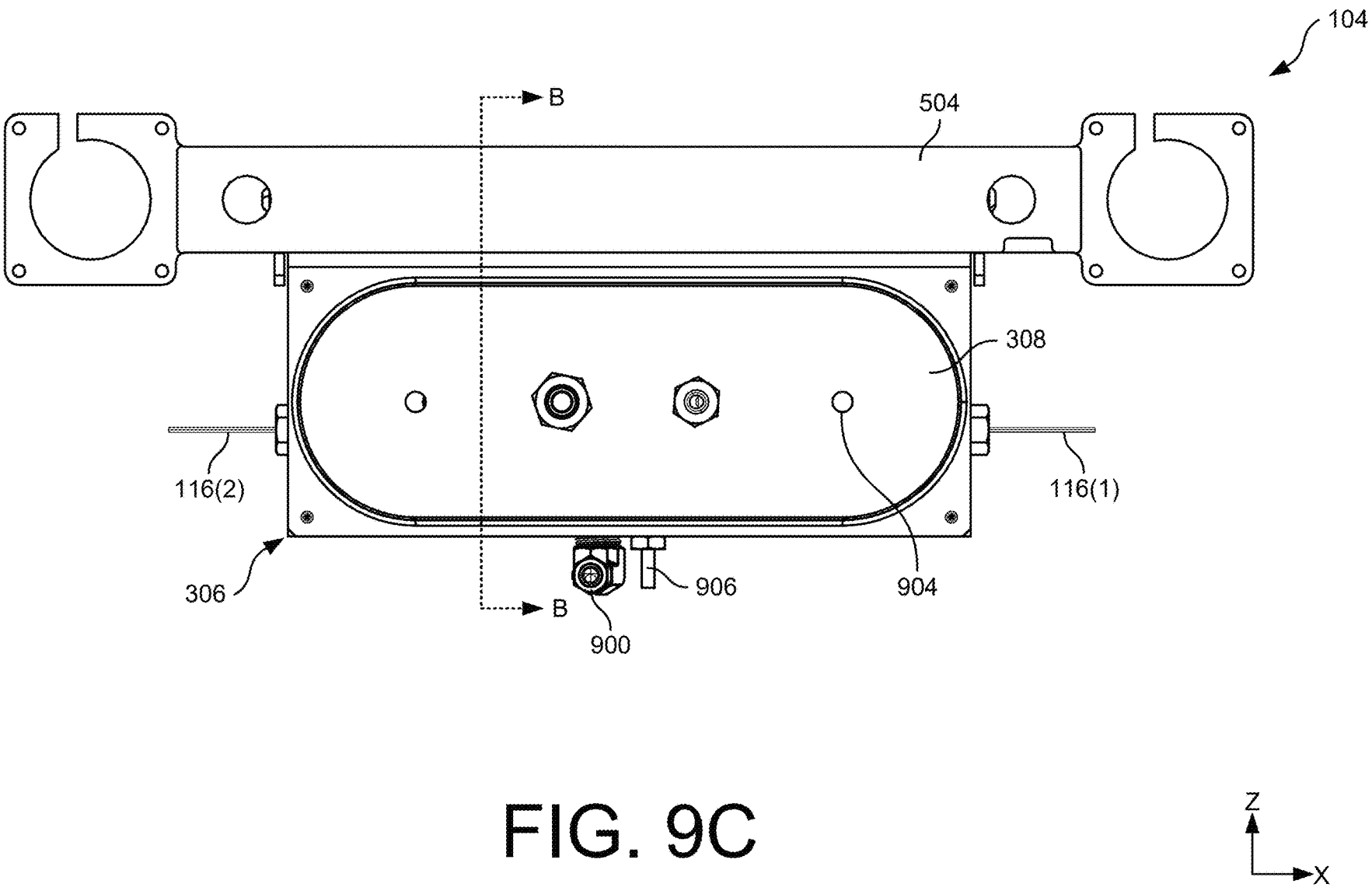
FIG. 9C illustrates a top view of the dispensing assembly of FIG. 6, according to examples of the present disclosure.
Figure 9D:
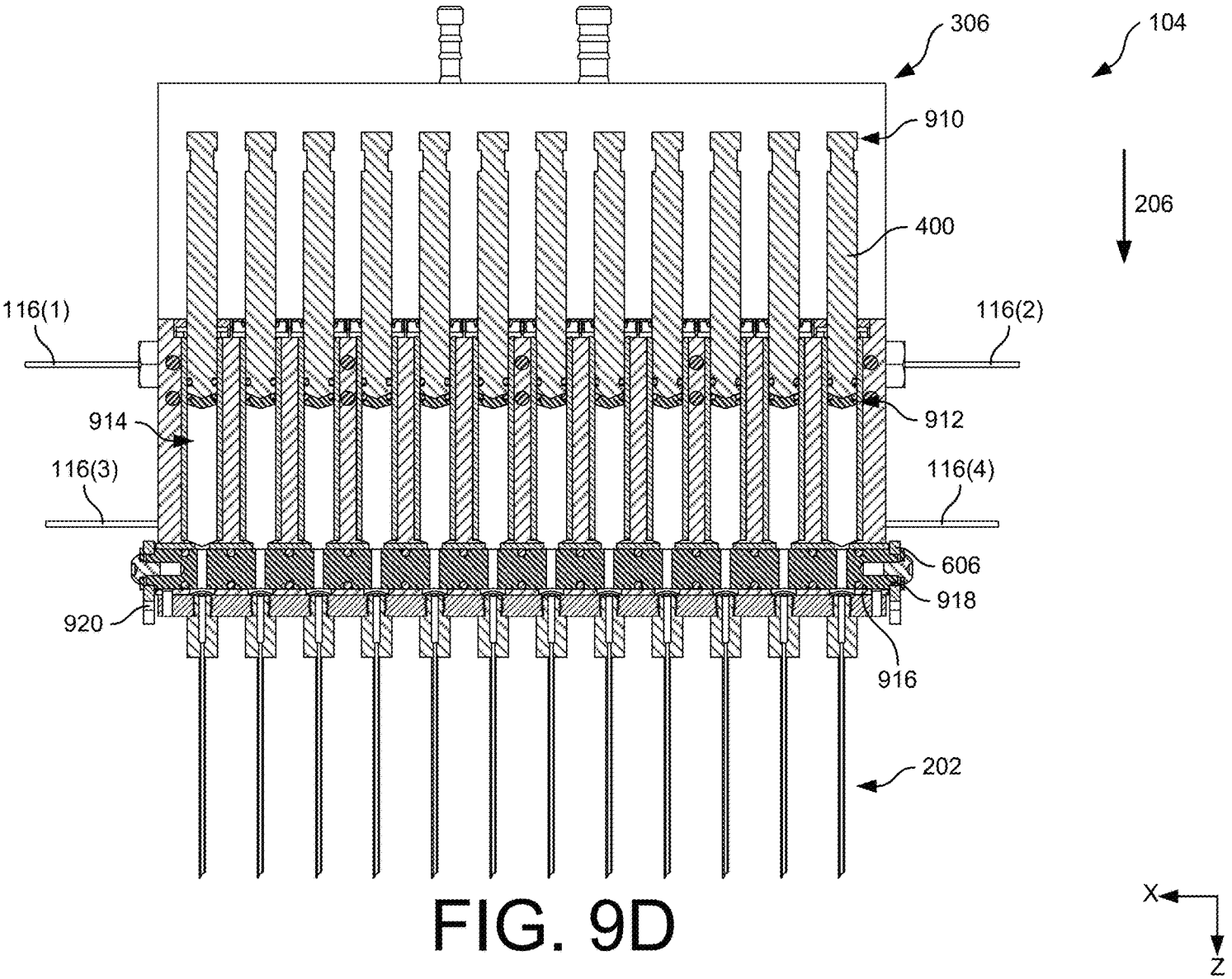
FIG. 9D illustrates a cross-sectional view of the dispensing assembly of FIG. 6, taken along line A-A of FIG. 9B, according to examples of the present disclosure.

FIGS. 9A-9D illustrate various views of the dispensing assembly 104, according to examples of the present disclosure. FIG. 9A illustrates a first side view of the dispensing assembly 104, FIG. 9B illustrates a second side view of the dispensing assembly 104, FIG. 9C illustrates a top view of the dispensing assembly 104, and FIG. 9D illustrates a cross-sectional view of the dispensing assembly 104, taken along line A-A of FIG. 9B. In FIG. 9D, the mount 504 is shown removed.

The dispensing assembly 104 includes the reservoir 306, the manifold 204 coupled to the reservoir 306, the catch 402 coupled to the reservoir 306, and the plungers 400. A first fitting 900 couples to the reservoir 306. In some instances, conduit couples to the first fitting 900 and fluidly couples to the pump 122(3). A second fitting 902 may couple to the catch 402 and fluidly couples to the pump 122(2) via conduit. The first connection 520 and the second connection 522 are further coupled to the piston 308. Apertures 904 may couple the rods 512 to the piston 308, respectively.

The heating element(s) 116 may include a first heating element 116(1) and a second heating element 116(2) coupled to the reservoir 306. In addition, the heating element(s) 116 may include a third heating element 116(3) and a fourth heating element 116(4) coupled to the manifold 204. A first temperature sensor 906 may couple to the reservoir 306 and a second temperature sensor 908 may couple the manifold 204. The first temperature sensor 906 and the second temperature sensor 908 may be used to control the heating element(s) 116, for example, via sensor data 120 generated from the first temperature sensor 906 and the second temperature sensor 908, respectively. For example, a temperature of the fluid within the reservoir 306 and the manifold 204 may be controlled based on temperature readings from the first temperature sensor 906 and the second temperature sensor 908.

As shown in FIG. 9D, the plungers 400 may include a first end 910 and a second end 912 spaced apart from the first end 910 (e.g., in the Y-direction). The first end 910 may couple to the mount 504, while the second end 912 may be disposed within chambers 914 of the manifold 204. The chambers 914, as will be explained herein, may receive fluid from the reservoir 306. During actuation of the actuator(s) 314, the plungers 400 move in the direction 206 to apply pressure to the fluid within the chambers 914.

A sleeve 916 and a shaft 918 are shown engaged with the manifold 204. As will be discussed herein, the sleeve 916 may be disposed within a passage of the manifold 204, and the shaft 918 may be disposed within the sleeve 916. The actuator(s) 510 may couple to the shaft 918, for example, via the arm 606 and an arm 920, respectively, to impart rotational movement to the shaft 918 (e.g., about the X-axis). The shaft 918 may define channels that align with orifices in the sleeve 916, the chambers 914, etc., to cause fluid to be routed to the needles 202. For example, in a first position of the shaft 918, such as shown in FIG. 9D, the channels in the shaft 918 may align with the chambers 914 and the needles 202 to permit the fluid to flow to the needles 202. Comparatively, in a second position of the shaft 918, the channels in the shaft 918 may not align with the chambers 914 and the needles 202 to restrict the fluid to flow to the needles 202. The manifold 204 may define twelve of the chambers 914, where each of the chambers 914 may be configured to fluidly connect to one of the twelve of the needles 202, respectively. The shaft 918 may correspondingly include twelve of the channels for routing the fluid from the chambers 914 to the needles 202, respectively.

FIG. 10 illustrates a partial cross-sectional view of the dispensing assembly 104, showing the manifold 204, the plungers 400, the sleeve 916, the shaft 918, and the needles 202, according to examples of the present disclosure. In FIG. 10, a first chamber 914(1), a second chamber 914(2), a third chamber 914(3), and a fourth chamber 914(4), and a first plunger 400(1), a second plunger 400(2), a third plunger 400(3), and a fourth plunger 400(4) are shown.

As introduced above, the manifold 204 may define the chambers 914 that receive the fluid. In FIG. 10, the fluid is shown being absent from the chambers 914. However, the fluid may be dispensed into the chambers 914, via actuation of the piston 308. Once filled, the plungers 400 may be actuated in the direction 206. The plungers 400 may be sealed against sidewalls of the chambers 914 via one or more o-rings. As the plungers 400 are actuated in the direction 206, the fluid may flow through the sleeve 916, the shaft 918, and into the needles 202. The needles 202 may define lumens 1000 through which the fluid is channeled.

The manifold 204, in addition to defining the chambers 914, defines a passage 1002. The sleeve 916 may be disposed within the passage 1002. The sleeve 916 may define orifices that fluidly connect with the chambers 914 and the needles 202. For example, the sleeve 916 may define first orifices 1004 that fluidly connect with the chambers 914, and second orifices 1006 that fluidly connect with the needles 202. The sleeve 916 may be rotatable within the passage 1002.

The shaft 918 is disposed within the sleeve 916. The shaft 918 may define channels 1008. As shown in FIG. 10, the channels 1008 are fluidly connected to, or between, the first orifices 1004 and the second orifices 1006 to permit the fluid to route from the chambers 914 to the needles 202. However, the shaft 918 may be rotated such that the channels 1008 are not fluidly connected to, or between, the first orifices 1004 and the second orifices 1006. This restricts the fluid routing between the chambers 914 and the needles 202. The shaft 918 may be rotated between the first position in which the channels 1008 are fluidly connected to the first orifices 1004 and the second orifices 1006, and a second position in which the channels 1008 are not fluidly connected to the first orifices 1004 and the second orifices 1006. The actuator(s) 510 may control the rotation of the shaft 918.

O-rings 1010, or other gaskets, bushings, etc., may be used to seat the shaft 918 within the sleeve 916. The o-rings 1010 may prevent fluid leaking between the chambers 914, or between the needles 202. For example, o-rings 1010 may prevent fluid in the second chamber 400(2) flowing to the first needle 202(1), and/or the o-rings 1010 may prevent fluid in the second chamber 400(2) from flowing to the third needle 202(3). The o-rings 1010 may be disposed within grooves, races, etc., of the shaft 918.

The needles 202 may be coupled to the manifold 204. In some instances, the manifold 204 defines receptacles into which ends of the needles 202 are disposed. For example, ends of the needle 202 may be threaded into the receptacles. The needles 202 may be removably coupled to the manifold 204 for replacement, maintenance, etc., Moreover, different needles may be coupled to the manifold 204 depending upon a size of the paper cones (e.g., length), and/or different needles may have differently sized lumens for dispensing the fluid.

FIG. 11 illustrates a cross-sectional view of the dispensing assembly 104, taken along line B-B of FIG. 9C, according to examples of the present disclosure. The reservoir 306 defines a cavity 1100 that receives the fluid. For example, the fluid may be dispensed into the cavity 1100 via the first connection 520. The reservoir 306 defines channels 1102 that fluidly connect to channels 1104 in the manifold 204. The channels 1104 are fluidly connected to the chambers 914. For example, the channels 1102 and the channels 1104 may route fluid into the chambers 914. As the plunger 400 is actuated in the direction 206, the fluid may be urged into the chambers 914.

The chambers 914 fluidly connect to the needles 202 via the shaft 918 and the sleeve 916. For example, as the actuator(s) 314 actuate the plungers 400, the fluid may be routed to the needles 202, through the chambers 914, the sleeve 916, and the shaft 918. The catch 402 is shown coupled to the reservoir 306, and the first temperature sensor 906 is shown disposed in the reservoir 306.

Figure 12A:
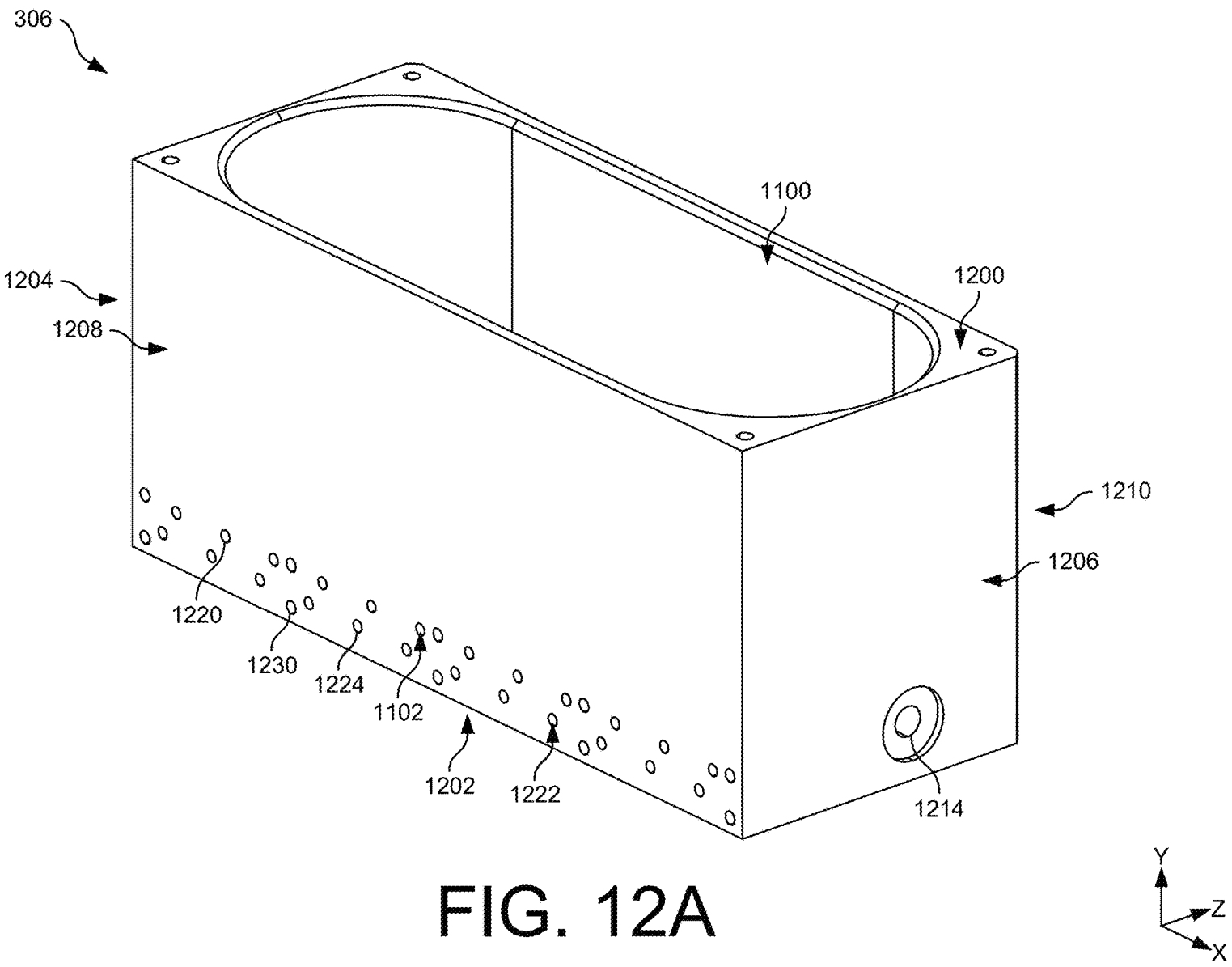
FIG. 12A illustrates a first isometric view of an example reservoir of the dispensing assembly of FIG. 6, according to examples of the present disclosure.
Figure 12B:
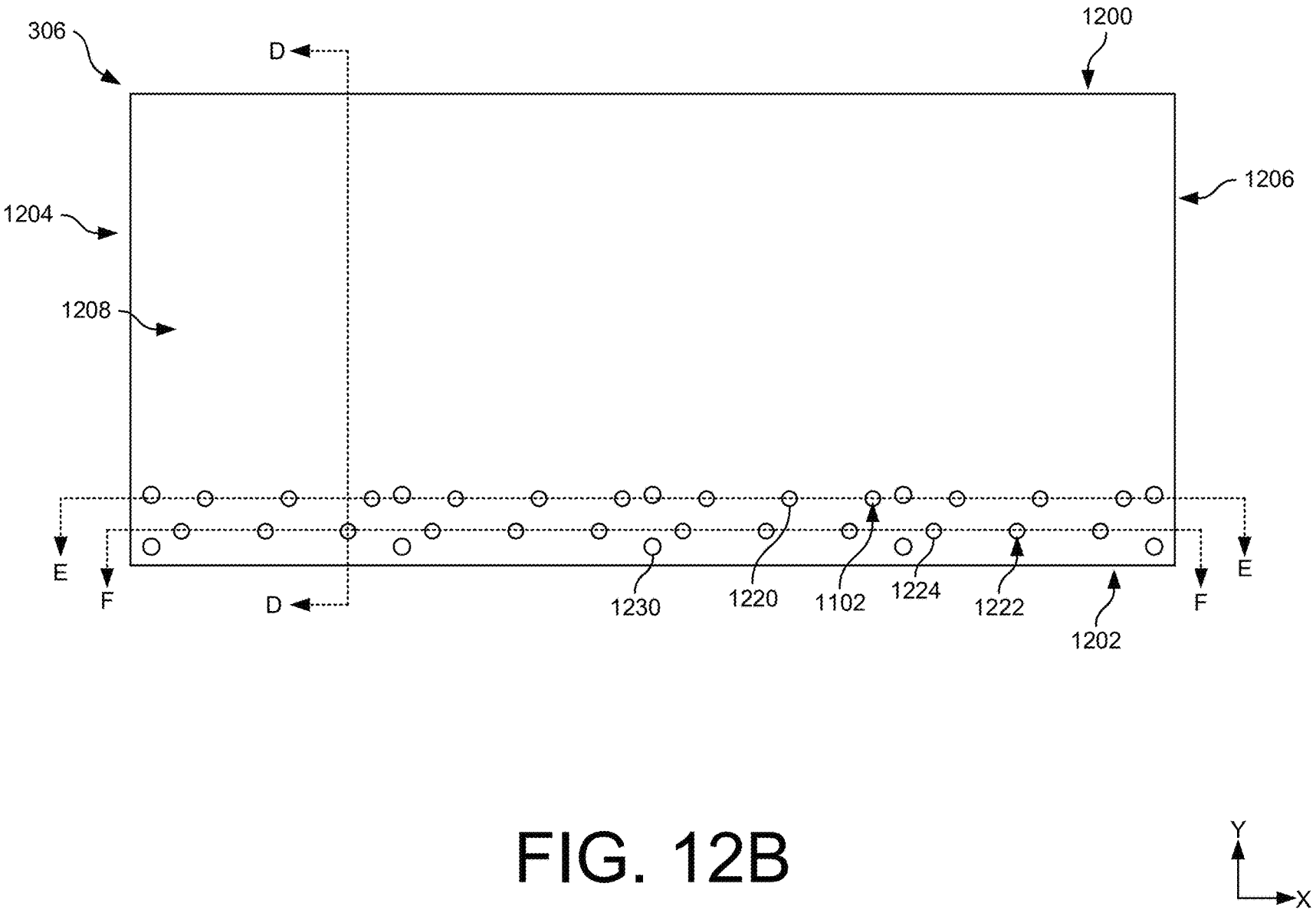
FIG. 12B illustrates a front view of the reservoir of FIG. 12A, according to examples of the present disclosure.
Figure 12C:
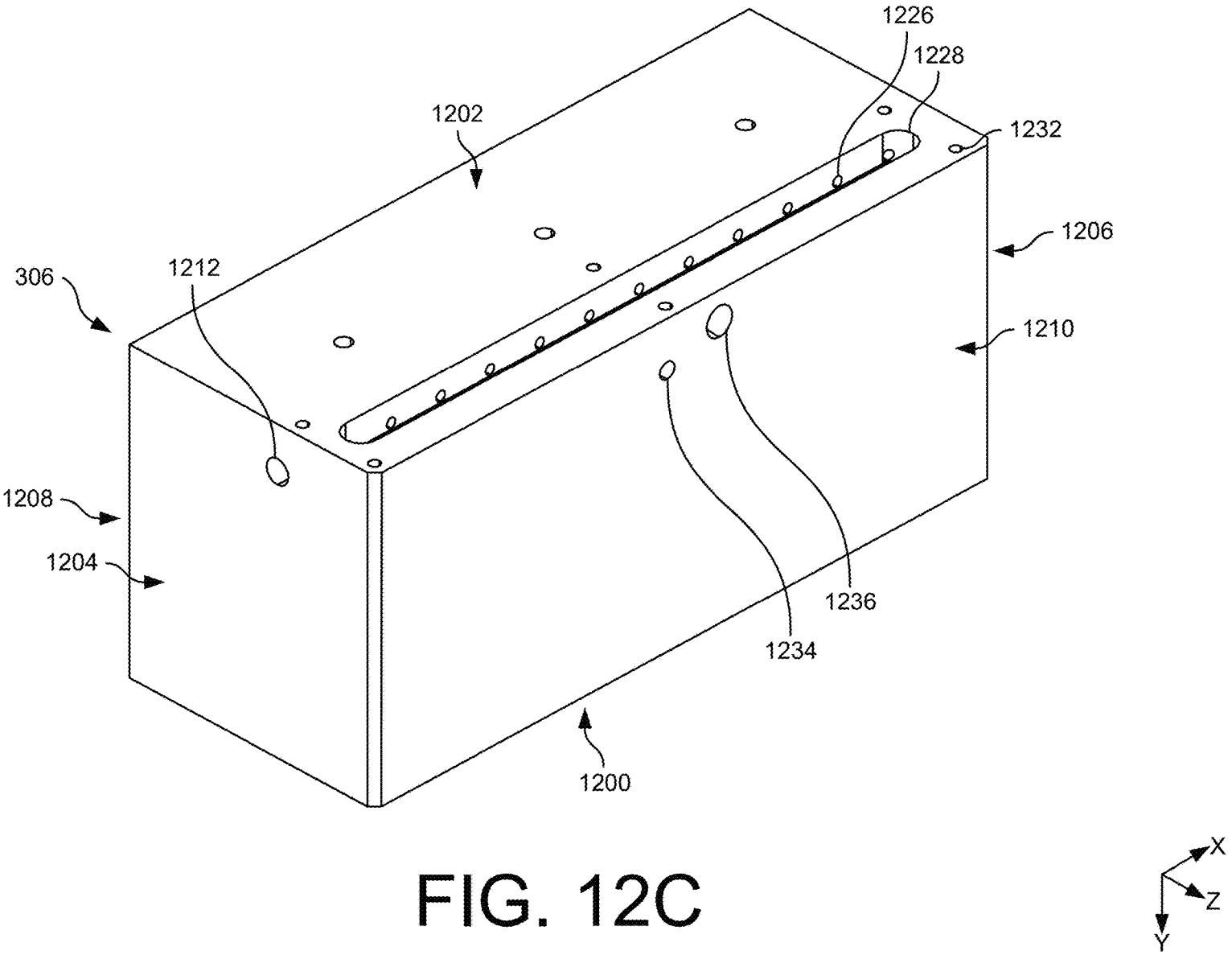
FIG. 12C illustrates a second isometric view of the reservoir of FIG. 12A, according to examples of the present disclosure.
Figure 12D:
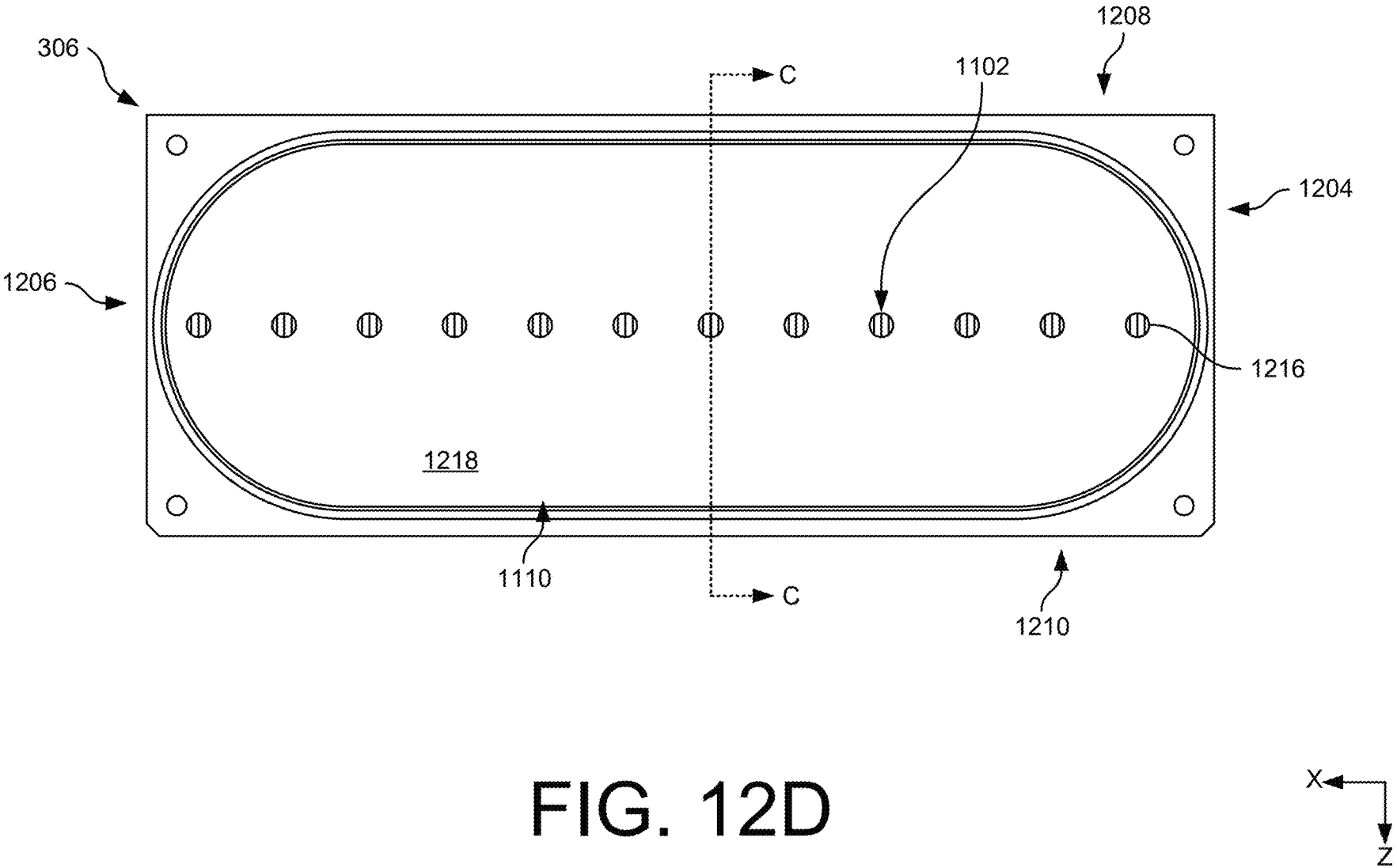
FIG. 12D illustrates a top view of the reservoir of FIG. 12A, according to examples of the present disclosure.

FIGS. 12A-12D illustrate various views of the reservoir 306, according to examples of the present disclosure. FIG. 12A illustrates a top isometric view of the reservoir 306, FIG. 12B illustrates a first side view of the reservoir 306, FIG. 12C illustrates a bottom isometric view of the reservoir 306, and FIG. 12D illustrates a second side view of the reservoir 306.

The reservoir 306 may include a top 1200, a bottom 1202 spaced apart from the top 1200 (e.g., in the Y-direction), a first side 1204 (e.g., left-hand side), a second side 1206 (e.g., right-hand side) spaced apart from the first side 1204 (e.g., in the X-direction), a third side 1208 (e.g., front), and a fourth side 1210 (e.g., back) spaced apart from the third side 1208 (e.g., in the Z-direction). The reservoir 306 may define the cavity 1100 to receive the piston 308. The fluid may be pumped into the cavity 1100 via the pump(s) 122. As shown, the cavity 1100 may be disposed along, or defined by, the top 1200. The cavity 1100 is sized and shaped to receive the piston 308.

The first side 1204 may include a first port 1212 and the second side 1206 may include a second port 1214. The heating element 116(1) and the heating element 116(2) may be disposed in the first port 1212 and the second port 1214, respectively. For example, the heating element 116(1) and the heating element 116(2) may be insertable into the first port 1212 and the second port 1214, respectively, to heat the fluid within the cavity 1100. Alternatively, in some instances, only a single heating element 116 may be disposed in the first port 1212 and the second port 1214, or the reservoir 306 may only include a single heating element.

The reservoir 306 may define the channels 1102 that route the fluid into the chambers 914 of the manifold 204. Individual channels of the channels 1102 may include an inlet 1216 disposed within the cavity 1100, such as along a bottom surface 1218 of the cavity 1100, and an outlet 1220 disposed along the third side 1208. The inlet 1216 of the channels 1102 may be disposed along a straight line. In some instances, the inlets 1216 of the channels 1102 may be centrally disposed within the cavity 1100, between the third side 1208 and the fourth side 1210. Moreover, the inlets 1216 of the channels 1102 may be equidistantly spaced apart from one another.

The reservoir 306 may define channels 1222. Individual channels of the channels 1222 may include an inlet 1224 disposed along the third side 1208 and an outlet 1226 disposed within a trough 1228 on the bottom 1202 of the reservoir 306. In instances in which the injection device 100 is configured to dispense the fluid into twelve of the paper cones, the reservoir 306 may include twelve of the channels 1102 (and a corresponding inlet and outlet for each of the channels 1102) and twelve of the channels 1222 (and a corresponding inlet and outlet for each of the channels 1222). The channels 1102 and the channels 1222 may be formed within a body of the reservoir 306.

The outlet 1220 for the channels 1102 may be located closer to the top 1200 compared to the inlet 1224 of the channels 1222. The inlet 1224 of the channels 1222 may be located closer to the bottom 1202 compared to the outlet 1220 of the channels 1102. The channels 1222 may permit air to be purged out of the chambers 914 to avoid bubbles in the fluid, or dispensing air into the paper cones. As will be explained herein, the manifold 204 may couple to the third side 1208 of the reservoir 306. The channels 1104 of the manifold 204 may fluidly connect (e.g., mate, adjoin, etc.) to the channels 1102. The manifold 204 may include other channels that fluidly connect to the channels 1222. The third side 1208 of the reservoir 306 may include apertures 1230 for receiving fasteners that couple the manifold 204 to the reservoir 306.

The catch 402 may be coupled to the bottom 1202 of the reservoir 306. The trough 1228 is fluidly connected to the catch 402 such that excess fluid (as routed from the channels 1222) is collected in the catch 402. The bottom 1202 may include apertures 1232 for coupling the catch 402 to the reservoir 306. The fourth side 1210 may include a third port 1234, which may receive the first temperature sensor 906. For example, the first temperature sensor 906 may be insertable into the third port 1234. The first temperature sensor 906 may be used to measure a temperature of the reservoir 306, or a temperature associated with the fluid in the reservoir 306, for use in controlling the heating element(s) 116. The fourth side 1210 may also include an opening 1236 that receives the first fitting 900 to vent the channels 1222 and/or the catch 402.

The reservoir 306 may be formed from metal, plastics, composites, ceramics, etc. Suitable manufacturing techniques, depending upon the material, include casting, machining, injection molding, etc.

Figure 13A:
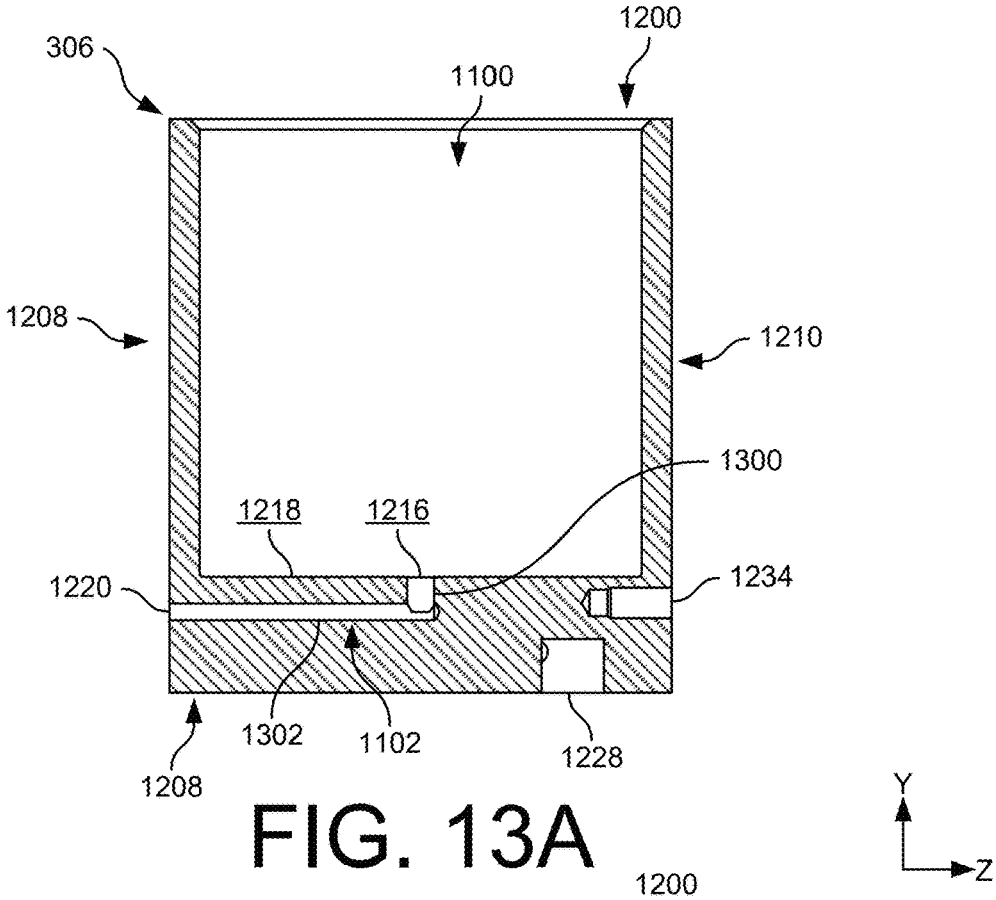
FIG. 13A illustrates a cross-sectional view of the reservoir of FIG. 12A, taken along line C-C of FIG. 12D, according to examples of the present disclosure.
Figure 13B:
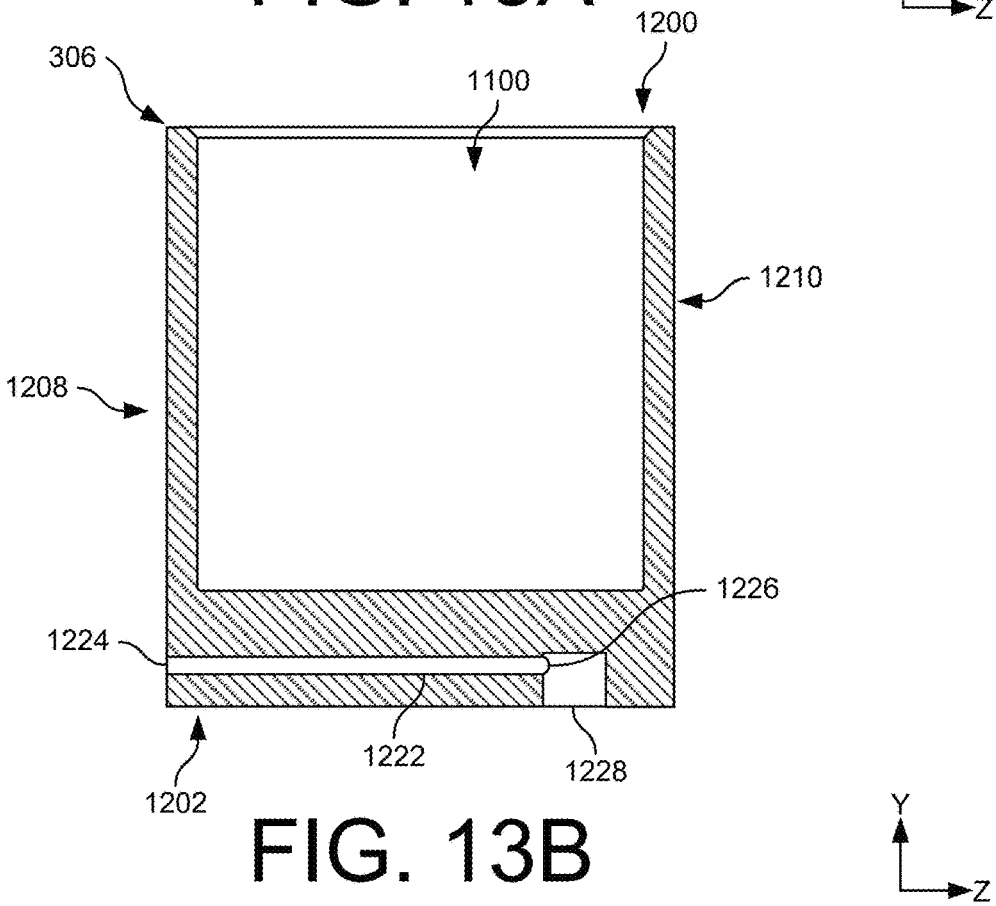
FIG. 13B illustrates a cross-sectional view of the reservoir of FIG. 12A, taken along line D-D of FIG. 12B, according to examples of the present disclosure.

FIGS. 13A and 13B illustrate cross-sectional views of the reservoir 306, according to examples of the present disclosure. FIG. 13A illustrates a cross-sectional view of the reservoir 306, taken along line C-C of FIG. 12D, and FIG. 13B illustrates a cross-sectional view of the reservoir 306, taken along line D-D of FIG. 12B. Although FIGS. 13A and 13B illustrate one of the channels 1102 and one of the channels 1222, respectively, other channels of the channels 1102 and other channels of the channels 1222, respectively, may be similar.

The reservoir 306 includes the cavity 1100 formed in the top 1200 and the trough 1228 formed in the bottom 1202. The cavity 1100 may include a depth (e.g., in the Y-direction) and may be configured to hold a predetermined volume of the fluid. The trough 1228 may include a depth (e.g., in the Y-direction) that is less than the depth of the cavity 1100. The trough 1228 may be located closer to the fourth side 1210 as compared to the third side 1208. Other variations, however, are envisioned. The reservoir 306 may also include the third port 1234 to accommodate the first temperature sensor 906.

As shown in FIG. 13A, the channels 1102 extend from the bottom surface 1218 of the cavity 1100 to the third side 1208 of the reservoir 306. For example, the inlet 1216 of the channels 1102 may be disposed in the bottom surface 1218 and the outlet 1220 of the channels 1102 may be disposed along the third side 1208. In some instances, the channels 1102 include a first portion 1300 and a second portion 1302. The first portion 1300 may extend in a first direction (e.g., Y-direction) and the second portion 1302 may extend in a second direction (e.g., Z-direction) different than the first direction. In some instances, the first portion 1300 may be oriented perpendicular to the second portion 1302. The second portion 1302 may also be longer in length than the first portion 1300. As shown, the first portion 1300 may extend from the bottom surface 1218, while the second portion 1302 may extend from third side 1208. The first portion 1300 and the second portion 1302 may fluidly connect (e.g., adjoin) at a location beneath the bottom surface 1218.

As shown in FIG. 13B, the channels 1222 may extend from the third side 1208 in a direction towards the fourth side 1210 (e.g., in the Z-direction). For example, the inlet 1224 of the channels 1222 may be disposed along the third side 1208 and the outlet 1226 of the channels 1222 may be disposed within the trough 1228, and accessible via the bottom 1202. The channels 1222 may fluidly connect to the trough 1228. In some instances, the channels 1222 may be oriented parallel to the top 1200 and/or the bottom 1202. The channels 1222 may also be oriented parallel to the second portion 1302 of the channels 1102. The channels 1222 may be longer in length as compared to the channels 1102, or the second portion 1302 of the channels 1102. As introduced above, the channels 1222 may be located closer to the bottom 1202 than the channels 1102. For example, the channels 1222 may be located closer to the bottom 1202 than the second portion 1302.

Figure 14A:
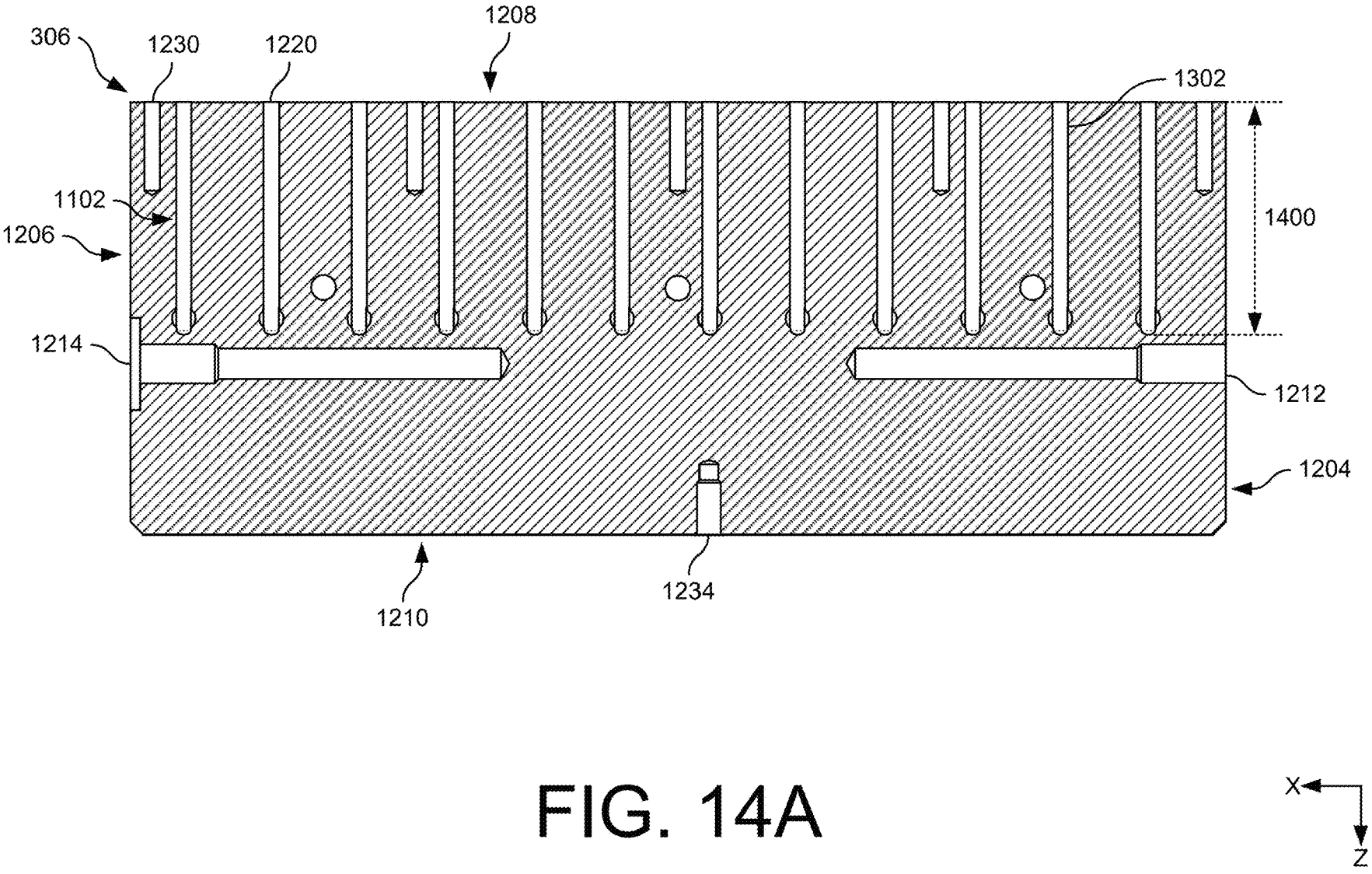
FIG. 14A illustrates a cross-sectional view of the reservoir of FIG. 12A, taken along line E-E of FIG. 12B, according to examples of the present disclosure.
Figure 14B:
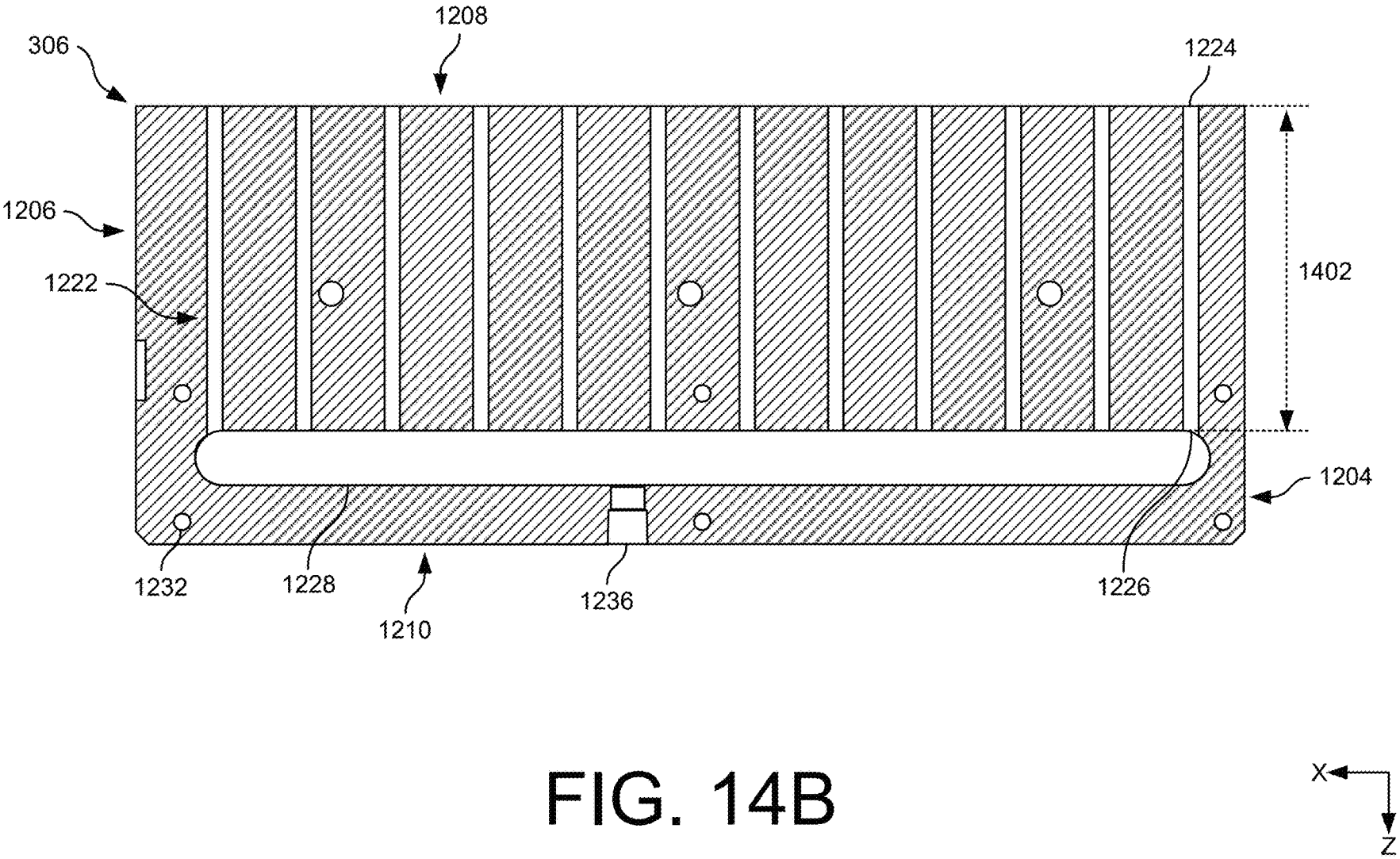
FIG. 14B illustrates a cross-sectional view of the reservoir of FIG. 12A, taken along line F-F of FIG. 12B, according to examples of the present disclosure.

FIGS. 14A and 14B illustrate cross-sectional views of the reservoir 306, according to examples of the present disclosure. FIG. 13A illustrates a cross-sectional view of the reservoir 306, taken along line E-E of FIG. 12B, and FIG. 14B illustrates a cross-sectional view of the reservoir 306, taken along line F-F of FIG. 12B.

The reservoir 306 defines the first port 1212, the second port 1214, and the third port 1234. The first port 1212 may be disposed in the first side 1204, the second port 1214 may be disposed in the second side 1206, and the third port 1234 may be disposed in the fourth side 1210. Heating element(s) 116 may be disposed in the first port 1212 and the second port 1214 to heat the fluid within the cavity 1100, respectively. The first temperature sensor 906 may be disposed in the third port 1234 for measuring a temperature of the reservoir 306 or the fluid, for example, for use in controlling the heating element(s) 116.

The third side 1208 of the reservoir 306 may include the apertures 1230 for receiving fasteners that couple the manifold 204 to the reservoir 306. The third side 1208 further includes the outlets 1220 to the channels 1102. The second portion 1302 extends from the outlets 1220 in a direction towards the fourth side 1210. The second portion 1302 may include a length 1400. As shown, the second portion 1302 of the channels 1102 may be oriented parallel to one another.

The channels 1222 extend between the third side 1208 and the trough 1228. The channels 1222 may include a length 1402 that is greater than the length 1400. The inlet 1224 may be disposed along the third side 1208, and the outlet 1226 may be disposed within the trough 1228. As shown, the channels 1222 may be oriented parallel to one another. The fourth side 1210 defines the opening 1236 for receiving the vent line, for example, to vent the catch 402. The apertures 1232 are further formed in the reservoir 306 to permit coupling of the catch 402 to the reservoir 306.

Figure 15A:
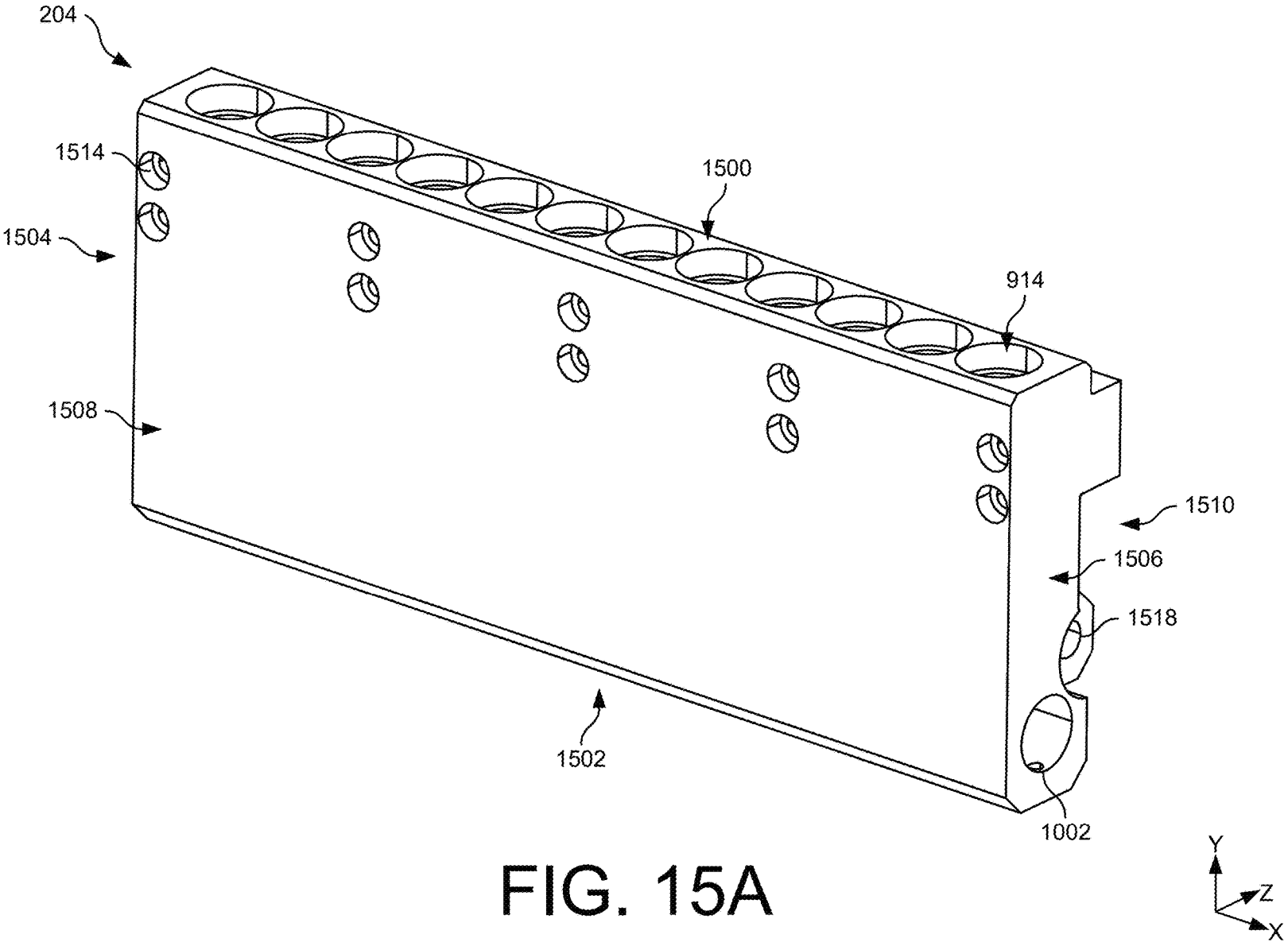
FIG. 15A illustrates an isometric view of an example manifold of the dispensing assembly of FIG. 6, according to examples of the present disclosure.
Figure 15B:
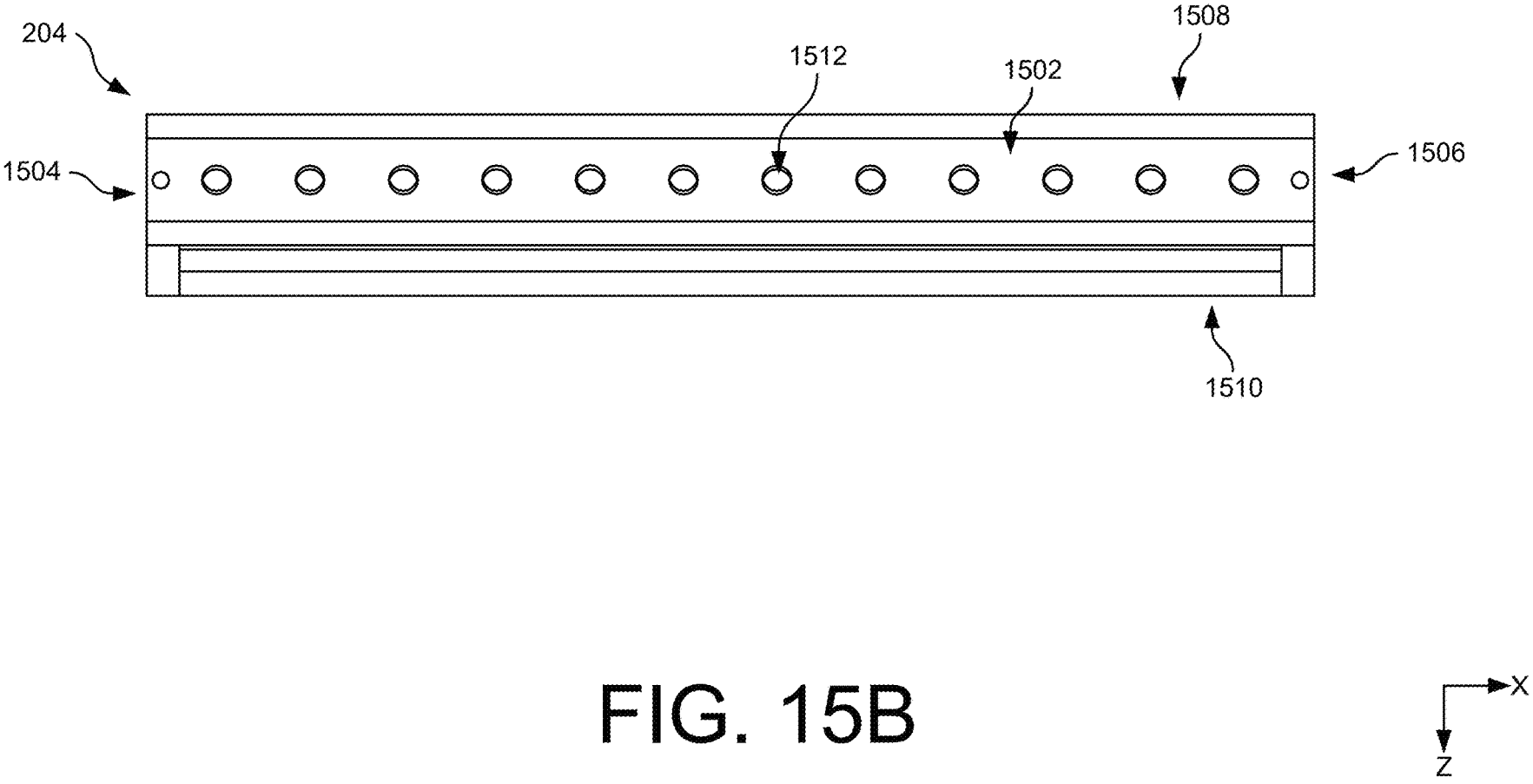
FIG. 15B illustrates a bottom view of the manifold of FIG. 15A, according to examples of the present disclosure.
Figure 15C:
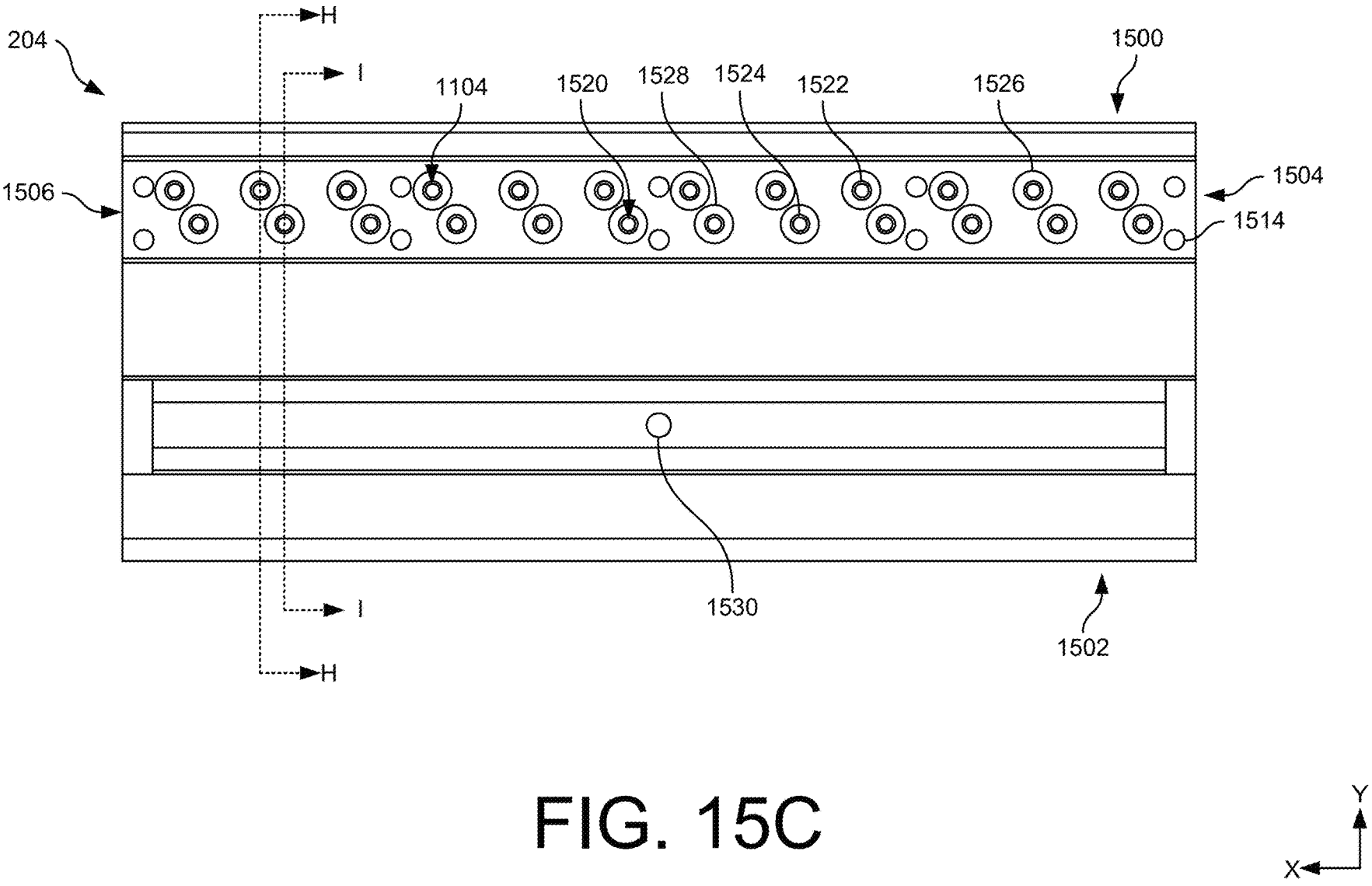
FIG. 15C illustrates a rear view of the manifold of FIG. 15A, according to examples of the present disclosure.
Figure 15E:
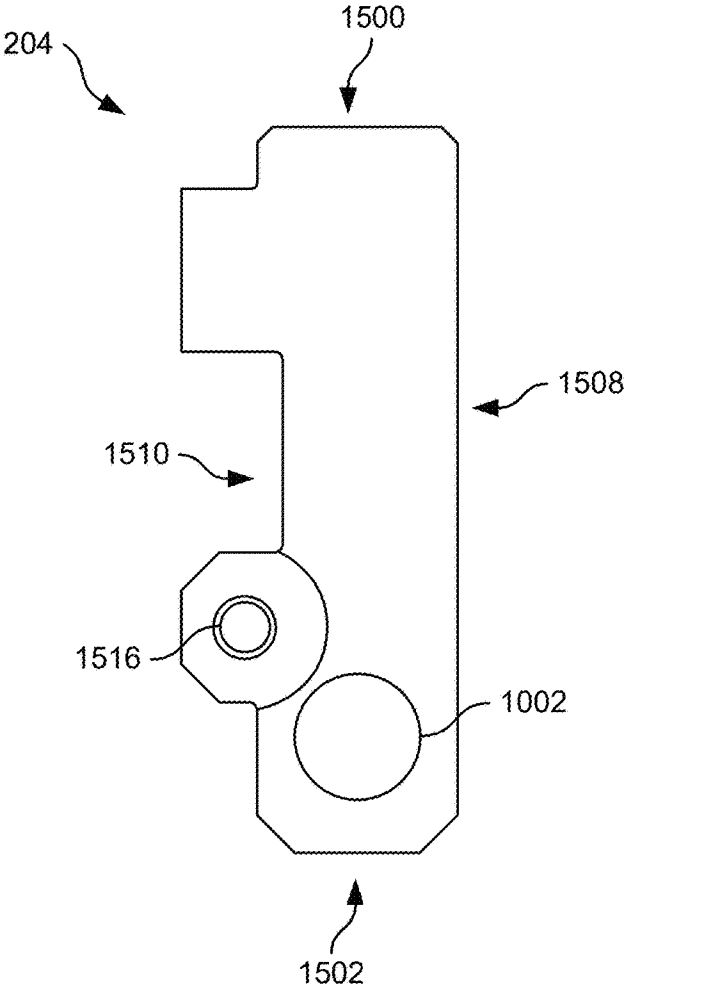
FIG. 15E illustrates a second side view of the manifold of FIG. 15A, according to examples of the present disclosure.
Figure 15D:
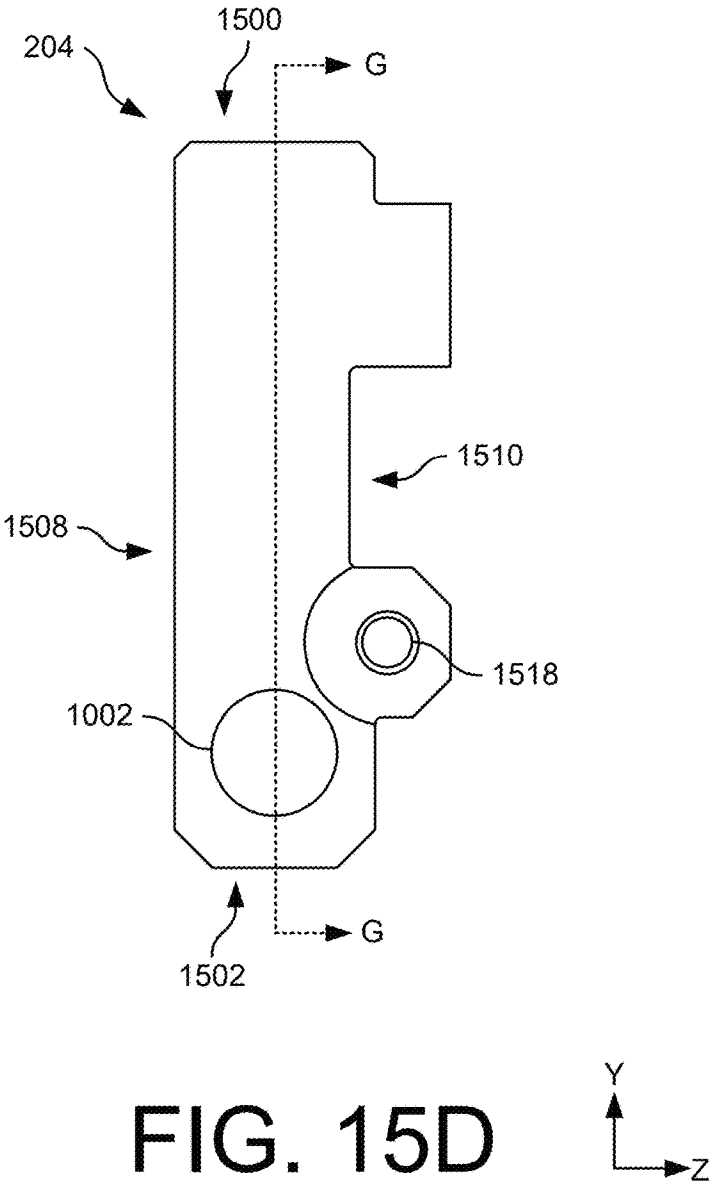
FIG. 15D illustrates a first side view of the manifold of FIG. 15A, according to examples of the present disclosure.

FIGS. 15A-15E illustrate various views of the manifold 204, according to examples of the present disclosure. FIG. 15A illustrates an isometric view of the manifold 204, FIG. 15B illustrates a bottom view of the manifold 204, FIG. 15C illustrates a first side view of the manifold 204, FIG. 15D illustrates a second side view of the manifold 204, and FIG. 15E illustrates a third side view of the manifold 204.

The manifold 204 may include a top 1500, a bottom 1502 spaced apart from the top 1500 (e.g., in the Y-direction), a first side 1504 (e.g., left-hand side), a second side 1506 (e.g., right-hand side) spaced apart from the first side 1504 (e.g., in the X-direction), a third side 1508 (e.g., front), and a fourth side 1510 (e.g., back) spaced apart from the third side 1508 (e.g., in the Z-direction). The manifold 204 may define the chambers 914 that receive the plungers 400. As shown, the manifold 204 may define twelve of the chambers 914. The chambers 914 may be formed in the top 1500 of the manifold 204, or may be open at the top 1500, such that the plungers 400 are insertable into the chambers 914.

The manifold 204 may define the passage 1002 in which the sleeve 916 and the shaft 918 are disposed. As shown, the passage 1002 may be disposed between the first side 1504 and the second side 1506. The passage 1002 may be fluidly connected to the chambers 914 and the needles 202. For example, the bottom 1502 may define receptacles 1512 that receive the first end 700 of the needles 202. In some instances, the needles 202 may be threaded into the receptacles 1512. The receptacles 1512 may be aligned and equidistantly spaced apart from one another. As discussed above, the shaft 918 may be rotated to align the channels 1008 with the chambers 914 and permit the fluid to flow into the needles 202.

The manifold 204 may include apertures 1514 that receive fasteners that couple the manifold 204 to the reservoir 306. For example, the apertures 1514 may be disposed between the third side 1508 and the fourth side 1510. The apertures 1514 may align with the apertures 1230, and fasteners may be disposed through the apertures 1514 and into the apertures 1230 for coupling the manifold 204 to the reservoir 306.

The first side 1504 may include a first port 1516 and the second side 1506 may include a second port 1518. The heating element 116(3) an the heating element 116(4) may be disposed in the first port 1516 and the second port 1518, respectively. For example, the heating element(s) 116 may be insertable into the first port 1516 and the second port 1518, respectively, to heat the fluid within or flowing through the manifold 204. Alternatively, in some instances, only a single heating element 116 may be disposed in the first port 1516 and the second port 1518, or the manifold 204 may only include a single heating element 116.

The manifold 204 defines the channels 1104 and channels 1520. The channels 1104 and the channels 1520 are fluidly connected to the chambers 914. The channels 1104 fluidly connect to the channels 1102, for example, to route fluid from the cavity 1100 into the chambers 914. For example, the channels 1104 may include an inlet 1522 that fluidly connects (e.g., engages, mates, adjoins, etc.) with the outlet 1220 of the channels 1102. The inlet 1522 may be disposed on the fourth side 1510. An outlet of the channels 1104, as will be discussed herein, is fluidly connected to the chambers 914. The channels 1520 fluidly connect the channels 1222, for example, to purge air out of the chambers 914 and into the catch 402. For example, the channels 1520 may include an outlet 1524 that fluidly connects (e.g., engages, mates, adjoins, etc.) with the inlet 1224 of the channels 1222. The outlet 1524 may be disposed on the fourth side 1510. An inlet of the channels 1520, as will be discussed herein, are fluidly connected to the chambers 914.

The inlet 1522 may be located closer to the top 1500 as compared to the outlet 1524. More generally, the channels 1520 may be located vertically beneath (e.g., in the Y-direction) the channels 1104. The location of the channels 1520 below the channels 1104 permits the air to be purged out of the chambers 914. The manifold 204 may define twelve of the channels 1104 that fluidly connect to the twelve of the channels 1102, respectively. Additionally, the manifold 204 may define twelve of the channels 1520 that fluidly connect to the twelve of the channels 1222, respectively.

The manifold 204 may define a groove 1526 (e.g., race, indent, etc.) around the inlet 1522, on the fourth side 1510. The manifold 204 may define a groove 1528 (e.g., race, indent, etc.) around the outlet 1524, on the fourth side 1510.

O-rings may be disposed within groove 1526 and/or the groove 1528, respectively, to seal the manifold 204 and the reservoir 306 to prevent leakage of the fluid. A port 1530 may be located along the fourth side 1510 to receive the second temperature sensor 908.

The manifold 204 may be formed from metal, plastics, composites, ceramics, etc. Suitable manufacturing techniques, depending upon the material, include casting, machining, injection molding, etc.

Figure 16A:
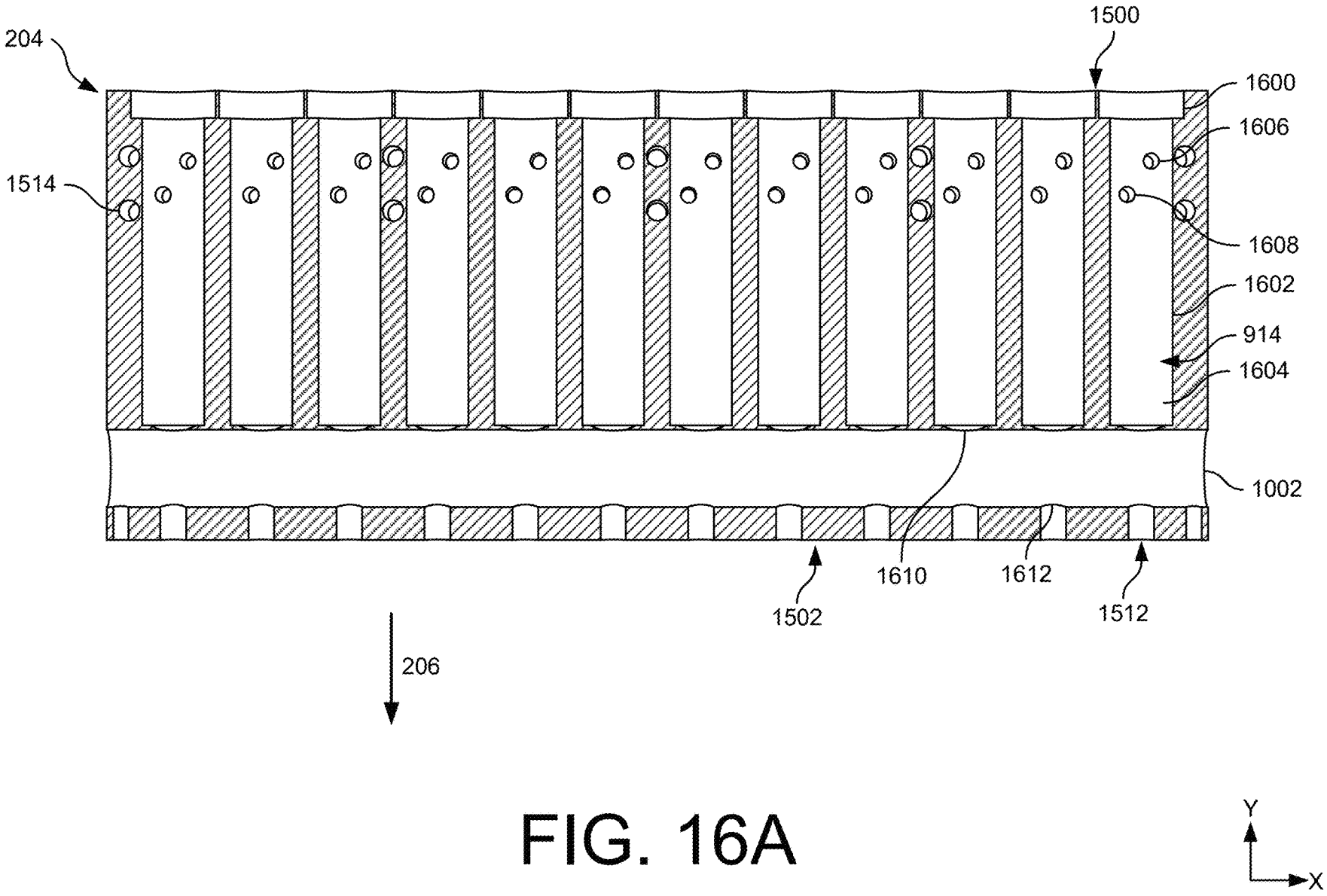
FIG. 16A illustrates a first cross-sectional view of the manifold of FIG. 15A, taken along line G-G of FIG. 15D, according to examples of the present disclosure.

FIGS. 16A-16C illustrate cross-sectional views of the manifold 204, according to examples of the present disclosure. FIG. 16A illustrates a first cross-sectional view of the manifold 204, taken along line G-G of FIG. 15D, FIG. 16B illustrates a second cross-sectional view of the manifold 204, taken along line H-H of FIG. 15C, and FIG. 16C illustrates a third cross-sectional view of the manifold 204, taken along line I-I of FIG. 15C.

The manifold 204 defines the chambers 914 in which the plungers 400 are disposed. In some instances, the chambers 914 include a first portion 1600 having a first cross-sectional dimension and a second portion 1602 having a second cross-sectional dimension. The second cross-sectional dimension may be less than the first cross-sectional dimension. The second portion 1602 may include a length (e.g., in the Y-direction) that is greater than a length (e.g., in the Y-direction) of the first portion 1600. A seal, gasket, etc., may be disposed in the first portion 1600. The plungers 400 are configured to be disposed through the seal disposed in the first portion 1600, and may engage an interior surface 1604 of the second portion 1602. For example, rings, o-rings, etc., may engage the interior surface 1604.

The channels 1104 and the channels 1520 are fluidly connected to the chambers 914, respectively. The channels 1104 and the channels 1520 may be fluidly connected to the second portion 1602 of the chambers 914, respectively. As introduced above, the channels 1104 may include the inlet 1522 and an outlet 1606. The channels 1520 include the outlet 1524 and an inlet 1608. The outlet 1606 may be located closer to the top 1500 than the inlet 1608.

The chambers 914 are fluidly connected to the passage 1002. The chambers 914 may include an outlet 1610 that is fluidly connected to the passage 1002. When the sleeve 916 and the shaft 918 are coupled to the manifold 204, or disposed in the passage 1002, the sleeve 916 and the shaft 918 may route the fluid to the needles 202. For example, the outlets 1610 may fluidly connect to the first orifices 1004 in the sleeve 916. The first orifices 1004 may route the fluid to the channels 1008 in the shaft 918. The channels 1008 in the shaft 918 may route the fluid through the second orifices 1006 and through an inlet 1612 fluidly connected to the receptacles 1512. Introduced above, the needles 202 may be threaded into the receptacles 1512. The first orifices 1004, the channels 1008, and the second orifices 1006 may route fluid from the chambers 914 to the receptacles 1512 (or the needles 202) when the shaft 918 is in the first position. However, the shaft 918 may be rotatable within the sleeve 916, for example, to prevent the flow of fluid from the chambers 914 to the receptacles 1512 (or the needles 202). In some instances, the sleeve 916 may be rotatable with the shaft 918, or the shaft 918 may be rotatable within the sleeve 916.

The plungers 400 may move between a retracted state and an extended state within the chambers 914, or within the second portion 1602. In the retracted state, the plungers 400 may be disposed adjacent to the top 1500, within the chambers 914. In the retracted state, the plungers 400 (or an end of the plungers 400) may be disposed vertically above the outlet 1606. The chambers 914 may be filled until the fluid is disposed above the inlet 1608 of the channels 1520. In some instances, the setting(s) 112 may be used to control the actuator(s) 312 to control the amount of fluid dispensed into the chambers 914, and/or when to actuate the actuator(s) 312. After the chambers 914 are filled, the plungers 400 may be actuated in the direction 206 towards their extended state, or towards the outlet 1610. As the plungers 400 move in the direction 206, any air in the chambers 914 is purged out the channels 1520.

The chambers 914 may be designed with a predetermined amount of volume. For example, the chambers 914 may have a volume that permits fluid to be dispensed into six paper cones. In the event that the tray 102 includes six rows, each of the chambers 914 may be filled with enough fluid to dispense the fluid into one paper cone in the first row, one paper cone in the second row, and so on. Accordingly, the chambers 914 may be filled with an adequate amount of fluid for six paper cones. After the fluid has been dispensed into the paper cones across the six rows, and the tray 102 is replaced, the plungers 400 may move to their retracted position and the piston 308 may be actuated to dispense the fluid into the chambers 914. The actuator(s) 312 may control the piston 308 to dispense a sufficient amount of the fluid into the chambers 914.

The manifold 204 further defines the apertures 1514 through which the fasteners are disposed for coupling the manifold 204 to the reservoir 306.

Figure 17C:
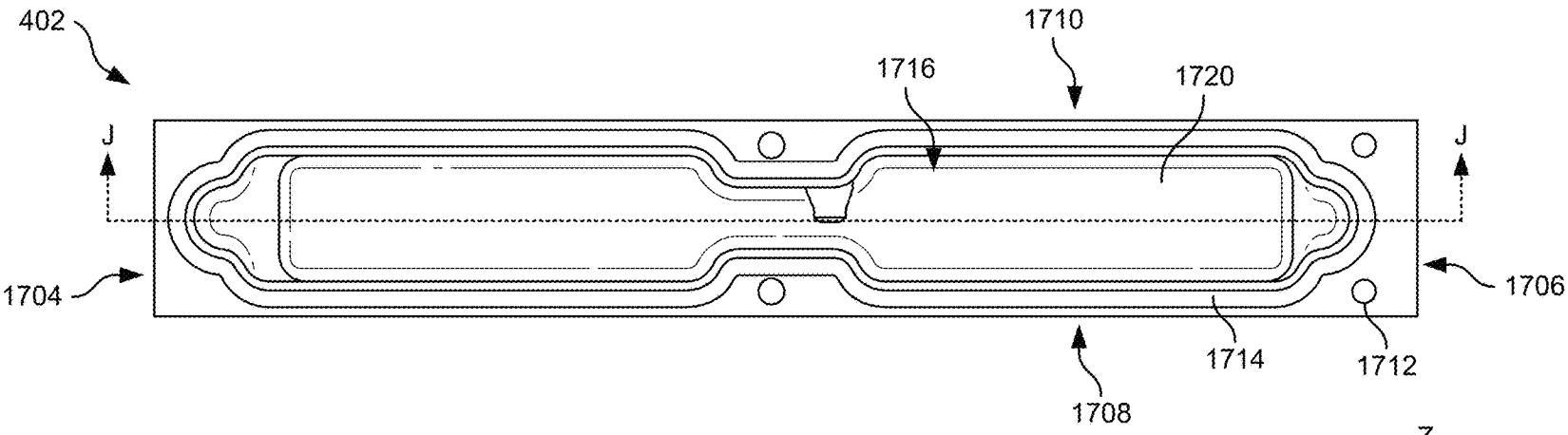
FIG. 17C illustrates a top view of the catch of FIG. 17A, according to examples of the present disclosure.
Figure 17D:
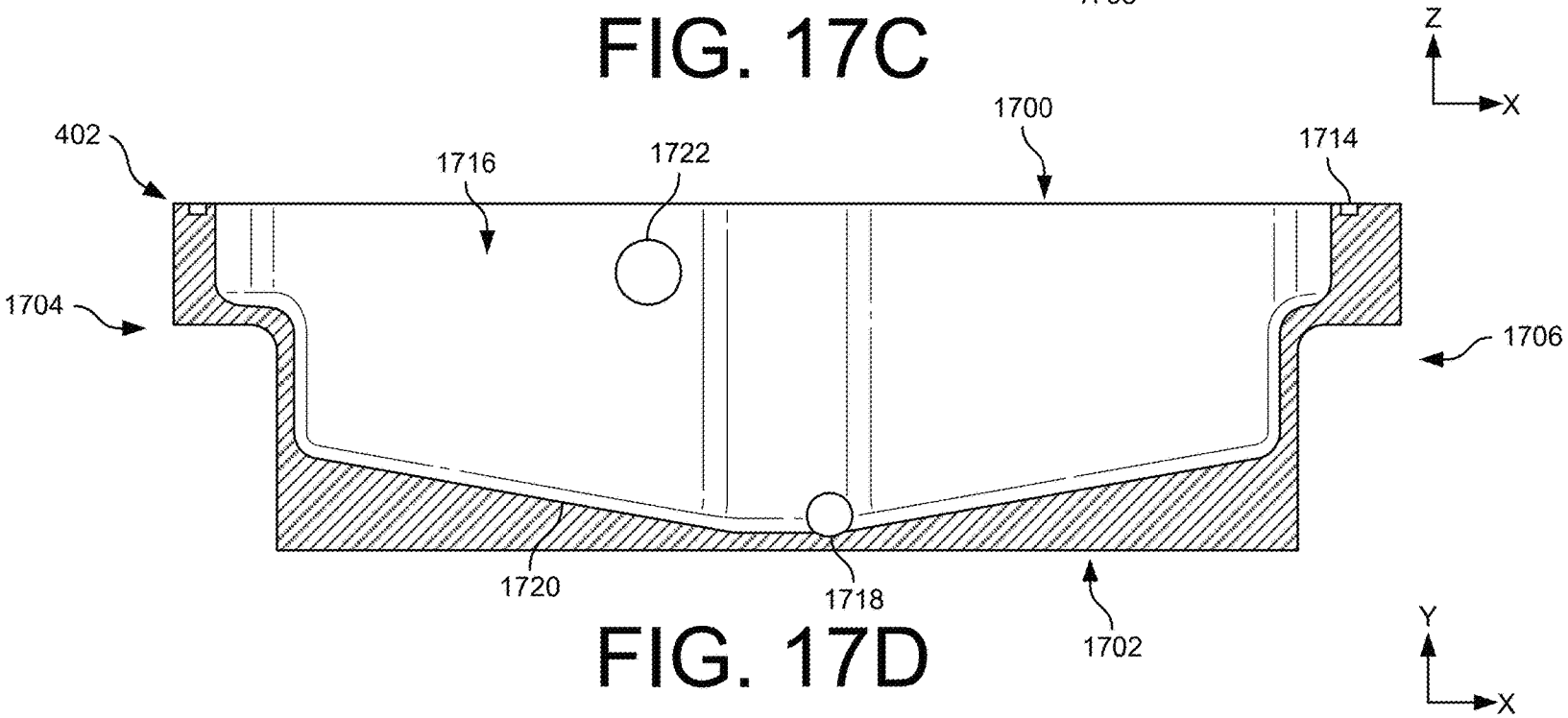
FIG. 17D illustrates a cross-sectional view of the catch of FIG. 17A, taken along line J-J of FIG. 17C, according to examples of the present disclosure.

FIGS. 17A-17D illustrate various views of the catch 402, according to examples of the present disclosure. FIG. 17A illustrates an isometric view of the catch 402, FIG. 17B illustrates a side view of the catch 402, FIG. 17C illustrates a top view of the catch 402, and FIG. 17D illustrates a cross-sectional view of the catch 402, taken along line J-J of FIG. 17C.

The catch 402 may include a top 1700, a bottom 1702 spaced apart from the top 1700 (e.g., in the Y-direction), a first side 1704 (e.g., left-hand side), a second side 1706 (e.g., right-hand side) spaced apart from the first side 1704 (e.g., in the X-direction), a third side 1708 (e.g., front), and a fourth side 1710 (e.g., back) spaced apart from the third side 1708 (e.g., in the Z-direction). The top 1700 may couple to the bottom 1202 of the reservoir 306. For example, fasteners may be disposed through apertures 1712 in the catch 402 and into the apertures 1232 on the bottom 1202 of the reservoir 306. In some instances, the catch 402 may define a groove 1714 in which a seal, gasket, etc., is disposed for sealing the catch 402 against the reservoir 306.

The catch 402 may define a cavity 1716 that collects excess fluid, for example, routed from the channels 1520 and the channels 1222. When coupled to the reservoir 306, the trough 1228 may be disposed adjacent to the cavity 1716 such that fluid within that exits the channels 1222 (via the outlets 1226), drains into the cavity 1716. The groove 1714 may be disposed in the top 1700 and may encircle, surround, or be disposed around the cavity 1716.

The catch 402 may define a port 1718 that receives the second fitting 902. The port 1718 may be disposed along the fourth side 1710. For example, any fluid that collects in the catch 402 may be recycled via one of the pump(s) fluidly connected to the port 1718. In some instances, the fluid may be recycled back into the cavity 1100 of the reservoir 306, containers, etc. As shown in FIG. 17D, a bottom surface 1720 of the cavity 1100 may be slopped to funnel the fluid to the port 1718. In some instances, the catch 402 may include an opening 1722 disposed along the fourth side 1710. A sensor may be disposed in the opening 1722 and may sense a fill volume, amount, etc., of the fluid within the catch 402 (or the cavity 1716). Based on the fill volume, the pump(s) 122 fluidly connected to the port 1718 may be activated to recycle the fluid. As shown, the port 1718 may be disposed closer to the bottom 1702 than the opening 1722. Although a particular shape of the cavity 1716 is shown, other shapes are envisioned.

The catch 402 may be formed from metal, plastics, composites, ceramics, etc. Suitable manufacturing techniques, depending upon the material, include casting, machining, injection molding, etc.

FIG. 18 illustrates an isometric view of one of the plungers 400, according to examples of the present disclosure. The plunger 400 includes the first end 910 and the second end 912 spaced apart from the first end 910 (e.g., in the Y-direction). A length of the plunger 400 extends between the first end 910 and the second end 912. The plunger 400 may also include an exterior surface 1800.

The plunger 400 is configured to be at least partially disposed within the chamber 914. For example, the first end 910 may be disposed external to the chamber 914 (e.g., coupled to the mount 504), while the second end 912 may be disposed within the chamber 914. The second end 912 may be configured to translate within the second portion 1602 of the chamber 914. For example, when the plunger 400 is actuated in the direction 206, the second end 912 may move in a direction towards the outlet 1610 (or the bottom end of the chambers 914). In the retracted state of the plungers 400, for example, when the chambers 914 are being filled with the fluid, the second end 912 may be disposed vertically above the outlet 1606 of the channels 1104.

The exterior surface 1800 defines a first groove 1802 that couples the plunger 400 to the mount 504. For example, the mount 504 may define ribs, spins, extrusions, etc., that engage within the first groove 1802. As the actuator(s) 314 actuate to act on the mount 504, motion is imparted into the plungers 400 given the coupling of the plungers 400 to the mount 504. The first groove 1802 may be disposed adjacent to the first end 910, and couple to the mount 504 at a location external to the chambers 914.

The exterior surface 1800 may also define one or more second grooves 1804 proximate to the second end 912. O-rings, seals, gaskets, etc., may be disposed within the second grooves 1804, respectively, to seal the plungers 400 against the interior surface 1604 of the chambers 914.

The plunger 400 may be formed from metal, plastics, composites, etc. Suitable manufacturing techniques, depending upon the material, include casting, machining, injection molding, etc.

FIGS. 19A and 19B illustrate various views of one of the needles 202, according to examples of the present disclosure. FIG. 19A illustrates a side view of the needle 202, and FIG. 19B illustrates a cross-sectional view of the needle 202 taken along line K-K of FIG. 19A.

The needle 202 includes the first end 700 and the second end 702 spaced apart from the first end 700 (e.g., in the Y-direction). The first end 700 may be coupled to the manifold 204. For example, the first end 700 may be threaded into the receptacles 1512 along the bottom 1502 of the manifold 204. The needle 202 includes the lumen 1000 that extends between the first end 700 and the second end 702. The second end 702 may be pointed, sharp, or come to a point to pierce through the agricultural material disposed in the paper cone.

In some instances, the needle 202 may include a base 1900 disposed proximate to the first end 700, and a shaft 1902 that extends from the base 1900 towards the second end 702. The base 1900 and the shaft 1902 may define the lumen 1000. The shaft 1902 may include a length that accommodates a depth, or size, of the paper cone. In doing so, the shaft 1902 is disposable within the paper cone without the base 1900, for example, contacting the paper cone or the tray 102.

The needle 202 may be formed from metal, plastics, composites, etc. Suitable manufacturing techniques, depending upon the material, include casting, machining, injection molding, etc.

Figure 20A:
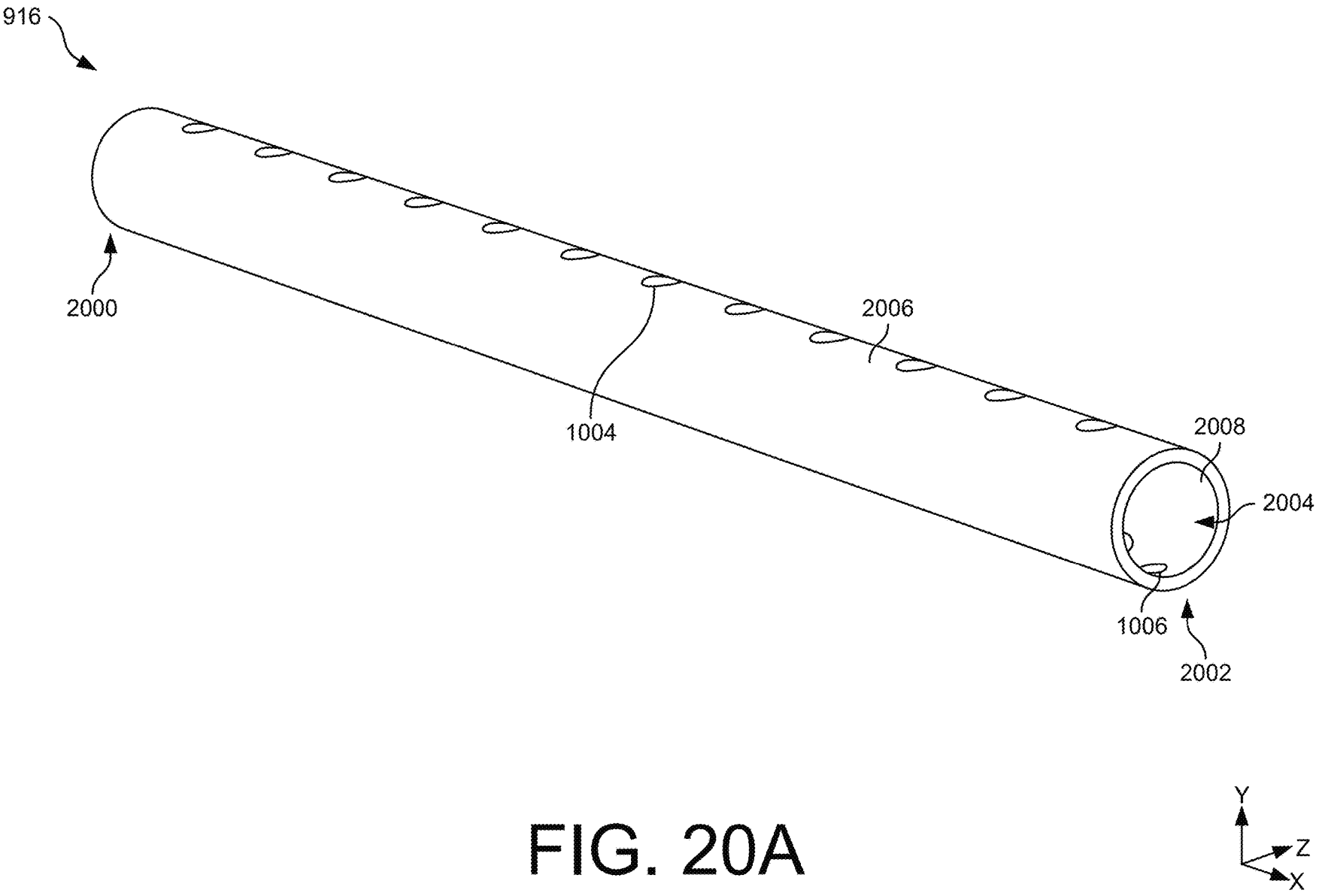
FIG. 20A illustrates an isometric view of an example sleeve of the dispensing assembly of FIG. 6, according to examples of the present disclosure.
Figure 20B:
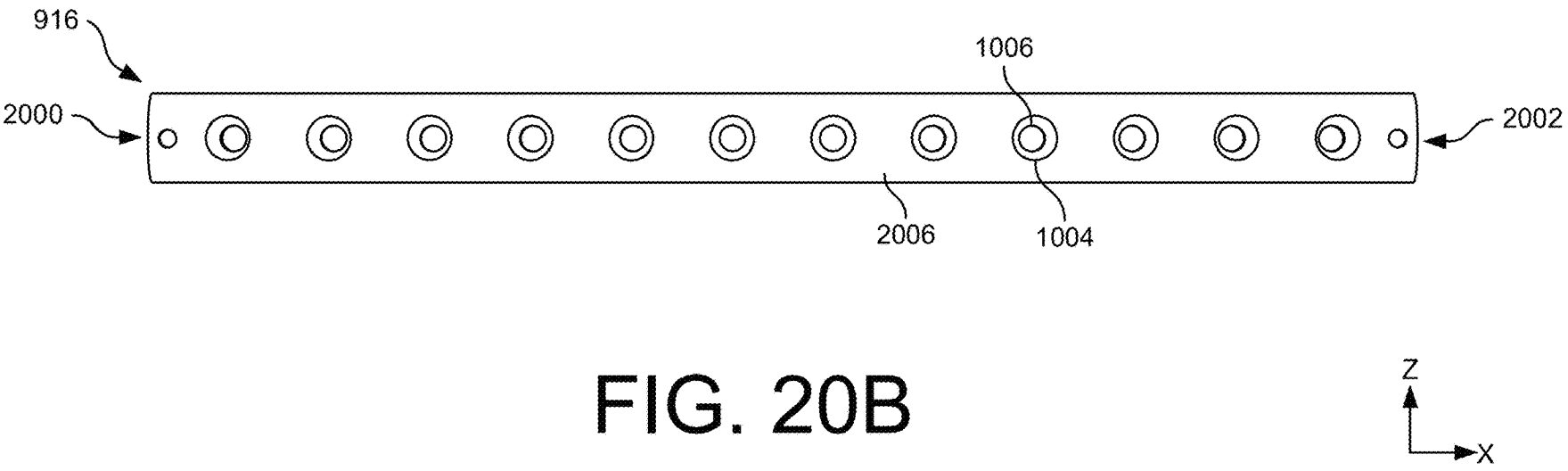
FIG. 20B illustrates a first side view of the sleeve of FIG. 20A, according to examples of the present disclosure.
Figure 20C:
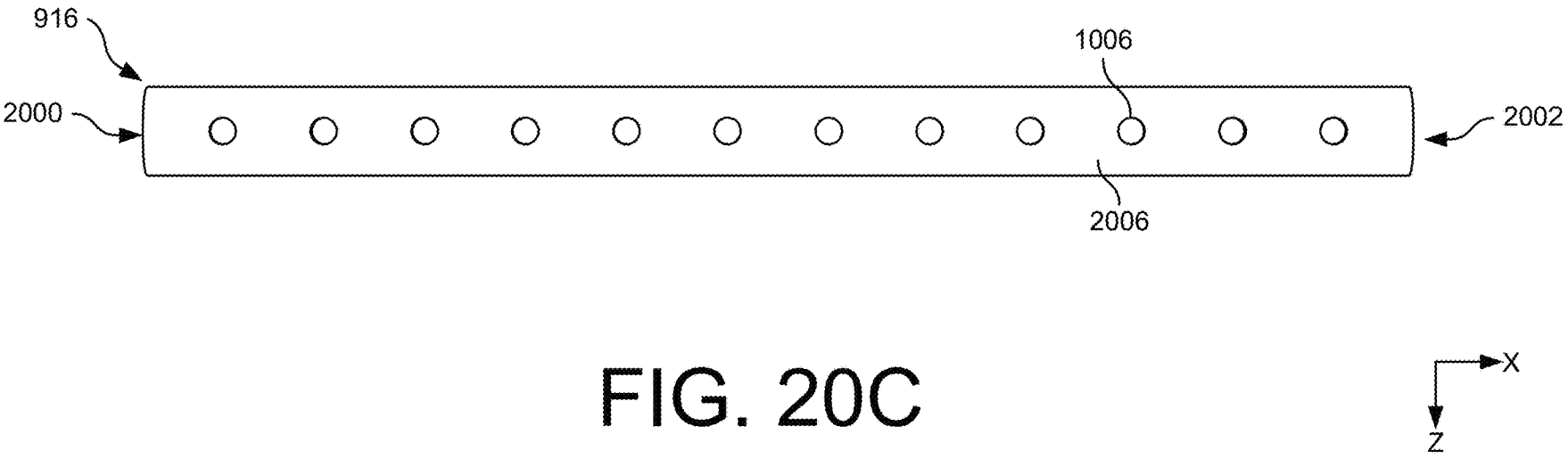
FIG. 20C illustrates a second side view of the sleeve of FIG. 20A, according to examples of the present disclosure.

FIGS. 20A-20C illustrates various views of the sleeve 916, according to examples of the present disclosure. FIG. 20A illustrates an isometric view of the sleeve 916, FIG. 20B illustrates a first side view of the sleeve 916, and FIG. 20C illustrates a second side view of the sleeve 916.

The sleeve 916 may include a first end 2000 and a second end 2002 spaced apart from the first end 2000 (e.g., in the X-direction). A channel 2004 may be disposed between the first end 2000 and the second end 2002. The channel 2004 may be sized to receive the shaft 918. The sleeve 916 also includes an exterior surface 2006 and an interior surface 2008, where the interior surface 2008 may define the channel 2004. The first orifices 1004 and the second orifices 1006 may be disposed through a thickness of the sleeve 916, between the exterior surface 2006 and the interior surface 2008. The first orifices 1004 may be disposed adjacent to the outlets 1610, while the second orifices 1006 may be disposed adjacent to the inlets 1612. In some instances, the first orifices 1004 may include a greater cross-sectional dimension as compared to the second orifices 1006.

The sleeve 916 may be formed from metal, plastics, composites, etc. Suitable manufacturing techniques, depending upon the material, include casting, machining, injection molding, etc.

Figure 21A:
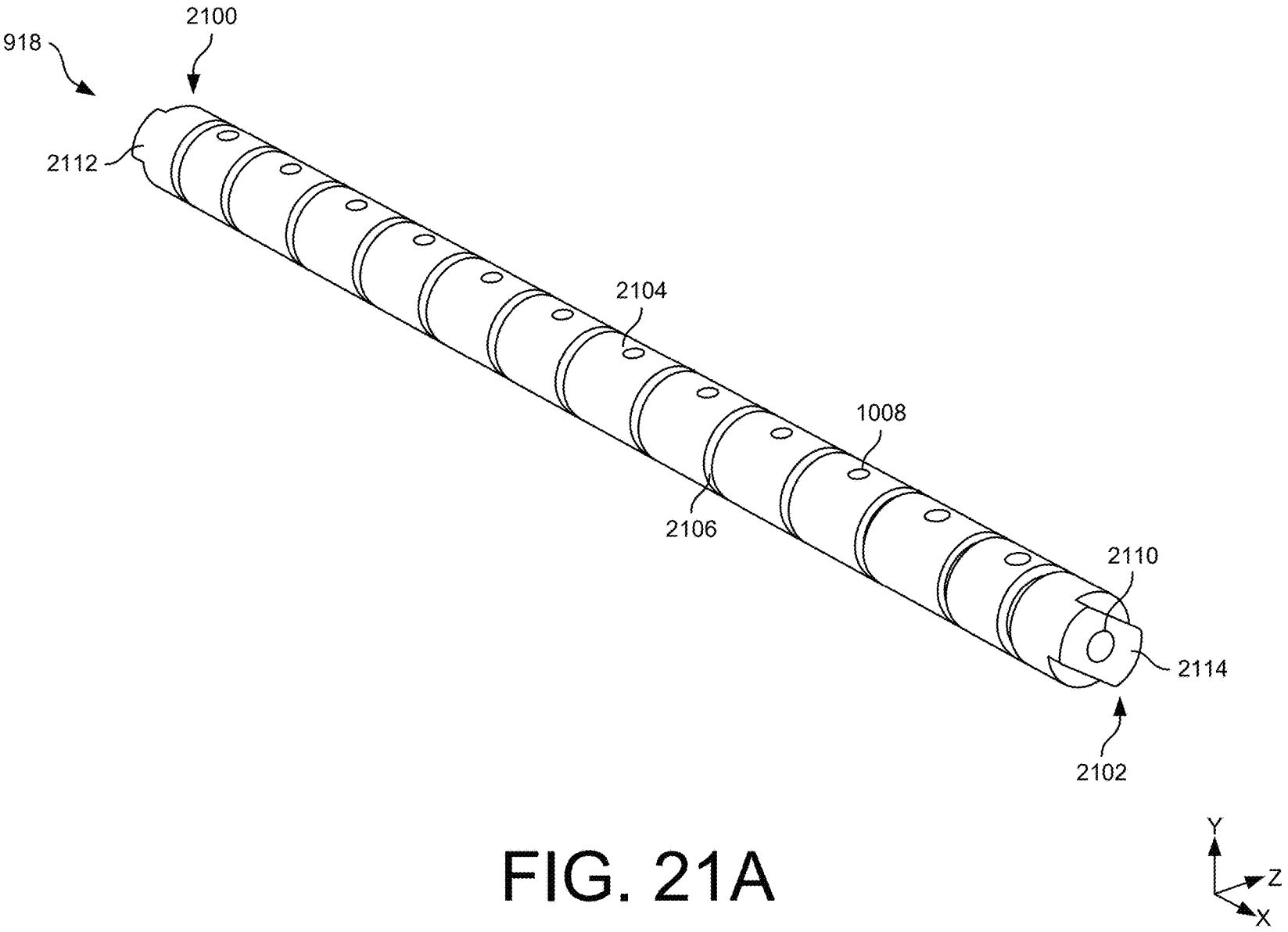
FIG. 21A illustrates an isometric view of an example shaft of the dispensing assembly of FIG. 6, according to examples of the present disclosure.
Figure 21B:
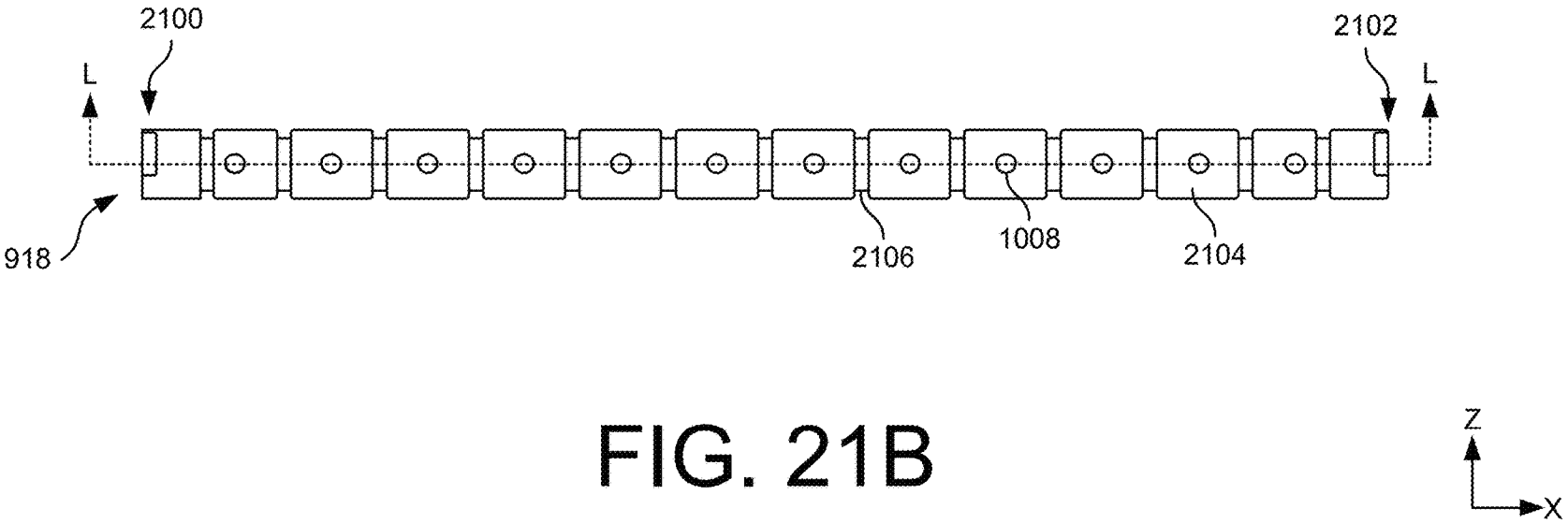
FIG. 21B illustrates a side view of the shaft of FIG. 21A, according to examples of the present disclosure.
Figure 21C:
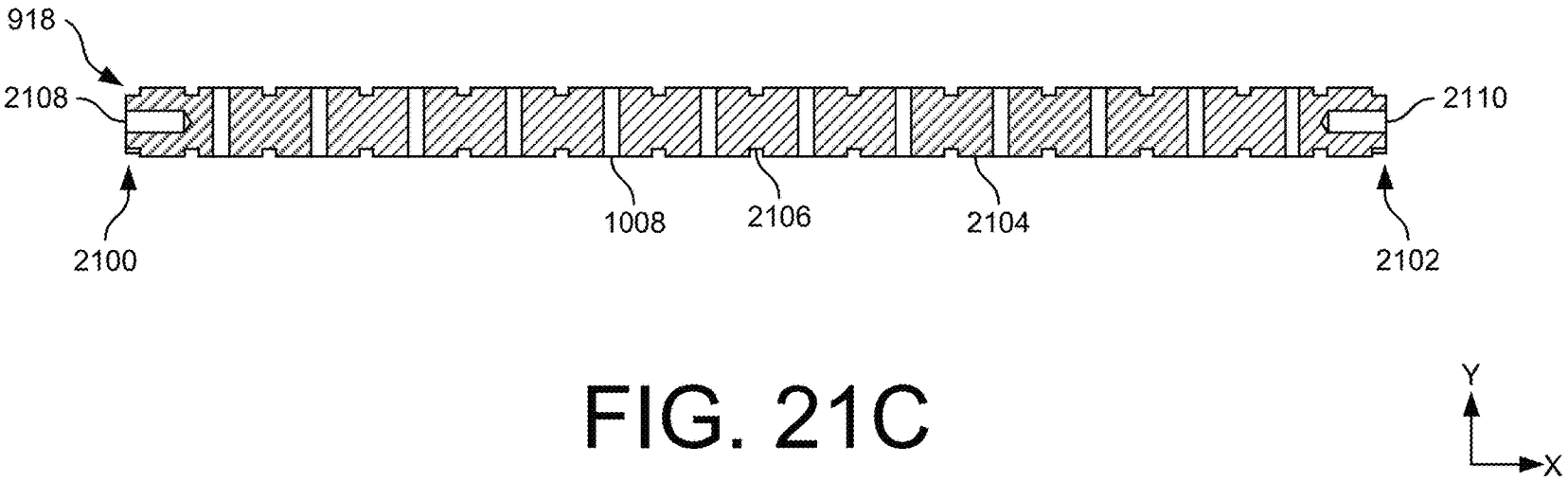
FIG. 21C illustrates a cross-sectional view of the shaft of FIG. 21A, taken along line L-L of FIG. 21B, according to examples of the present disclosure.

FIGS. 21A-21C illustrate various views of the shaft 918, according to examples of the present disclosure. FIG. 21A illustrates an isometric view of the shaft 918, FIG. 21B illustrates a side view of the shaft 918, and FIG. 21C illustrates a cross-sectional view of the shaft 918, taken along line L-L of FIG. 21B.

The shaft 918 is sized to be disposable within the channel 2004 of the sleeve 916. For example, the shaft 918 may nest within the channel 2004. The shaft 918 may include a first end 2100 and a second end 2102 spaced apart from the first end 2100 (e.g., in the X-direction). The shaft 918 also includes an exterior surface 2104. The exterior surface 2104 may form grooves 2106, for example, to receive the o-rings 1010. The o-rings 1010, for example, may engage with the interior surface 2008 of the sleeve 916. As shown, the grooves 2106 may be disposed circumferentially around the exterior surface 2104 (e.g., about the X-axis).

The shaft 918 forms the channels 1008 that are disposed between sides of the shaft 918, or through the exterior surface 2104. The o-rings 1010 may seal adjacent channels 1008 to prevent the fluid from leaking between adjacent channels 1008. For example, each of the channels 1008 may be sealed by two of the o-rings 1010, one of one side of the channels 1008 and another on the other side of the channels 1008 (e.g., spaced apart in the X-direction). In doing so, the fluid from the chambers 914 may be routed to the needles 202, respectively. As shown, the shaft 918 may define twelve of the channels 1008.

The shaft 918 is configured to be rotated via the actuator(s) 510. The actuator(s) 510 may couple to the shaft 918 and the first end 2100 and/or the second end 2102. For example, an aperture 2108 may be disposed at the first end 2100 and an aperture 2110 may be disposed at the second end 2102. The fasteners 604 may be threaded into the aperture 2108 to couple the actuator(s) 510, or plates, arms, etc., of the actuator(s) 510 to the first end 2100 and the second end 2102. In some instances, the first end 2100 includes a rib 2112 and/or the second end 2102 includes a rib 2114. The rib 2112 and the rib 2114 may engage with corresponding features of the actuator(s) 510 (or plates, arms, etc., of the actuator(s) 106) to impart motion to the shaft 918 without slippage, for example.

Figure 22:
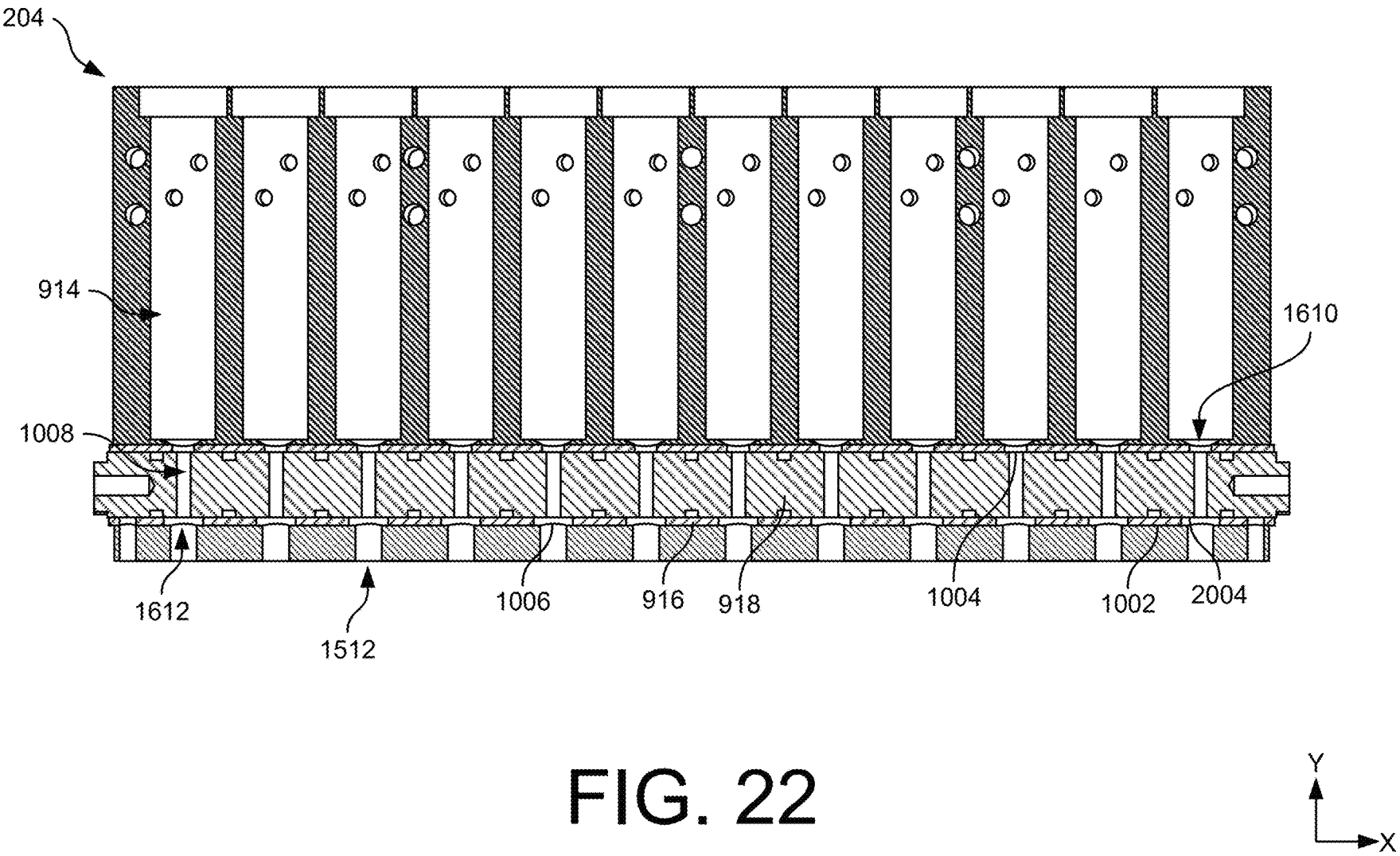
FIG. 22 illustrates a cross-sectional view, showing an example engagement between the manifold of FIG. 15A, the sleeve of FIG. 20A, and the shaft of FIG. 21A, according to examples of the present disclosure.

FIG. 22 illustrates a cross-sectional view showing an engagement between the manifold 204, the sleeve 916, and the shaft 918, according to examples of the present disclosure. As indicated above, the sleeve 916 may be disposed within the passage 1002 of the manifold 204. The shaft 918, meanwhile, may be disposed within the channel 2004 of the sleeve 916.

In FIG. 22, the receptacles 1512 are shown fluidly connected to the chambers 914, respectively. For example, the shaft 918 may be in the first position in which the channels 1008 align the first orifices 1004, the second orifices 1006, the outlet 1610, and the inlet 1612. Here, the fluid may flow from the chambers 914 to the needles 202. Comparatively, the shaft 918 may be rotated to the second position. In the second position, the channels 1008 may not align with the first orifices 1004, the second orifices 1006, the outlet 1610, and the inlet 1612. Accordingly, fluid may be restricted from being supplied to the needles 202.

Figure 23C:
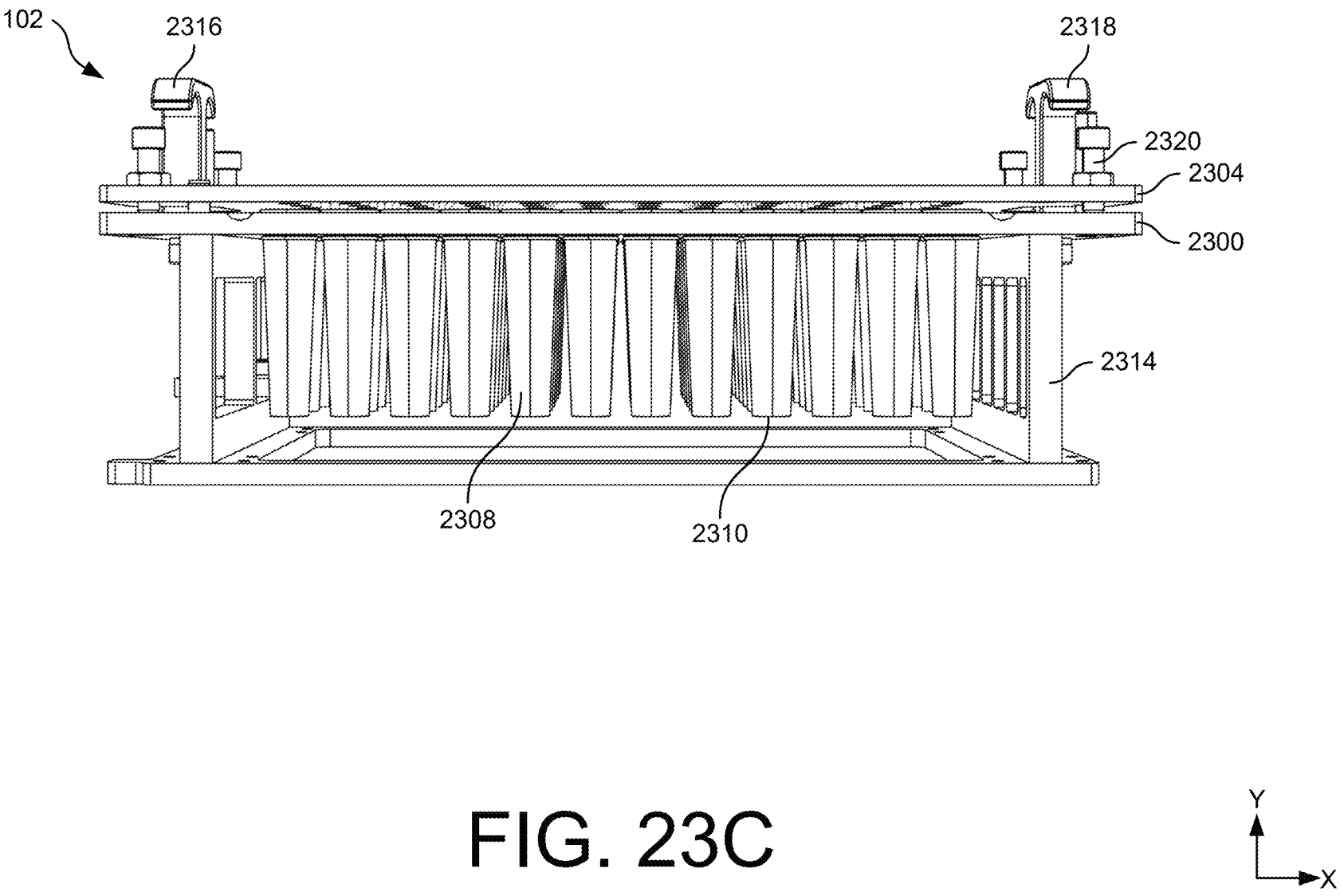
FIG. 23C illustrates a side view of the tray of FIG. 23A, according to examples of the present disclosure.
Figure 23D:
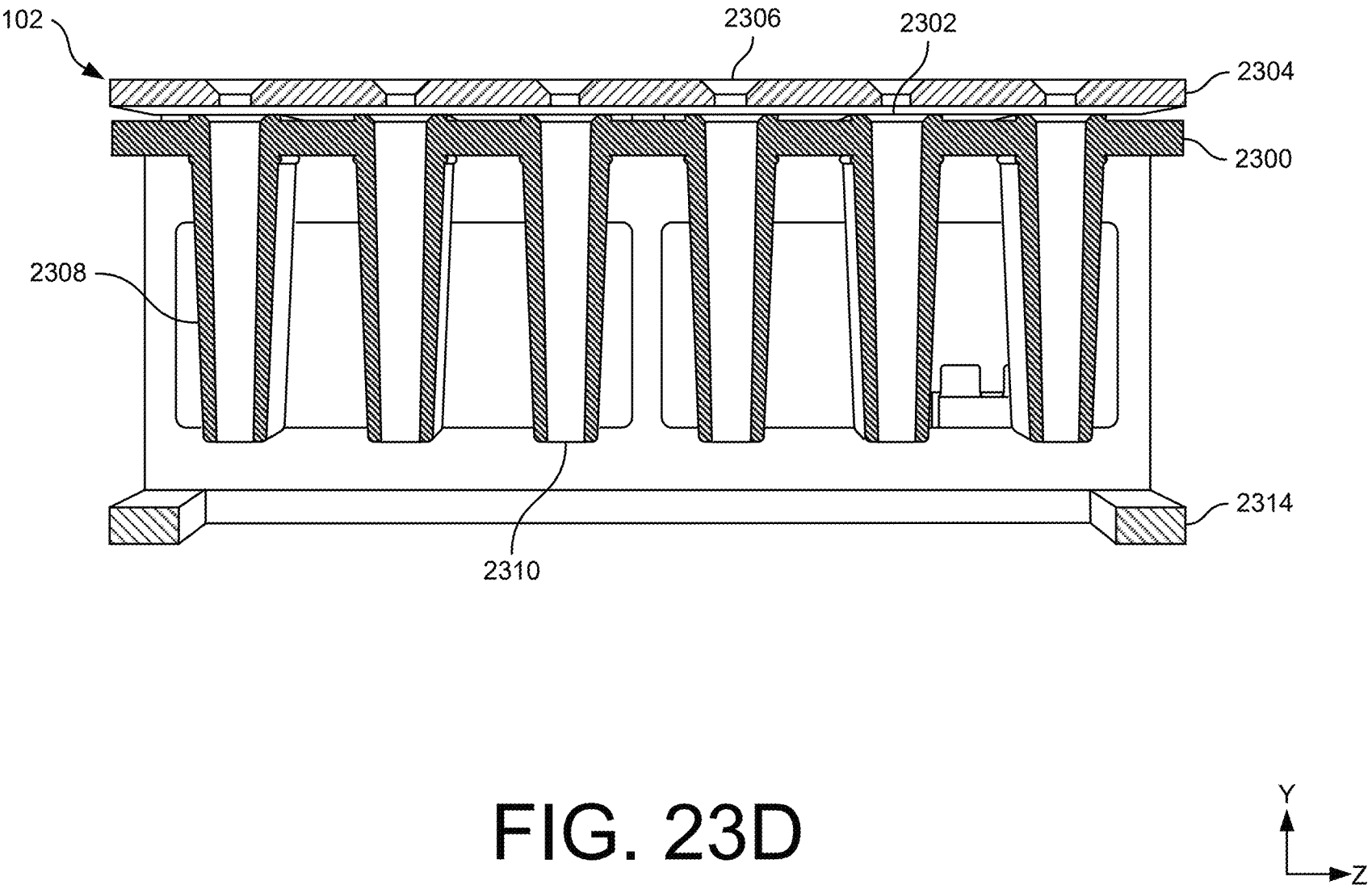
FIG. 23D illustrates a cross-sectional view of the tray of FIG. 23A, taken along line M-M of FIG. 23B, according to examples of the present disclosure.

FIGS. 23A-23D illustrate various views of the tray 102, according to examples of the present disclosure. FIG. 23A illustrates an isometric view of the tray 102, FIG. 23B illustrates a top view of the tray 102, FIG. 23C illustrates a side view of the tray 102, and FIG. 23D illustrates a cross-sectional view of the tray 102, taken along line M-M of FIG. 23B.

In some instances, the tray 102 includes a first plate 2300 having openings 2302 and a second plate 2304 having openings 2306. The needles 202 may be insertable through the openings 2302 and the openings 2306. The tray 102 includes sleeves 2308 coupled to, or disposed on, the second plate 2304. The paper cones may be disposed within the sleeves 2308. For example, the paper cones may be disposed through the openings 2306 and into the sleeves 2308. Once inserted into the sleeves 2308, the paper cones may be disposed completely or at least partially within the sleeves 2308. In some instances, after the paper cones are inserted into the sleeves 2308, the second plate 2304 may be disposed over (e.g., on top of) the first plate 2300. The sleeves 2308 may be conically shaped to retain the paper cones within the tray 102.

The paper cones may include a top and a bottom spaced apart from the top (e.g., in the Y-direction). When inserted into the sleeves 2308, the top of the paper cones may be disposed above the first plate 2300 (or the openings 2302), and the bottom of the paper cones may be disposed through an end 2310 of the sleeves 2308. Moreover, once the paper cones are disposed in the sleeves 2308, the second plate 2304 may be disposed on top of the first plate 2300, thereby interposing the top of the paper cones between the first plate 2300 and the second plate 2304.

The openings 2302, the openings 2306, and/or the sleeves 2308 may be arranged in rows 2312. For example, the openings 2302, the openings 2306, and/or the sleeves 2308 may be arranged in six of the rows 2312, where each of the rows 2312 has twelve of the openings 2302, the openings 2306, and/or the sleeves 2308. When the fluid is dispensed into the agricultural material, the twelve of the needles 202 are disposed in the corresponding openings 2302, the openings 2306, and/or the sleeves 2308.

Initially, the tray 102 may be moved into position such that a first row of the paper cones in the tray 102 are disposed adjacent to the needles 202 (e.g., the second ends 702 of the needles 202). With the paper cones in place, the second end 702 of the needles 202 may be moved into the agricultural material. Therein, the fluid may be dispensed. Once the paper cones within the first row are filled with the fluid, the needles 202 may retract. With the first row of the paper cones filled, the tray 102 may move along the tracks 302 and into position such that a second row of the paper cones are disposed adjacent to the needles 202 (e.g., the second end 702 of the needles 202). The process of dispensing the fluid into the paper cones may repeat and after filling the paper cones in the second row, the tray 102 may move along the tracks 302 and into position such that a third row of the paper cones are disposed adjacent to the needles 202.

The tray 102 may include a base 2314 that couples to slides disposed along the tracks 302. The tray 102 may be slidable along the tracks 302 to dispose the paper cones adjacent to the needles 202 such that the needles 202 may be disposed into the paper cones. The tray 102 may also include a first handle 2316 and a second handle 2318. In some instances, the second plate 2304 may include one or more passages (e.g., channels) disposed along sides/edges of the second plate 2304. The passages may receive posts 2320 that extend from the first plate 2300 for aligning the first plate 2300 and the second plate 2304. In doing so, the openings 2302 in the first plate 2300 may align with the openings 2306 of the second plate 2304 such that the needles 202 are insertable into the agricultural material in the paper cones.

Figure 24:
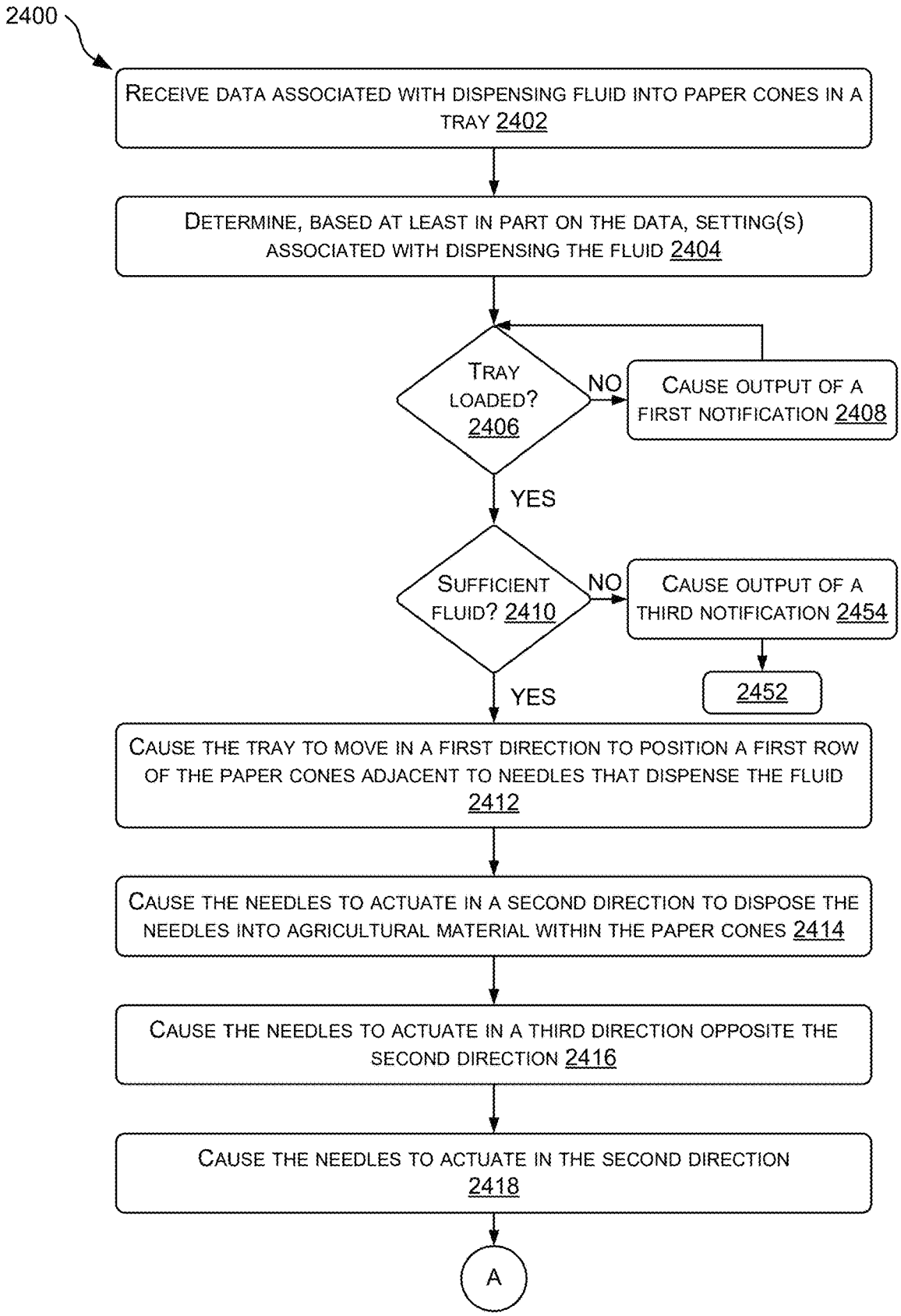
FIG. 24-26 illustrate an example process performed at least in part by the injection device of FIG. 1, according to examples of the present disclosure.
Figure 25:
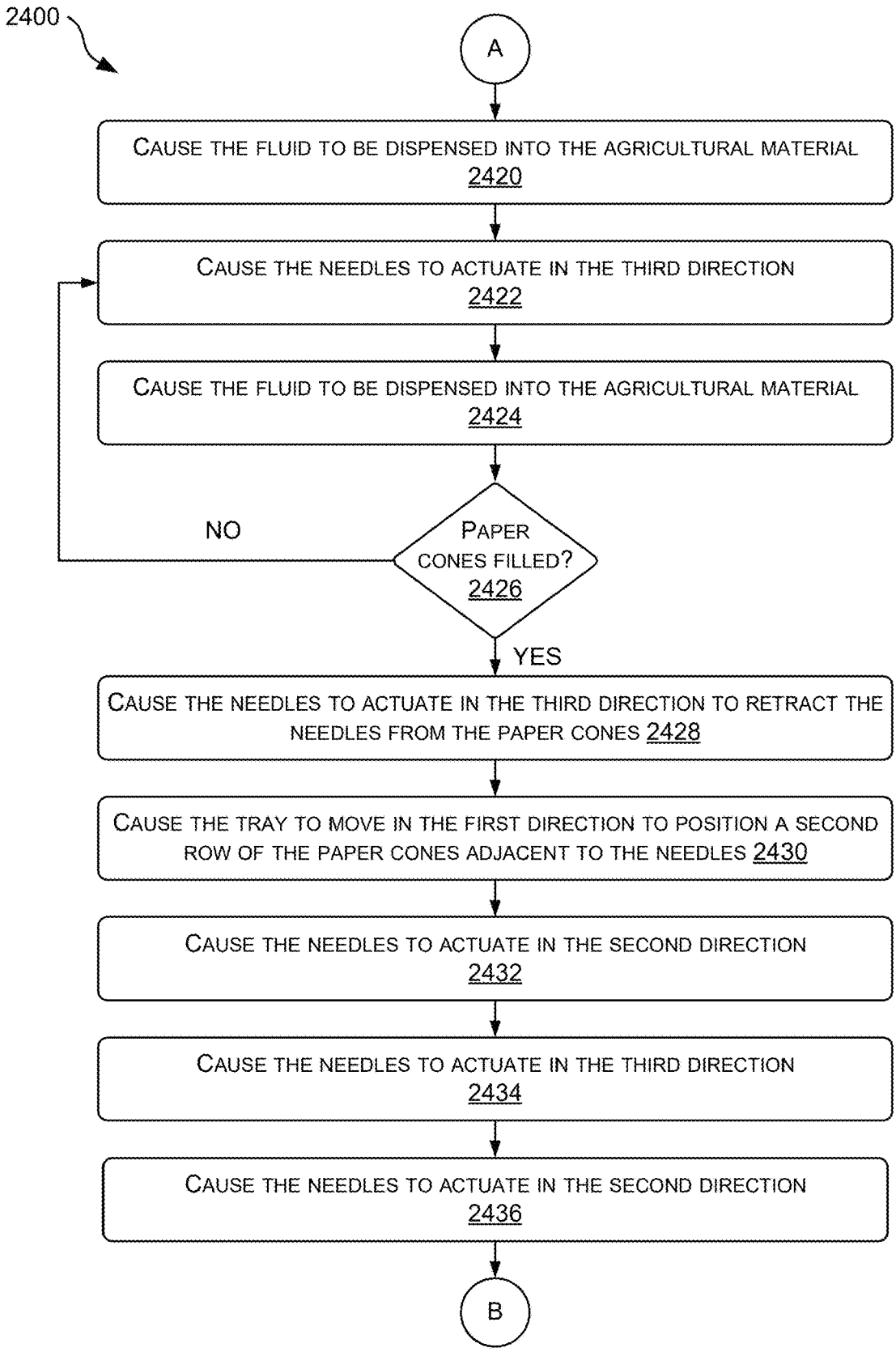
Figure 26:
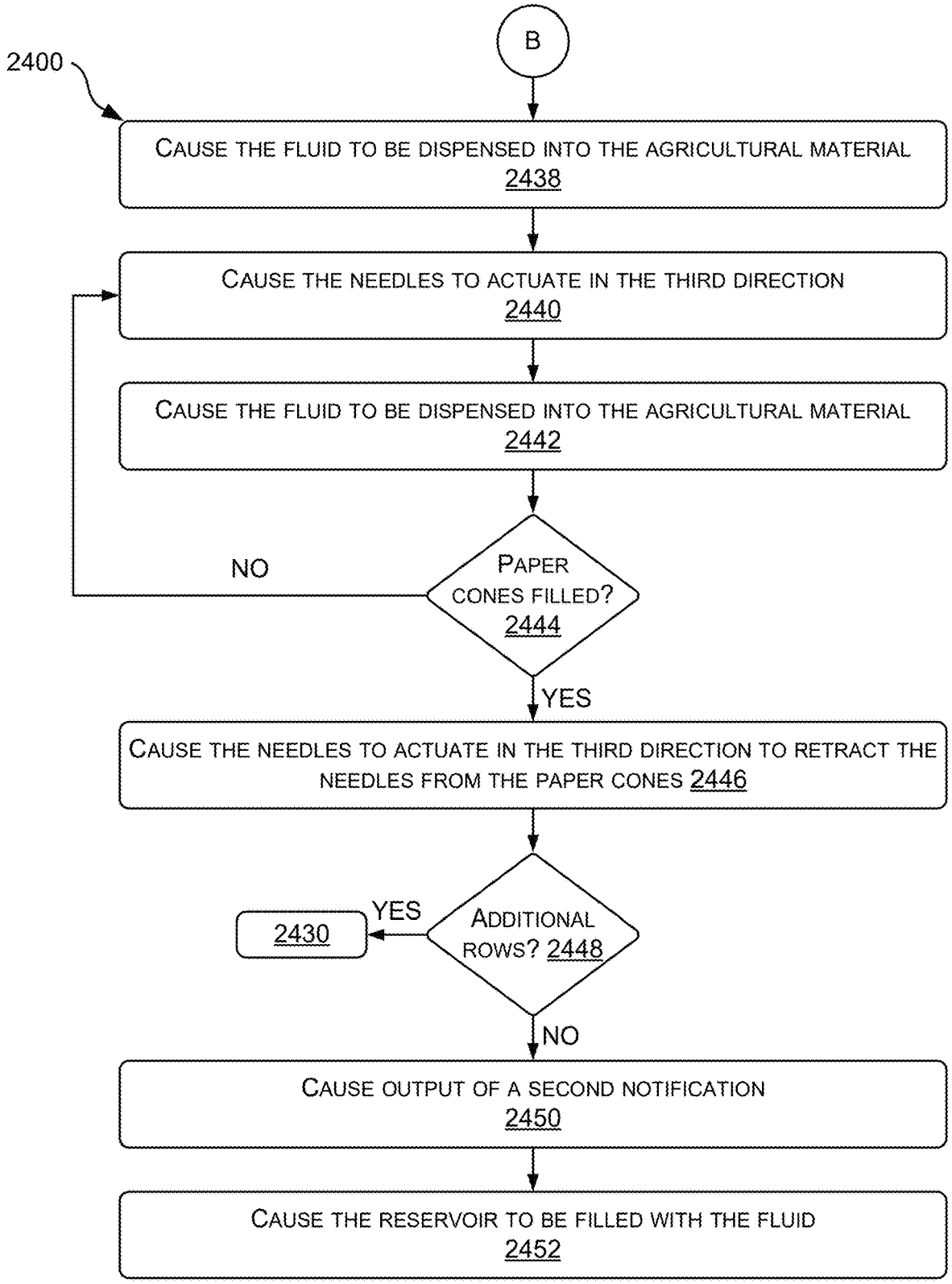

FIGS. 24-26 illustrates an example process 2400 associated with dispensing liquid into paper cones, according to examples of the present disclosure. The process 2400 described herein are illustrated as collections of blocks in logical flow diagrams, which represent a sequence of operations, some or all of which may be implemented in hardware, software, or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process 2400, or alternative processes, and not all of the blocks need to be executed. For discussion purposes, the process 2400 are described with reference to the environments, devices, architectures, diagrams, and systems described in the examples herein, such as those described with respect to FIGS. 1-23D, although the process 2400 may be implemented in a wide variety of other environments, architectures, and systems.

At 2402, the process 2400 may include receiving data associated with dispensing fluid into paper cones in a tray. For example, in some instances, a user operating the injection device 100 may utilize the display 114 to control or otherwise operate the injection device 100. In some instances, the user may control the injection device 100 via one or more device(s) communicatively coupled to the injection device 100 (e.g., mobile phone). In some instances, the data may be associated with powering on the injection device 100, configuring the injection device 100 to dispense fluid into the paper cones, etc.

At 2404, the process 2400 may include determining, based at least in part on the data, setting(s) associated with dispensing the fluid. For example, based at least in part on the data received at 2402, the process 2400 may determine the setting(s) 112. In some instances, the setting(s) 112 may be associated with an amount of fluid to dispense into the paper cones, a number of paper cones in the tray 102 (e.g., per row, the amount of rows, etc.), a spacing between the paper cones in the tray 102, a type of the fluid, a distance over which to dispense the fluid into the paper cones, a size of the paper cones, a temperature by which to heat the fluid, etc. The process 2400 may be configured to dispense the fluid and/or control dispensing of the fluid into the paper cones based at least in part on the setting(s) 112.

At 2406, the process 2400 may include determining whether the tray is loaded in the injection device 100. For example, the sensor(s) 118 may generate sensor data 120 associated with whether the tray 102 is disposed within the injection device 100. The injection device 100 may refrain, or be restricted from operating, when the tray 102 is absent. In some instance, the sensor(s) 118 may include contact sensor(s), proximity sensor(s), etc., to determine the presence of the tray 102 in the injection device 100. If at 2406 the process determines that the tray 102 is not loaded (e.g., the tray 102 is absent), the process 2400 may follow "NO" route and proceed to 2408.

At 2408, the process 2400 may include causing output of a first notification. For example, the display 114 may output an error message, warning, etc. Alternatively, other I/O components of the injection device 100, such as lighting elements, speakers, etc., may output the first notification. The first notification may serve to inform the user to load the tray 102 in the injection device 100. From 2408, the process 2400 may continue to 2406 to determine whether the tray 102 has been loaded. If at 2406 the process 2400 determines that the tray 102 is loaded, the process 2400 may follow the "YES" route and proceed to 2410.

At 2410, the process 2400 may include determining a reservoir has sufficient fluid. In some instances, the sensor(s) 118 may be used to determine an amount of fluid within the reservoir 306, an amount of fluid previously dispensed, etc. In some instances, the sensor(s) 118 may be used to determine a position of the piston 308 within the reservoir 306, or the cavity 1100, to determine the amount of fluid in the reservoir 306. For example, the amount of fluid in the reservoir 306 may be used to determine whether there is a sufficient amount of fluid to fill the paper cones in the tray 102. In some instances, whether the reservoir 306 has a sufficient amount of fluid may be based on the setting(s) 112. For example, if the setting(s) 112 indicate to dispense a total of 1.5 mL into each paper cones, the process 2400 may determine whether there is 108 mL in the reservoir 306 (e.g., 1.5 mL×12 chambers×6 rows of paper cones). If at 2410, the process 2400 determines that there is a sufficient amount of fluid, the process 2400 may follow the "YES" route and proceed to 2412.

At 2412, the process 2400 may include causing the tray to move in a first direction to position a first row of the paper cones adjacent to needles that dispense the fluid. For example, actuator(s) 106 may move the tray 102 in a direction 304 along the tracks 302. In some instances, the amount by which the actuator(s) 106 move the tray 102 may be based at least in part on the setting(s) 112. For example, the setting(s) 112 may indicate an amount of movement of the tray 102 in the direction 304 to dispose the first row of the paper cones adjacent (e.g., vertically below) to the needles 202. In some instances, the sensor(s) 118 may be used to determine, or place, the first row of the paper cones adjacent to the needles 202. For example, the sensor(s) 118 may be used to determine whether the first row of the paper cones are aligned with the needles 202. If the needles 202 and the paper cones are not aligned, the tray 102 may be actuated in the direction 304 or a reverse direction.

At 2414, the process 2400 may include causing the needles to actuate in a second direction to dispose the needles into agricultural material within the paper cones. For example, the actuator(s) 310 may acuate to move the needles 202 in the direction 206 into the agricultural material. In some instances, the amount of actuation by the actuator(s) 310 in the direction 206 may be based at least in part on the setting(s) 112. For example, the setting(s) 112 may indicate a size (e.g., depth) of the paper cones. The needles 202 may be actuated such that the second end 702 of the needles 202 are disposed within the agricultural material. In some instances, the second end 702 of the needles 202 may be disposed to a certain depth within the agricultural material. In some instances, the sensor(s) 118 may be used to determine an amount of actuation by the actuator(s) 310, a position of the needles 202 within the paper cones, etc.

In some instances, when the needles 202 are disposed into the paper cones, the shaft 918 may be in the second position to fluidly disconnect the chambers 914 and the needles 202. This may prevent leaking of the fluid. Moreover, in some instances, before moving the needles 202 into the paper cones, the plungers 400 may be moved to their retracted position. With the needles 202 in the retracted position, the chambers 914 may be filled with fluid via the piston 308 (e.g., through actuation of the actuator(s) 312). Once filled, the plungers 400 may be moved in the direction 206 to purge air out of the chambers 914.

At 2416, the process 2400 may include causing the needles to actuate in a third direction opposite the second direction. In some instances, the actuator(s) 310 may move the needles 202 in the direction 600, opposite the direction 206, to at least partially retract the needles 202 from the agricultural material. As will be explained herein, the movement of the needles 202 in the direction 600, and subsequently in the direction 206, may form a void in the agricultural material to accommodate the needle 202 and/or the fluid dispensed from the needle 202.

At 2418, the process 2400 may include causing the needles to actuate in the second direction. For example, after retracting the needles 202 in the direction 600, the actuator(s) 310 may move the needles 202 in the direction 206. In some instances, the actuator(s) 310 may cycle between actuation in the direction 206 and the direction 600. For example, as the needles 202 are inserted into the agricultural material, the needles 202 may move (e.g., oscillate) in and up and down fashion to create a void within the agricultural material. This void may accommodate dispensing of the fluid. In some instances, as the needles 202 are actuated in the direction 600, the needles 202 may move further into paper cones. For example, at a first instance, the needles 202 may move in the direction 206 by a first amount to be disposed to a first position within the agricultural material. After moving in the direction 600, at a second instance, the needles may move in the direction 206 by a second amount to be disposed at a second position within the agricultural material. The second amount may be greater than the first amount, and/or the second position may be deeper (e.g., further) into the agricultural material. Any number of cycles between moving the needles 202 in the direction 206 and the direction 600 may be performed. Ultimately, however, the second end 702 of the needles 202 are disposed at a bottom-most position within the agricultural material. From 2418, the process 2400 may proceed to "A" which is discussed in FIG. 25.

In FIG. 25, from "A", the process 2400 may proceed to 2420. At 2420, the process 2400 may include causing the fluid to be dispensed into the agricultural material. For example, the needles 202 may dispense fluid into the agricultural material. To dispense the fluid, the shaft 918 may be rotated via the actuator(s) 510 to move the shaft 918 to the first position. In the first position, the shaft 918 permits the flow of fluid to the needles 202. For example, the channels 1008 may align with the first orifices 1004, the second orifices 1006, the outlet 1610, and the inlet 1612. Moreover, the plungers 400 may be actuated via the actuator(s) 314. The actuator(s) 314 may urge the plungers 400 in the direction 206 to pressurize the fluid and force the fluid out the needles 202. In some instances, the amount of fluid dispensed may be based at least in part on the setting(s) 112. For example, the setting(s) 112 may indicate an amount of fluid to dispense into the agricultural material. In some instances, the setting(s) 112 may indicate an amount of actuation via the actuator(s) 314 to dispense the appropriate amount of fluid into the agricultural material.

At 2422, the process 2400 may include causing the needles to acuate in the third direction. For example, the actuator(s) 310 may actuate to move the needles 202 in the direction 600. In some instances, the needles 202 may be actuate in the direction 600 to dispose the second end 702 of the needles 202 at a different location within the agricultural material. For example, the fluid may be dispensed, or disposed, at different locations within the agricultural material. At 2420, the fluid may be disposed at a first location within the agricultural material (e.g., bottom-most position), and the needles 202 may be moved to different positions within the agricultural material to dispense the fluid at different locations. In some instances, as the needles 202 move in the direction 600, the shaft 918 may be rotated to the first position.

At 2424, the process 2400 may include causing the fluid to be dispensed into the agricultural material. For example, the needles 202 may dispense fluid into the agricultural material. To dispense the fluid, the shaft 918 may be rotated via the actuator(s) 510 to move the shaft 918 to the first position. In the first position, the shaft 918 permits the flow of fluid to the needles 202. To dispense the fluid, the actuator(s) 314 may be actuated to urge the plungers 400 in the direction 206 to pressurize the fluid and force the fluid out the needles 202. In some instances, the amount of fluid dispensed may be based at least in part on the setting(s) 112.

In some instances, the fluid may be dispensed as the needles 202 move in the direction 600. For example, as the needles 202 move in the direction 600 via actuation of the actuator(s) 310, the actuator(s) 314 may move in the plungers 400 in the direction 206 to dispense the fluid. In this manner, the fluid may be dispensed along a length, or over a distance, within the agricultural material. For example, if the setting(s) 112 indicate to dispense 1.5 mL into the paper cones, over a distance of two inches, the actuator(s) 312 and the actuator(s) 314 may be actuated accordingly. In some instances, at each step of the needles 202 within the agricultural material as the needles 202 move in the direction 600, the needles 202 may dispense a given amount of fluid. For example, if the needles 202 dispense fluid at six locations throughout the paper cone, at each location, the needles 202 may dispense 0.25 mL (e.g., 1.5 mL/6 locations).

At 2426, the process 2400 may determine whether the paper cones are filled. For example, the process 2400 may determine whether the paper cones have been filled with the determined amount of fluid. In some instances, the amount of fluid dispensed into the paper cones may be based on the setting(s) 112. If the setting(s) 112 indicate to dispense 1.5 mL into the paper cones, the process 2400 may determine whether 1.5 mL have been dispensed. In some instances, the sensor(s) 118 may be used to determine a position of the actuator(s) 314, a position of the plungers 400, etc., for knowing whether 1.5 mL have been dispensed, or whether the needles 202 need to dispense more fluid in the agricultural material. If at 2426, the process 2400 determines that paper cones have not been filled, the process 2400 may follow the "NO" route and proceed to 2422. For example, the needles 202 may be moved to different positions in the agricultural material to dispense addition fluid. Comparatively, if at 2426 the process 2400 determines that the paper cones have been filled, the process 2400 may follow the "YES" route and proceed to 2428.

At 2428, the process 2400 may include causing the needles to actuate in the third direction to retract the needles from the paper cones. For example, once the paper cones have been filled with the amount of fluid, the actuator(s) 310 may actuate to retract the needles 202 from the paper cones. When actuated in the direction 600, the second end 702 may be retracted from the paper cones. Retracting the needles 202 permits the tray 102 to be moved in the direction 304 without contacting the needles 202. In some instances, the shaft 918 may be moved to the second position as the needles 202 are retracted from the paper cones.

At 2430, the process 2400 may include causing the tray to move in the first direction to position a second row of the paper cones adjacent to the needles. For example, with the first row of paper cones filled, and the needles 202 retracted, the actuator(s) 106 may actuate to move the tray 102 in the direction 304. In some instances, the amount of movement of the tray 102 may be based at least in part on the setting(s) 112. For example, the setting(s) 112 may indicate an amount of movement in the direction 304 to align the needles 202 with the paper cones in the second row. In some instances, the setting(s) 112 indicate a spacing between the rows of the paper cones in the tray 102, and the actuator(s) 106 may actuate the tray 102 by a distance corresponding to the spacing.

At 2432, the process 2400 may include causing the needles to actuate in the second direction to dispose the needles into agricultural material within the paper cones. For example, the actuator(s) 310 may acuate to move the needles 202 in the direction 206 into the agricultural material. In some instances, the amount of actuation by the actuator(s) 310 in the direction 206 may be based at least in part on the setting(s) 112. The needles 202 may be actuated such that the second end 702 of the needles 202 are disposed within the agricultural material. In some instances, the second end 702 of the needles 202 may be disposed to a certain depth within the agricultural material. In some instances, the operation 2432 may be similar to the operation 2414.

At 2434, the process 2400 may include causing the needles to actuate in the third direction. In some instances, the actuator(s) 310 may move the needles 202 in the direction 600 to at least partially retract the needles 202 from the agricultural material. The movement of the needles 202 in the direction 600, and subsequently in the direction 206, may form a void in the agricultural material to accommodate the needle 202 and/or the fluid dispensed from the needle. The operation 2434 may be similar to the operation 2416.

At 2436, the process 2400 may include causing the needles to actuate in the second direction. For example, after retracting the needles 202 in the direction 600, the actuator(s) 310 may move the needles 202 in the direction 206. In some instances, the actuator(s) 310 may cycle between actuation in the direction 206 and the direction 600. For example, as the needles 202 are inserted into the agricultural material, the needles 202 may move in and up and down fashion to create a void within the agricultural material. This void may accommodate dispensing of the fluid. Ultimately, however, the second end 702 of the needles are disposed at a bottom-most position within the agricultural material. The operation 2436 may be similar to the operation 2418. From 2436, the process 2400 may proceed to "B" which is discussed in FIG. 26.

In FIG. 26, from "B", the process 2400 may proceed to 2438. At 2438, the process 2400 may include causing the fluid to be dispensed into the agricultural material. For example, the needles 202 may dispense fluid into the agricultural material. To dispense the fluid, the shaft 918 may be rotated via the actuator(s) 510 to move the shaft 918 to the first position. In the first position, the shaft 918 permits the flow of fluid to the needles 202. In some instances, the amount of fluid dispensed may be based at least in part on the setting(s) 112. For example, the setting(s) 112 may indicate an amount of fluid to dispense into the agricultural material. In some instances, the setting(s) 112 may indicate an amount of actuation via the actuator(s) 314 to dispense the appropriate amount of fluid into the agricultural material. The operation 2438 may be similar to the operation 2420.

At 2440, the process 2400 may include causing the needles to acuate in the third direction. For example, the actuator(s) 310 may actuate to move the needles 202 in the direction 600. In some instances, the needles 202 may be actuate in the direction 600 to dispose the second end 702 of the needles 202 at a different location within the agricultural material. For example, the fluid may be dispensed, or disposed, at different locations within the agricultural material. At 2438, the fluid may be disposed at a first location within the agricultural material (e.g., bottom-most position), and the needles 202 may be moved to different positions within the agricultural material to dispense the fluid at different locations. In some instances, as the needles 202 move in the direction 600, the shaft 918 may be rotated to the second position. The operation 2440 may be similar to the operation 2422.

At 2442, the process 2400 may include causing the fluid to be dispensed into the agricultural material. For example, the needles 202 may dispense fluid into the agricultural material. To dispense the fluid, the shaft 918 may be rotated via the actuator(s) 510 to move the shaft 918 to the first position. In the first position, the shaft 918 permits the flow of fluid to the needles 202. To dispense the fluid, the actuator(s) 314 may be actuated to urge the plungers 400 in the direction 206 to pressurize the fluid and force the fluid out the needles 202. In some instances, the amount of fluid dispensed may be based at least in part on the setting(s) 112. The setting(s) 112 may be used to dispose an appropriate amount of the fluid. The operation 2442 may be similar to the operation 2424.

At 2444, the process 2400 may determine whether the paper cones are filled. For example, the process 2400 may determine whether the paper cones have been filled with the determined amount of fluid. In some instances, the amount of fluid dispensed into the paper cones may be based on the setting(s) 112. If at 2444, the process 2400 determines that paper cones have not been filled, the process 2400 may follow the "NO" route and proceed 2440. For example, the needles 202 may be moved to different positions in the agricultural material to dispense additional fluid. Comparatively, if at 2444 the process 2400 determines that the paper cones have been filled, the process 2400 may follow the "YES" route and proceed to 2446. The operation 2444 may be similar to the operation 2426.

At 2446, the process 2400 may include causing the needles to actuate in the third direction to retract the needles from the paper cones. For example, once the paper cones have been filled with the amount of fluid, the actuator(s) 310 may actuate to retract the needles 202 from the paper cones. When actuated in the direction 600, the second end 702 may be retracted from the paper cones. Retracting the needles 202 permits the tray 102 to be moved in the direction 304 without contacting the needles 202. In some instances, the shaft 918 may be moved to the second position as the needles 202 are retracted from the paper cones. The operation 2446 may be similar to the operation 2428.

At 2448, the process 2400 may include determining whether there are additional rows of paper cones within the tray. For example, the process 2400 may determine whether all of the paper cones have been filled with the fluid. By way of example, if the tray 102 includes six of the rows of paper cones, the process 2400 may determine whether all of the paper cones across the six rows have been filled with fluid. In some instances, the sensor(s) 118 may be used to determine whether all of the rows have been filled, for example, based on a position of the tray 102. If at 2448 the process 2400 determines that there are additional rows to be filled, the process 2400 may follow the "YES" route and proceed to 2430. For example, the tray 102 may be moved in the direction 304 to position a third row of the paper cones adjacent to the needles 202. Comparatively, if at 2448 the process 2400 determines that there are no additional rows, the process 2400 may follow the "NO" route and proceed to 2450.

At 2450, the process 2400 may include causing output of a second notification. For example, the display 114 may output a notification that the paper cones have been filled with the fluid. Additionally, or alternatively, other I/O components may output the second notification. In some instances, after all of the rows of paper cones have been filled with the fluid, the tray 102 may retract along the tracks 302 in a direction opposite to the direction 304. For example, the tray 102 may be disposed away from the needles 202. Movement of the tray 102 to this position permits the tray 102 to be interchanged with another tray having paper cones that have yet to be filled with the fluid.

At 2452, the process 2400 may include causing the reservoir to be filled. For example, after dispensing the fluid into the paper cones, the reservoir 306 may be refilled. In some instances, the reservoir 306 may be refilled between trays 102, or between any number of trays 102 (e.g., three, four, etc.). In other words, the reservoir 306, or the cavity 1100, may hold a sufficient amount of fluid to dispense the fluid across any number of the paper cones across the trays 102. However, from time to time, the reservoir 306 needs to be refilled. In some instances, the pump 122(1) may supply the fluid from a container fluidly connected to the supply line 200. During filling of the reservoir 306, the actuator(s) 314 may move the piston in the direction 600.

Moreover, in some instances, after filling the paper cones within one of the trays 102, the plungers 400 may retract such that the chambers 914 may be refilled with the fluid. For example, the actuator(s) 314 may move the plungers 400 in the direction 600, and therein, the piston 308 may be actuated to urge the fluid into the chambers 914. From 2452, the process 2400 may loop to 2402 to fill additional paper cones across the trays 102.

Returning to 2410, if the process 2400 determines that there is not sufficient fluid, the process may follow the "NO" route and proceed to 2454. At 2454, the process 2400 may include causing output of a third notification. For example, the display 114 may output a notification that the reservoir 306 needs to be filled with fluid. From 2454, the process 2400 may proceed to 2452, whereby the reservoir 306 may be filled with the fluid.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative of some embodiments that fall within the scope of the claims.

What is claimed is:

1. An injection device comprising:
a reservoir including a cavity configured to receive a fluid;
a manifold coupled to the reservoir, the manifold including chambers fluidly connected to the cavity;
plungers, wherein individual plungers of the plungers are at least partially disposed within individual chambers of the chambers;
needles, wherein individual needles are fluidly connected to the individual chambers;
a tray configured to receive paper cones;
one or more processors; and
one or more non-transitory computer-readable media storing computer-executable instructions that, when executed by the one or more processors, cause the one or more processors to perform operations including:
receiving data associated with dispensing the fluid into the paper cones,
determining, based at least in part on data, one or more settings associated with dispensing the fluid,
causing the tray to actuate in a first direction to align individual paper cones of the paper cones with the individual needles,
causing the needles to actuate in a second direction to at least partially dispose the individual needles within the individual paper cones of the paper cones, and
causing the plungers to actuate in the second direction to dispense the fluid into the individual paper cones.

2. The injection device of claim 1, further comprising one or more heating elements disposed in at least one of the reservoir or the manifold.

3. The injection device of claim 1, wherein:
the reservoir includes:
first channels fluidly connected to the cavity, and
second channels fluidly connected to a catch; and
the manifold includes:
first channels fluidly connected to (i) individual first channels of the first channels of the reservoir and (ii) the individual chambers, and
second channels fluidly connected to (i) individual second channels of the second channels of the reservoir and (ii) the individual chambers.

4. The injection device of claim 1, wherein the manifold includes a passage, further comprising:
a sleeve disposed within the passage, the sleeve including a channel; and
a shaft disposed within the channel of the sleeve.

5. The injection device of claim 4, wherein:
the shaft is rotatable within the channel between a first position and a second position;
in the first position, the shaft permits the fluid to flow to the individual needles; and
in the second position, the shaft restricts the fluid to flow to the individual needles.

6. The injection device of claim 1, further comprising:
one or more first actuators configured to move the tray;
one or more second actuators configured to move the reservoir, the manifold, the plungers, and the needles; and
one or more second actuators configured to move the plungers independently of the reservoir, the manifold, and the needles.

7. The injection device of claim 1, wherein the one or more settings is associated with at least one of:
an amount of fluid to dispense into the individual paper cones;
an amount of actuation of the needles in the second direction; or
an amount of paper cones disposed in the tray.

8. A device comprising:
a reservoir including:
a cavity configured to receive a fluid, and
one or more channels fluidly connected to the cavity;
a manifold coupled to the reservoir, the manifold including:
one or more channels fluidly connected to individual channels of the one or more channels of the reservoir, and
one or more chambers fluidly connected to individual channels of the one or more channels of the manifold;
one or more plungers, wherein individual plungers of the one or more plungers are at least partially disposed within the individual channels of the manifold;
one or more needles, wherein individual needles of the one or more needles are configured to be fluidly connected to individual chambers of the one or more chambers;
one or more actuators coupled to the one or more plungers;
a tray configured to receive one or more paper cones;
one or more processors; and
one or more non-transitory computer-readable media storing computer-executable instructions that, when executed by the one or more processors, cause the one or more processors to perform operations including:
receiving data associated with one or more settings for dispensing the fluid into the one or more paper cones, and
causing, based at least in part on the one or more settings, the one or more actuators to actuate to dispense the fluid from the individual needles into individual paper cones of the one or more paper cones.

9. The device of claim 8, further comprising further comprising one or more heating elements disposed in at least one of the reservoir or the manifold.

10. The device of claim 8, further comprising a piston engaged with the reservoir, the piston being configured to actuate to pressurize the fluid within the cavity.

11. The device of claim 8, wherein the manifold includes a passage, further comprising:

a sleeve disposed within the passage, the sleeve including a channel; and a shaft disposed within the channel of the sleeve, the shaft being rotatable within the channel between a first position and a second position, wherein:

in the first position, the shaft permits the fluid to flow to the individual needles, and in the second position, the shaft restricts the fluid to flow to the individual needles.

12. The device of claim 8, the operations further including:

causing the one or more needles to acuate in a first direction to dispose the individual needles within the individual paper cones; and causing the one or more needles to acuate in a second direction, opposite the first direction, to retract the individual needles from the individual paper cones.

13. The device of claim 12, the operations further including causing the tray to actuation in a third direction to align the individual paper cones with the individual needles.

14. The device of claim 8, wherein the one or more settings is associated with at least one of:

an amount of fluid to dispense into the individual paper cones; or an amount of the one or more paper cones disposed in the tray.

15. A device comprising:

a reservoir including:

a cavity configured to receive a fluid, and channels fluidly connected to the cavity;

a manifold coupled to the reservoir, the manifold including:

channels fluidly connected to individual channels of the channels of the reservoir, and chambers fluidly connected to individual channels of the channels of the manifold;

plungers, wherein individual plungers of the plungers are at least partially disposed within the individual channels of the channels of the manifold;

needles, wherein individual needles of the needles are configured to be fluidly connected to individual chambers of the chambers;

at least one actuator coupled to the plungers;

one or more tracks configured to receive a tray containing paper cones;

one or more processors; and one or more non-transitory computer-readable media storing computer-executable instructions that, when executed by the one or more processors, cause the one or more processors to perform operations including:

causing the tray to actuate in to align individual paper cones of the paper cones with the individual needles of the needles, and causing the at least one actuator to actuate to dispense the fluid from the individual needles into the individual paper cones.

16. The device of claim 15, further comprising at least one second actuator, the operations further including causing the at least one actuator to actuate to at least partially dispose the individual needles within the individual paper cones.

17. The device of claim 15, further comprising one or more heating elements disposed in at least one of the reservoir or the manifold.

18. The device of claim 15, further comprising:

at least one second actuator configured to move the tray; and at least one third actuator configured to move the reservoir, the manifold, the plungers, and the needles, wherein the at least one actuator moves the plungers independent of the reservoir, the manifold, and the needles.

19. The device of claim 15, further comprising a catch, wherein:

the reservoir includes second channels fluidly connected to the catch; and the manifold includes second channels fluidly connected to individual second channels of the second channels of the reservoir, and the individual chambers.

20. The device of claim 15, the operations further including receiving data associated with one or more settings for dispensing the fluid, and wherein causing the at least one actuator to actuate to dispense the fluid is based at least in part on the one or more settings.

* * * * *